US008284178B2

(12) United States Patent
Yamashita et al.

(10) Patent No.: US 8,284,178 B2
(45) **Date of Patent: *Oct. 9, 2012**

(54) DISPLAY PANEL MODULE AND ELECTRONIC APPARATUS

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 461 days.

This patent is subject to a terminal disclaimer.

(21) Appl. No.: 12/461,666

(22) Filed: Aug. 20, 2009

(65) Prior Publication Data

US 2010/0079430 A1 Apr. 1, 2010

(30) Foreign Application Priority Data

Sep. 29, 2008 (JP) ..... 2008-251711

(51) Int. Cl.
*G09G 5/00* (2006.01)

(52) U.S. Cl. ..... 345/210; 345/211; 345/212

(58) Field of Classification Search ..... 345/76–82, 345/89–100, 204–215, 690; 315/169.1–169.4
See application file for complete search history.

(56) References Cited

U.S. PATENT DOCUMENTS

| | | | | |
|---|---|---|---|---|
| 6,229,506 | B1 * | 5/2001 | Dawson et al. | 345/82 |
| 6,229,508 | B1 * | 5/2001 | Kane | 345/82 |
| 6,356,026 | B1 * | 3/2002 | Murto | 315/111.81 |
| 6,693,388 | B2 * | 2/2004 | Oomura | 315/169.3 |
| 2005/0206590 | A1 | 9/2005 | Sasaki et al. | |
| 2007/0247399 | A1 | 10/2007 | Yamashita et al. | |

FOREIGN PATENT DOCUMENTS

| | | | |
|---|---|---|---|
| JP | 2003-255897 | | 9/2003 |
| JP | 2003-271095 | | 9/2003 |
| JP | 2005-099773 | A | 4/2005 |
| JP | 2005-173434 | | 6/2005 |
| JP | 2006-215213 | | 8/2006 |
| JP | 2007-155754 | A | 6/2007 |
| JP | 2008-033194 | A | 2/2008 |
| JP | 2008-058637 | A | 3/2008 |
| JP | 2008-170856 | A | 7/2008 |

OTHER PUBLICATIONS

Japanese Office Action issued Nov. 24, 2010 for corresponding Japanese Application No. 2008-251711.

* cited by examiner

*Primary Examiner* — Vijay Shankar

(74) *Attorney, Agent, or Firm* — Rader Fishman & Grauer, PLLC

(57) ABSTRACT

A self-light-emission-type display panel module employs: a pixel array section including pixel areas laid out to form a two dimensional matrix in a display area to serve as pixel areas each having a signal holding capacitor, a device driving transistor, and a signal sampling transistor; a first driving section; a second driving section; and a third driving section.

8 Claims, 44 Drawing Sheets

33

35

37

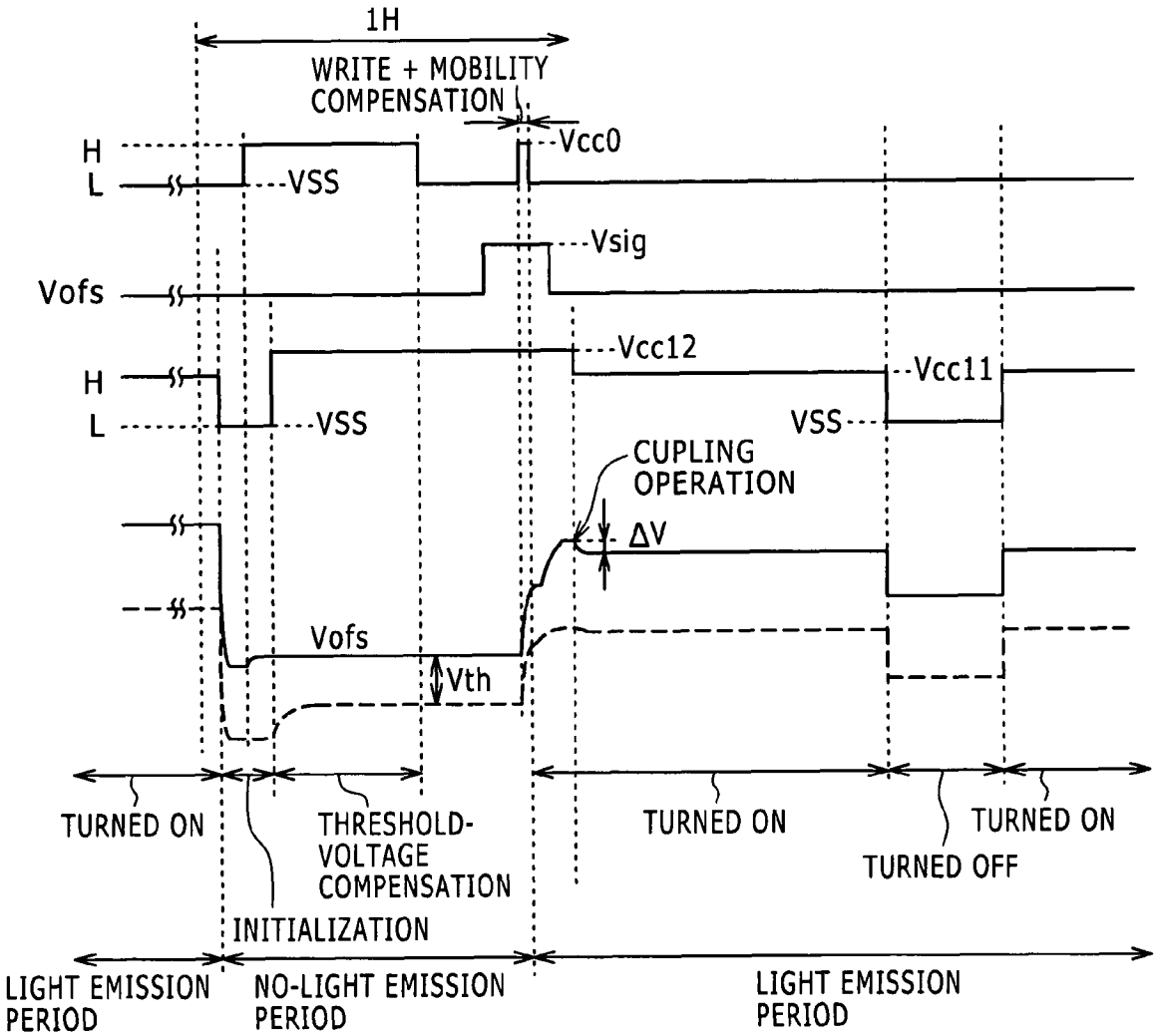
FIG.16A WSL
FIG.16B DTL
FIG.16C LSL
FIG.16D Vg
FIG.16E Vs

9

55

37

FIG.49A WSL
FIG.49B DTL
FIG.49C LSL
FIG.49D RSL
FIG.49E CSL
FIG.49F Vg
FIG.49G Vs

151

DISPLAY PANEL MODULE AND ELECTRONIC APPARATUS

BACKGROUND OF THE INVENTION

1. Field of the Invention

An invention described in this specification relates to a technology for driving a self-light-emitting device of a current-driven type. It is to be noted that an embodiment of the present invention is applied to a display panel module whereas another embodiment of the present invention is applied to a variety of electronic apparatus each employing the display panel module.

2. Description of the Related Art

The following description explains the structure of an organic EL (Electro Luminescence) panel module adopting an active matrix driving method as the structure of a typical display panel module and typical operations carried out by the organic EL panel module.

FIG. 1 is an explanatory block diagram showing a typical system structure of the organic EL panel module serving as a typical display panel module 1. As shown in the block diagram, the display panel module 1 employs a pixel array section 3, a signal-line driving section 5, a first control-line driving section 7 and a second control-line driving section 9. Each of the signal-line driving section 5, the first control-line driving section 7 and the second control-line driving section 9 is a circuit for driving the pixel array section 3.

In the pixel array section 3, each of pixels serves as a white unit. The pixels are laid out on the screen, which is formed by the pixel array section 3, to form a two dimensional matrix at resolutions prescribed in the vertical and horizontal directions.

FIG. 2 is an explanatory block diagram showing the configuration of a pixel which includes an array of sub-pixels 11 to serve as a white unit as described above. In the case of the configuration shown in the block diagram of FIG. 2, the pixel is configured to serve as a set which has an R (red color) sub-pixel 11, a G (green color) sub-pixel 11 and a B (blue color) sub-pixel 11. The number of sub-pixels 11 laid out on the pixel array section 3 is thus M×N×3 where reference notation N denotes the number of sub-pixels laid out on each row of the two dimensional matrix whereas reference notation M denotes the number of such rows laid out to form the two dimensional matrix. That is to say, the integer M represents the vertical-direction (or Y-direction) resolution whereas the integer N represents the horizontal-direction (or X-direction) resolution.

FIG. 1 shows interconnections between the circuits for driving the pixel array section 3 and the sub-pixels 11 which each serve as a smallest unit of the structure of each of the pixels composing the pixel array section 3.

The signal-line driving section 5 is a driving circuit for asserting a signal electric potential Vsig representing pixel data Din on a data signal line DTL. Each of the signal lines DTL is stretched in the vertical direction (or the Y direction). On the screen formed by the pixel array section 3, 3N signal lines DTL are laid out in the horizontal direction (or the X direction).

The first control-line driving section 7 is a driving circuit for driving write control signal lines WSL in order to sequentially control operations to write the signal electric potential Vsig or the like into sub-pixels 11 on a line-after-line basis. In the case of the display panel module 1 shown in the block diagram of FIG. 1, the first control-line driving section 7 sequentially carries out operations for each horizontal line unit (or each row of the two dimensional matrix) on a line-after-line basis in order to specify timings to write the signal electric potentials Vsig and offset electric potentials Vofs into sub-pixels 11.

The control-line driving section 9 is a driving circuit for controlling switching from an operation to supply a driving power to sub-pixels 11 through lighting control signal lines LSL to an operation to supply no driving power to sub-pixels 11 and vice versa. To put it more concretely, the second control-line driving section 9 asserts a high-level driving electric potential Vcc or a low-level driving electric potential Vss on the lighting control signal lines LSL. The driving electric potential Vcc is also referred to as a light emission electric potential whereas the ground electric potential Vss is referred to as a no-light emission electric potential.

In the case of the display panel module 1 shown in the block diagram of FIG. 1, each of the write control signal lines WSL and the lighting control signal lines LSL is stretched in the X direction (or the horizontal direction). 3M write control signal lines WSL are laid out in the Y direction (or the vertical direction). By the same token, 3M lighting control signal lines LSL are also laid out in the Y direction (or the vertical direction) as well.

FIG. 3 is an explanatory circuit diagram showing the structure of a sub-pixel 11. As shown in the circuit diagram of FIG. 3, the sub-pixel 11 employs a signal sampling transistor N1, a device driving transistor N2, a signal holding capacitor Cs and an organic EL device OLED. Each of the signal sampling transistor N1 and the device driving transistor N2 is a thin film transistor. The signal holding capacitor Cs is a capacitor for holding the gradation information supplied by the data signal line DTL.

One of the two main electrodes of the device driving transistor N2 is connected to the lighting control signal line LSL whereas the other main electrode of the device driving transistor N2 is connected the anode of the organic EL device OLED.

It is to be noted that, in the case of the sub-pixel 11 shown in the circuit diagram of FIG. 3, each of the signal sampling transistor N1 and the device driving transistor N2 is a thin-film transistor of the N-channel type. The circuit diagram of FIG. 3 also shows capacitors Coled and Csub each drawn by making use of a dashed line. The device capacitor Coled represents the capacitance of the organic EL device OLED whereas the parasitic capacitor Csub is a parasitic capacitor which exists between the device capacitor Coled and a substrate. Patent Document 1:

Japanese Patent Laid-Open No. 2003-271095 Patent Document 2:

Japanese Patent Laid-Open No. 2003-255897 Patent Document 3:

Japanese Patent Laid-Open No. 2005-173434 Patent Document 4:

Japanese Patent Laid-Open No. 2006-215213

SUMMARY OF THE INVENTION

FIGS. 4A to 4E show explanatory timing charts of operations to drive the sub-pixel 11 described above. To be more specific, FIG. 4A is a timing chart showing a waveform representing changes of a driving signal appearing on the write control signal line WSL whereas FIG. 4B is a timing chart showing a waveform representing changes of a driving signal appearing on the data signal line DTL. FIG. 4C is a timing chart showing a waveform representing changes of a driving signal appearing on the lighting control signal line LSL whereas FIG. 4D is a timing chart showing a waveform representing changes of a gate electric potential Vg appearing at the gate electrode of the device driving transistor N2. FIG. 4E is a timing chart showing a waveform representing changes of a source electric potential Vs appearing at the source electrode of the device driving transistor N2. In this case, the source electric potential Vs appearing at the source electrode of the device driving transistor N2 is an electric potential appearing at the main electrode which pertains to the device driving transistor N2 to serve as the source electrode at a light emission time.

As shown in the timing charts of FIGS. 4A to 4E, the operations to drive the sub-pixel 11 are carried out during a light emission period and a no-light emission period. The operation to store a signal electric potential Vsig in the signal holding capacitor Cs is started in the no-light emission period. If the thin-film transistors N1 and N2 are created by carrying out a low-temperature poly-silicon process and/or an amorphous silicon process, however, the transistors exhibit variations of the threshold-voltage characteristic and the mobility characteristic. That is to say, the threshold-voltage characteristic and the mobility characteristic vary from transistor to transistor.

In order to compensate the device driving transistor N2 for the characteristic variations described above, a horizontal scan period denoted by reference notation 1H in the timing charts of FIGS. 4A to 4E is set to include two operation periods provided for compensating the device driving transistor N2 for the characteristic variations described above. That is to say, the no-light emission period denoted by reference notation 1H includes two periods in each of which the write control signal line WSL is set at an H (high) level.

In the first period during which the write control signal line WSL is set at the H level, a threshold-voltage compensation process is carried out whereas, in the second period during which the write control signal line WSL is set at the H level, on the other hand, a mobility compensation process is carried out. It is to be noted that, prior to the execution of the threshold-voltage compensation process, an initialization operation is carried out in order to increase a gate-source voltage Vgs appearing between the gate and source electrodes of the device driving transistor N2 to a magnitude at least equal to the threshold voltage Vth of the device driving transistor N2. In order to carry out this initialization operation, the lighting control signal line LSL is controlled to temporarily decrease to an L (low) level which is the level of the ground electric potential Vss cited before. At a point of time at which the initialization operation is completed, the gate-source voltage Vgs of the device driving transistor N2 has a magnitude at least equal to the threshold voltage Vth of the device driving transistor N2. Thus, when the lighting control signal line LSL is controlled to increase to an H (high) level which is the level of the driving electric potential Vcc, a driving current Ids starts to flow to the device driving transistor N2, starting to raise the source electric potential Vs appearing at the source electrode of the device driving transistor N2.

Prior to the end of the initialization operation, the gate electric potential Vg appearing at the gate electrode of the device driving transistor N2 has been fixed at the offset electric potential Vofs. The source electric potential Vs of the device driving transistor N2 continues to rise till the gate-source voltage Vgs of the device driving transistor N2 is reduced to the threshold voltage Vth. This is because, as the gate-source voltage Vgs of the device driving transistor N2 is reduced to the threshold voltage Vth of the device driving transistor N2, the device driving transistor N2 is automatically turned off. The operation is referred to as the threshold-voltage compensation process.

As described above, in the second period during which the write control signal line WSL is set at the H level, a mobility compensation process is carried out. It is to be noted that, during the execution of the mobility compensation process, an operation to store the signal electric potential Vsig in the signal holding capacitor Cs is also carried out as well at the same time.

The mobility compensation process is carried out by putting the signal sampling transistor N1 in a turned-on state after the signal electric potential Vsig has been asserted on the data signal line DTL. It is to be noted that the mobility μ represents the current generating capability of the device driving transistor N2. A device driving transistor N2 having a relatively large mobility p is capable of generating a driving current Ids greater than a driving current Ids generated by a device driving transistor N2 having a relatively small mobility μ even if the gate-source voltage Vgs of the driving transistor N2 having a relatively large mobility μ is set at a magnitude equal to the gate-source voltage Vgs of the driving transistor N2 having a relatively small mobility p. For this reason, the mobility compensation process is carried out in order to compensate the device driving transistor N2 for the mobility μ which varies from transistor to transistor, causing the driving current Ids to also vary from transistor to transistor. The gate-source voltage Vgs of a device driving transistor N2 is reduced due to the increase of the source electric potential Vs of the device driving transistor N2 by such an electric-potential decrease that the larger the mobility μ of the device driving transistor N2, the larger the electric-potential decrease. Thus, without regard to differences in mobility μ, any device driving transistor N2 having a relatively large mobility μ generates a driving current Ids equal to a driving current Ids generated by a device driving transistor N2 having a relatively small mobility μ provided that the gate-source voltage Vgs of the driving transistor N2 having a relatively large mobility μ is set at a magnitude equal to the gate-source voltage Vgs of the driving transistor N2 having a relatively small mobility p, that is, provided that the same signal electric potential Vsig is applied to the gate electrodes of the driving transistors N2.

By the way, the length of the time t that it takes to properly carry out the mobility compensation process varies in accordance with the magnitude of the signal electric potential Vsig.

In general, the magnitude of the driving current Ids flowing in the course of the mobility compensation process is expressed by Eq. (1) given as follows:

$$Ids=k\cdot\mu\cdot\{Vsig/[1+(Vsig\cdot k\cdot\mu\cdot t)/C]\}^2 \quad (1)$$

In Eq. (1) given above, reference notation k denotes a constant whereas reference notation C denotes the total capacitance of the pixel circuit. That is to say, reference notation C denotes a capacitance expressed by the following equation:

$$C=Cs+Coled+Csub$$

The optimum length of the time t that it takes to carry out the mobility compensation process is expressed by Eq. (2) given as follows:

$$t=C/(k\cdot\mu\cdot Vsig) \quad (2)$$

Eq. (2) is substituted into Eq. (1) to serve as a replacement for the time t in order to find a driving current Ids for the optimized length of the time t. The driving current Ids for the optimized length of the time t is thus expressed by Eq. (3) given as follows:

$$Ids=k\cdot\mu\cdot\{Vsig/2\}^2 \quad (3)$$

Eq. (3) means that the optimum mobility compensation time found by calculation in accordance with Eq. (2) is the time that it takes to raise the source electric potential Vs of the device driving transistor N2 by an electric-potential increase equal to half the signal electric potential Vsig. In other words, Eq. (3) implies that, the gate-source voltage Vgs is raised by a mobility-compensation voltage ΔV which is equal to half the signal electric potential Vsig.

FIG. 5 is an explanatory diagram showing relations between a mobility-compensation voltage ΔV and a mobility compensation time that it takes to obtain the mobility-compensation voltage ΔV for different magnitudes of the signal electric potential Vsig. A bold-line curve shown in the diagram of FIG. 5 represents a relation between an optimum mobility compensation time period t and the mobility-compensation voltage ΔV when the mobility compensation process is carried out.

The timing of the falling edge of the second H-level period shown in the timing chart of FIG. 4A is adjusted properly to change in accordance with the bold-line curve shown in the diagram of FIG. 5 so that the mobility compensation process can be carried out during a proper mobility compensation period to result in neither insufficient compensation nor excessive compensation for every magnitude of the signal electric potential Vsig.

FIGS. 6A to 6D show typical examples of the explanatory timing charts for the mobility compensation process. The timing charts of FIGS. 6A to 6D represent waveforms for a signal electric potential Vsig of 3 V (when the offset electric potential is set to 0 V). To be more specific, FIG. 6A is a timing chart showing a waveform representing changes of the driving signal appearing on the write control signal line WSL whereas FIG. 6B is a timing chart showing a waveform representing changes of the driving signal appearing on the lighting control signal line LSL. FIG. 6C is a timing chart showing a waveform representing changes of the gate electric potential Vg appearing at the gate electrode of the device driving transistor N2 whereas FIG. 6D is a timing chart showing a waveform representing changes of the source electric potential Vs appearing at the source electrode of the device driving transistor N2.

As shown in the timing chart of FIG. 6D, during the mobility compensation period t, the gate electric potential Vg of the device driving transistor N2 rises by 1.5 V. Accordingly, the gate-source voltage Vgs of the device driving transistor N2 becomes equal to 4 V+Vth−2 V=1.5 V+Vth.

By carrying out the threshold-voltage compensation process and the optimized mobility compensation process, the device driving transistor N2 can be compensated for variations in threshold voltage from transistor to transistor and variations in mobility from transistor to transistor. As a result, it is possible to prevent the characteristic variations of the device driving transistor N2 from being recognized as differences in emitted-light luminance.

By the way, the contemporary display panel raises a problem that sufficient time is not allocated to the mobility compensation process as mobility compensation time. This problem is caused by higher definition/resolution of the display panel and the use of a higher driving frequency in the display panel.

As described before, the mobility compensation time is determined by the signal electric potential Vsig. Thus, the lower the gradation of an area, the longer the mobility compensation time for the area as shown in a diagram of FIG. 5. Then, if the mobility compensation process carried out for an area of low gradations cannot also be completed, the mobility compensation process for the area cannot be regarded to have been completed.

That is to say, the driving time of a pixel circuit cannot be shortened to a time period which is shorter than the time that it takes to complete the mobility compensation process carried out for an area of low gradations.

It is thus difficult to take a technological measure to solve the problem which is caused by a higher definition/resolution of the display panel and the use of a higher driving frequency in the display panel.

Addressing the problems described above, inventors of the present invention have innovated a self-light-emission-type display panel module employing:

(a) a pixel array section including pixel areas laid out to form a two dimensional matrix in a display area to serve as pixel areas each having a signal holding capacitor, a device driving transistor provided with a control electrode connected to a specific one of the two electrodes of the signal holding capacitor and a specific main electrode connected to the other electrode of the signal holding capacitor to serve as a transistor for providing a self-light-emitting device connected to the device driving transistor with a driving current having a magnitude according to a voltage stored in the signal holding capacitor, and a signal sampling transistor for controlling an operation to supply a signal electric potential to the control electrode of the device driving transistor;

(b) a first driving section configured to assert the signal electric potential on a data signal line;

(c) a second driving section configured to assert an electric-potential write timing signal on a first control line connected to the control electrode of the signal sampling transistor; and (d) a third driving section configured to provide a second control line connected to the other main electrode of the device driving transistor sequentially from time to time with the following three different driving voltages a first driving voltage having a lowest electric potential during a time span between the initial time of a no-light emission period and the start of a period for compensating the device driving transistor for characteristic variations, a second driving voltage having a highest electric potential during a time span between the start of the period for compensating the device driving transistor and an initial portion of a light emission period, and a third driving voltage having an intermediate electric potential after the initial portion of the light emission period.

In addition, addressing the problems described above, the inventors of the present invention have innovated a self-light-emission-type display panel module employing:

(a) a pixel array section including pixel areas laid out to form a two dimensional matrix in a display area to serve as pixel areas each having a signal holding capacitor, a device driving transistor provided with a control electrode connected to a specific one of the two electrodes of the signal holding capacitor and a specific main electrode connected to the other electrode of the signal holding capacitor to serve as a transistor for providing a self-light-emitting device connected to the device driving transistor with a driving current having a magnitude according to a voltage stored in the signal holding capacitor, a signal sampling transistor for controlling an operation to supply a signal electric potential to the control electrode of the device driving transistor, and a coupling capacitor having a specific electrode connected to the control electrode of the device driving transistor and the other electrode connected to a third control line;

(b) a first driving section configured to assert the signal electric potential on a data signal line;

(c) a second driving section configured to assert an electric-potential write timing signal on a first control line connected to the control electrode of the signal sampling transistor;

(d) a third driving section configured to control an operation to supply a driving voltage to the device driving transistor and an operation to stop the operation to supply a driving voltage to the device driving transistor; and (e) a fourth driving section configured to provide the third control line sequentially from time to time with the following two different driving voltages a high-level driving voltage having a relatively high electric potential during a time span between the start of a characteristic compensation period and an initial portion of a light emission period, and a low-level driving voltage having a relatively low electric potential after the initial portion of the light emission period.

The display panel module wherein a period T used to assert each signal electric potential corresponding to a pixel gradation is set at a value shorter than a mobility compensation time t calculated for the signal electric potential.

By the way, the self-light-emission-type display panel module explained above can also be described as a display panel module employing:

(a) a pixel array section including pixel areas laid out to form a two dimensional matrix in a display area to serve as pixel areas each having at least a signal holding capacitor, a device driving transistor provided with a control electrode connected to a specific one of the two electrodes of the signal holding capacitor and a specific main electrode connected to the other electrode of the signal holding capacitor to serve as a transistor for providing a self-light-emitting device connected to the device driving transistor with a driving current having a magnitude according to a voltage stored in the signal holding capacitor, and a signal sampling transistor for controlling an operation to supply a signal electric potential to the control electrode of the device driving transistor;

(b) a first driving section configured to assert the signal electric potential on a data signal line;

(c) a second driving section configured to assert an electric-potential write timing signal on a first control line connected to the control electrode of the signal sampling transistor; and (d) a third driving section configured to decrease an electric potential appearing at the control electrode of the device driving transistor through a coupling effect exercised after an initial portion of a light emission period.

In addition, the inventors of the present invention have also innovated an electronic apparatus including the self-light-emission-type display panel module employing the sections described above.

The electronic apparatus is configured to employ the display panel module, a system control section and an operation input section. The system control section is a section for controlling operations carried out in the entire electronic apparatus. The operation input section is a section for receiving operation inputs entered by the user to the system control section.

In the case of an invention innovated by the inventors of the present invention, a third driving section decreases an electric potential appearing at the control electrode of the device driving transistor through a coupling effect exercised after the start of a light emission period in order to optimize the gate-source voltage of the device driving transistor.

That is to say, in a signal electric-potential write operation, a mobility compensation time is shortened by using a signal electric potential higher than a signal electric potential required to obtain electric-potential relations which prevail in the light emission period. In addition, the matching of the mobility compensation quantity and the signal electric potential is assured by a coupling operation carried out later.

In the case of this driving method, the decrease of the mobility compensation time can be adjusted in accordance with a coupling quantity. As a result, it is possible to also keep up with a higher definition/resolution of the panel and a higher driving frequency used in the panel.

BRIEF DESCRIPTION OF THE DRAWINGS

These and other innovations as well features of the present invention will become clear from the following description of the preferred embodiments given with reference to the accompanying diagrams, in which:

FIGS. 16A to 16E are timing charts showing waveforms representing changes of a driving signal according to the first embodiment;

DETAILED DESCRIPTION OF THE PREFERRED EMBODIMENTS

The following description explains a case in which the present invention is applied to an organic EL panel module of an active matrix driving type. It is to be noted that, to embodiment members neither described in this specification nor shown in diagrams included in the specification, it is possible to apply technologies commonly known in the same fields as the members and/or technologies disclosed to the public as technologies pertaining to the same fields as the members. In addition, preferred embodiments described below are merely typical implementations of the present invention. That is to say, implementations of the present invention are by no means limited to the preferred embodiments.

(A): External Configuration

The technical term 'display panel module' used in this specification means not only a display panel module employing a pixel array section and driving circuits created on the same substrate as the pixel array section by carrying out semiconductor processes, but also other display panel modules such as a display panel module employing a pixel array section and driving circuits each created to serve as an ASIC (Application-Specific Integrated Circuit) on the same substrate as the pixel array section.

Figure 7:
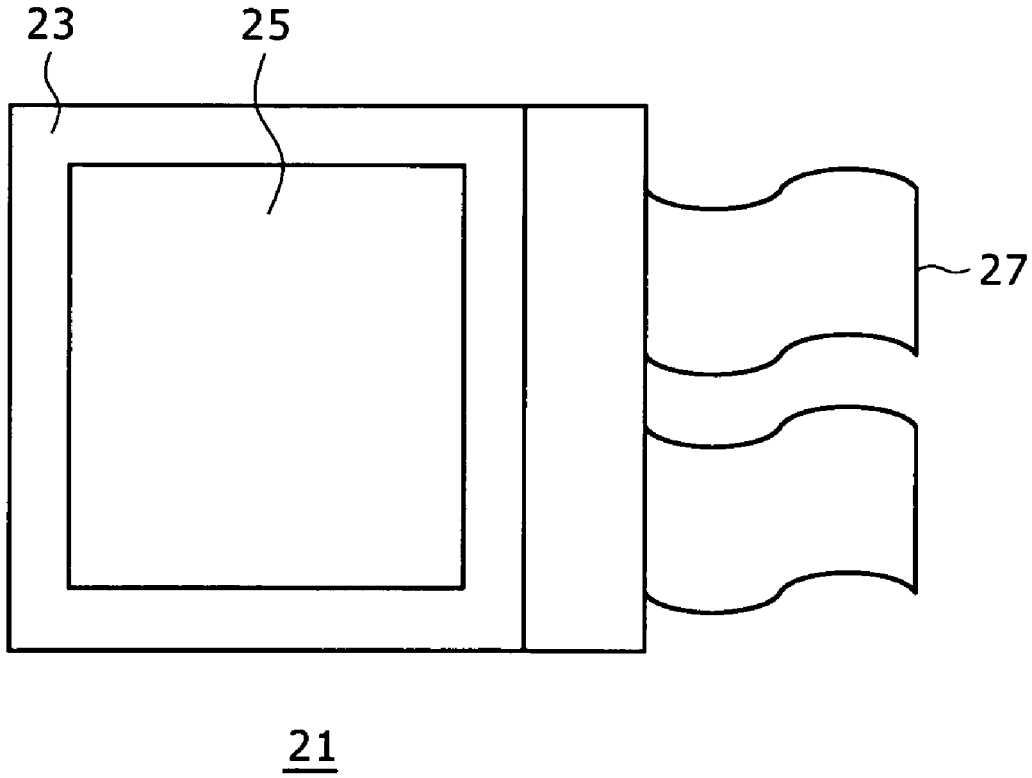
FIG. 7 is a diagram showing a typical external configuration of an organic EL panel module.

FIG. 7 is a diagram showing a typical external configuration of the organic EL panel module 21. As shown in the figure, the organic EL panel module 21 has a structure in which a facing substrate 25 is pasted on a display area of a support substrate 23. The support substrate 23 is made of a base material such as glass or plastic. The facing substrate 25 is also made of a transparent base material such as glass or plastic.

The base material of the facing substrate 25 seals the surface of the support substrate 23, sandwiching a sealing material between the base material of the facing substrate 25 and the surface. It is to be noted that the transparency of the base material of the facing substrate 25 needs to be assured merely on the radiation side of light. That is to say, on other sides, the base material of the facing substrate 25 can be nontransparent. In addition, the organic EL panel module 21 is also provided with an FPC (Flexible Print Circuit) 27 for receiving external signals and a driving power.

(B): First Embodiment (B-1): System Configuration

Figure 1:
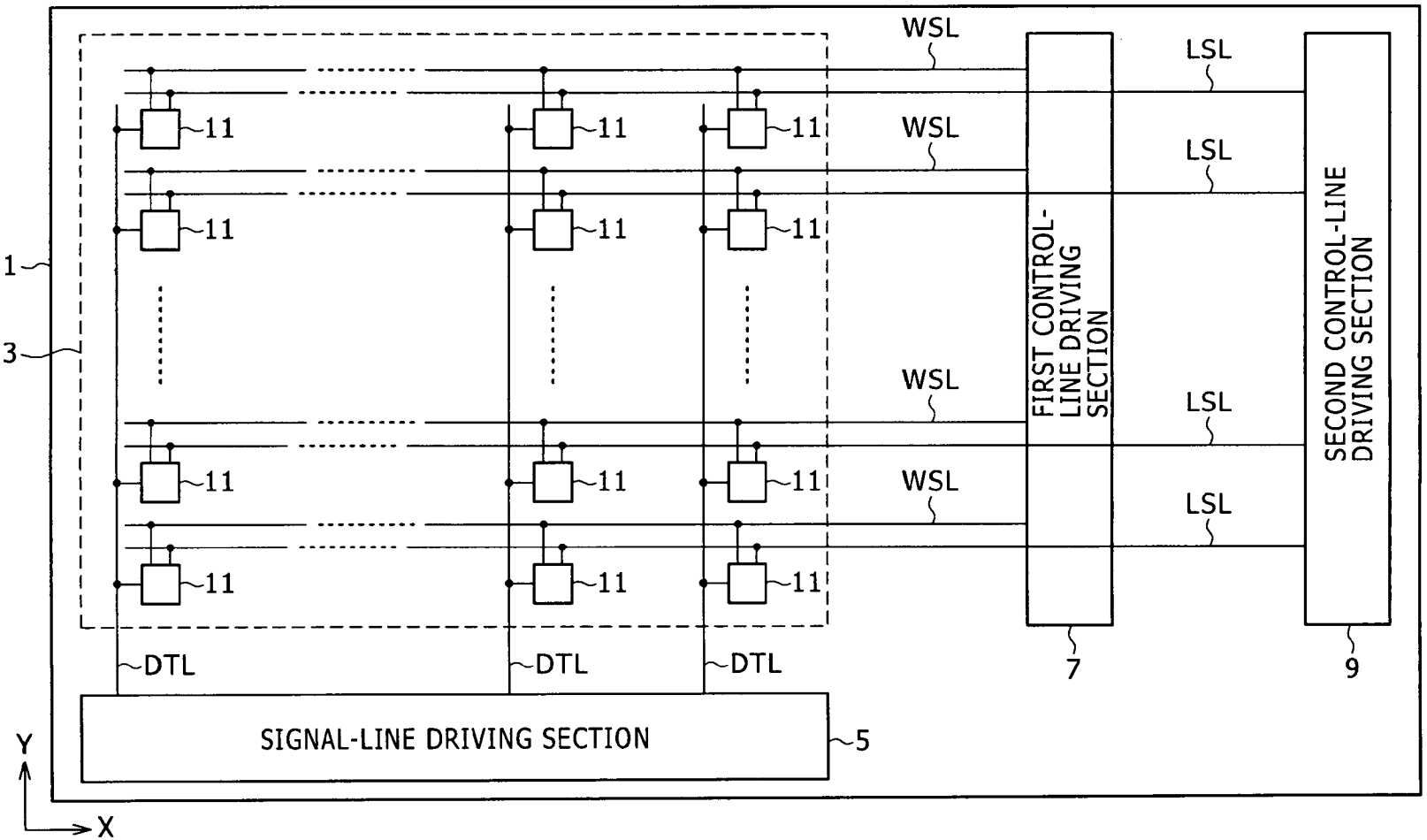
FIG. 1 RELATED ART
FIG. 1 is an explanatory block diagram showing a typical system structure of an organic EL panel module serving as a typical display panel module.
Figure 2:
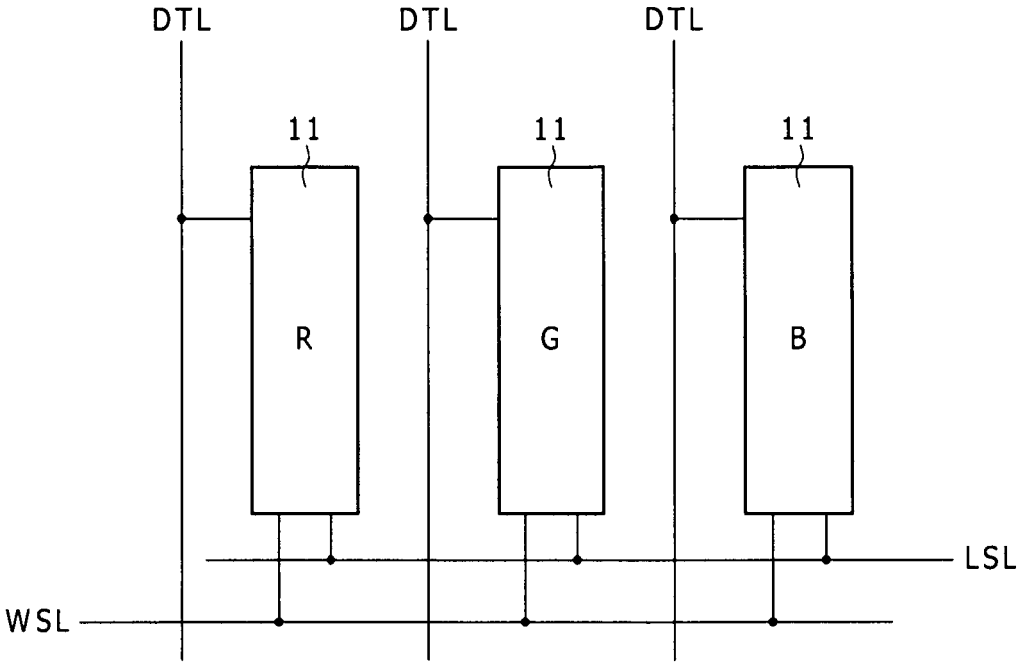
FIG. 2 RELATED ART
FIG. 2 is an explanatory block diagram showing the configuration of a pixel which includes an array of sub-pixels.
Figure 8:
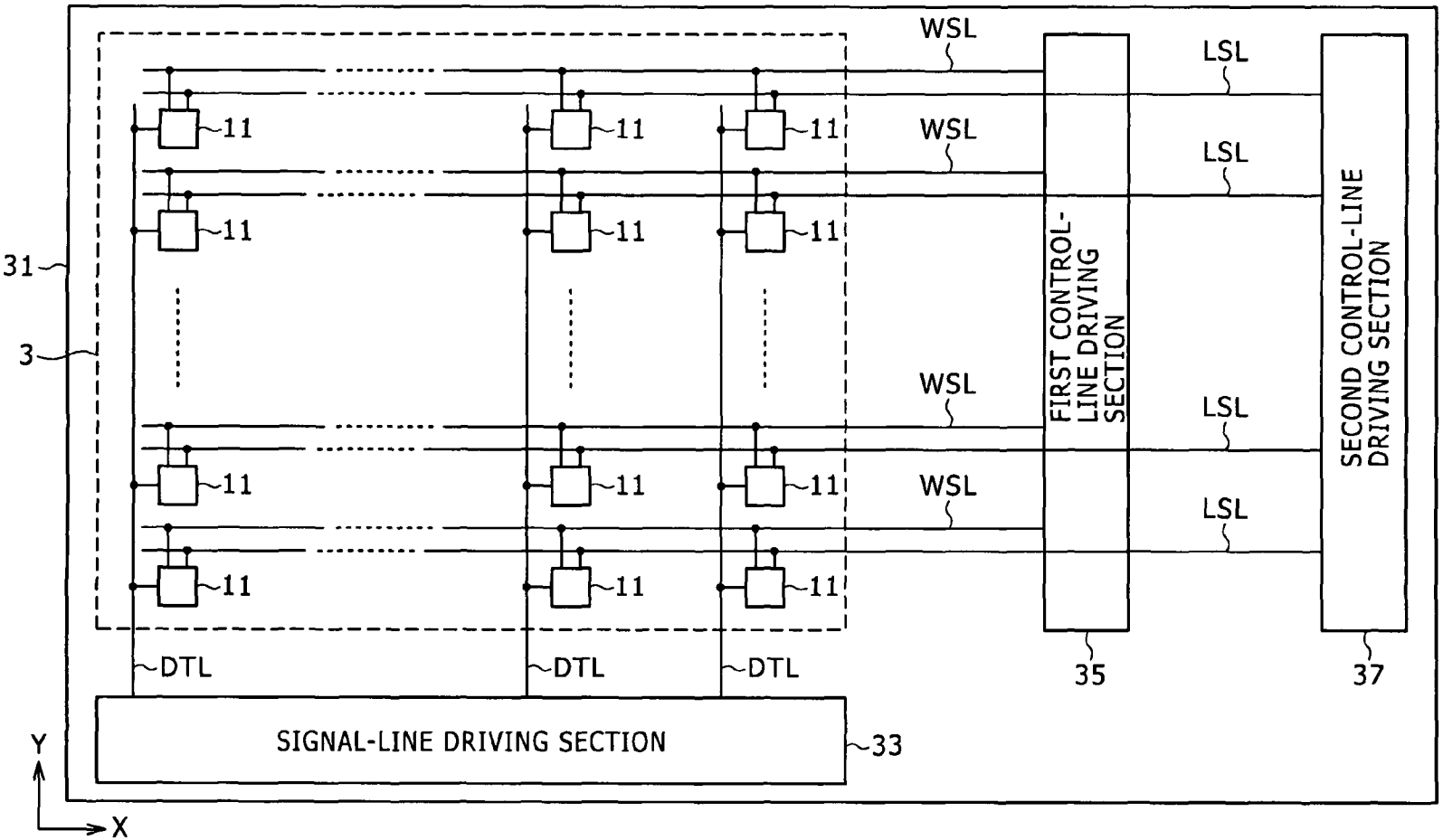
FIG. 8 is a block diagram showing a typical system configuration of an organic EL panel module according to a first embodiment.

FIG. 8 is a block diagram showing a typical system configuration of an organic EL panel module 31 according to a first embodiment. In the block diagram of FIG. 8, components identical with their respective counterparts shown in the block diagram of FIG. 1 are denoted by the same reference numerals or the same reference notations as the counterparts.

The organic EL panel module 31 shown in the block diagram of FIG. 8 employs a pixel array section 3, a signal-line driving section 33, a first control-line driving section 35 and a second control-line driving section 37. Each of the signal-line driving section 33, the first control-line driving section 35 and the second control-line driving section 37 is a circuit for driving the pixel array section 3.

The following description explains the configurations of the driving circuits as configurations peculiar to the first embodiment.

(a): Pixel Array Section

Figure 9:
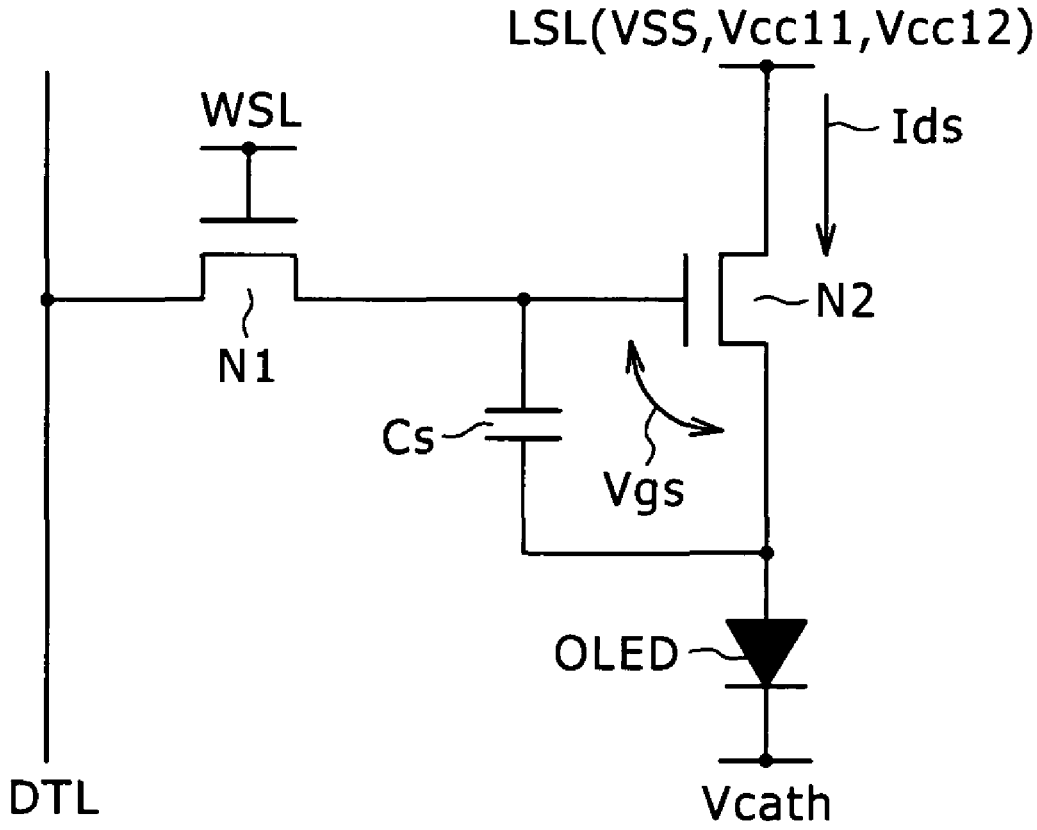
FIG. 9 is an explanatory circuit diagram showing the structure of a sub-pixel used in the first embodiment.

In the pixel array section 3, each of pixels serves as a white unit. The pixels are laid out on the screen, which is formed by the pixel array section 3, to form a two dimensional matrix at resolutions prescribed in the vertical and horizontal directions. In addition, as shown in a diagram of FIG. 9, a sub-pixel 11 included in a white unit is configured to employ a thin-film transistor N1, a thin-film transistor N2, a signal holding capacitor Cs used for storing gradation information, a coupling capacitor Cc and an organic EL device OLED. In the case of this embodiment, however, three different driving voltages are asserted on a lighting control signal line LSL which is connected to one of the two main electrodes of the thin-film transistor N2. The three different driving voltages are an off voltage and two different on voltages.

(b): Configuration of the Signal-Line Driving Section

The signal-line driving section 33 is a driving circuit for asserting the signal electric potential Vsig on the data signal line DTL to represent pixel data Din.

Figure 10:
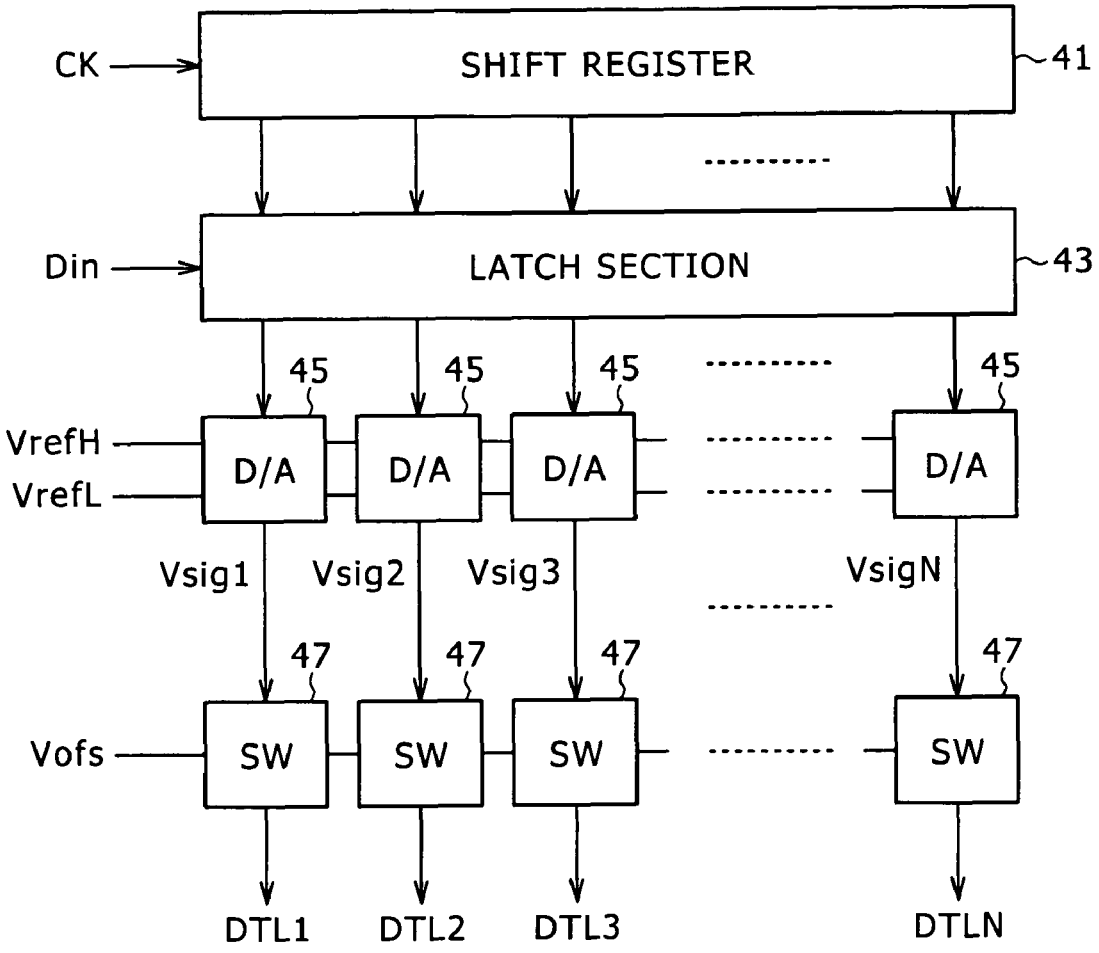
FIG. 10 is a diagram showing a typical configuration of a signal-line driving section.

FIG. 10 is a diagram showing a typical internal configuration of the signal-line driving section 33. As shown in the figure, the signal-line driving section 33 employs a shift register 41, a latch section 43, digital-to-analog conversion circuits 45 and switches 47. The shift register 41 is a circuit for generating signals indicating timings to latch pixel data Din in the latch section 43 on the basis of a clock signal CK.

The latch section 43 is a storage device for storing pixel data Din in a storage area allocated to the pixel data Din on the basis of timing signals generated by the shift register 41.

The digital-to-analog conversion circuit 45 is a circuit for converting pixel data Din latched in the latch section 43 into an analog signal voltage used as the signal electric potential Vsig. It is to be noted that the conversion characteristic of the digital-to-analog conversion circuit 45 is determined by an H-level reference electric potential VrefH and an L-level reference electric potential VrefL.

This embodiment adopts a driving method for lowering the gate electric potential Vg appearing at the gate electrode G of the device driving transistor N2 through a coupling effect exercised after the start of a light emission period as will be described alter.

Thus, the digital-to-analog conversion circuit 45 adjusts the reference electric potential so as to obtain a signal amplitude for an assumed voltage drop which will occur at a coupling driving time. To put it more concretely, the H-level reference electric potential VrefH is set at an electric potential higher than the signal amplitude realized after the coupling effect by a coupling voltage. It is needless to say that, the larger the coupling effect, the greater the importance to increase the H-level reference electric potential VrefH.

Figure 11:
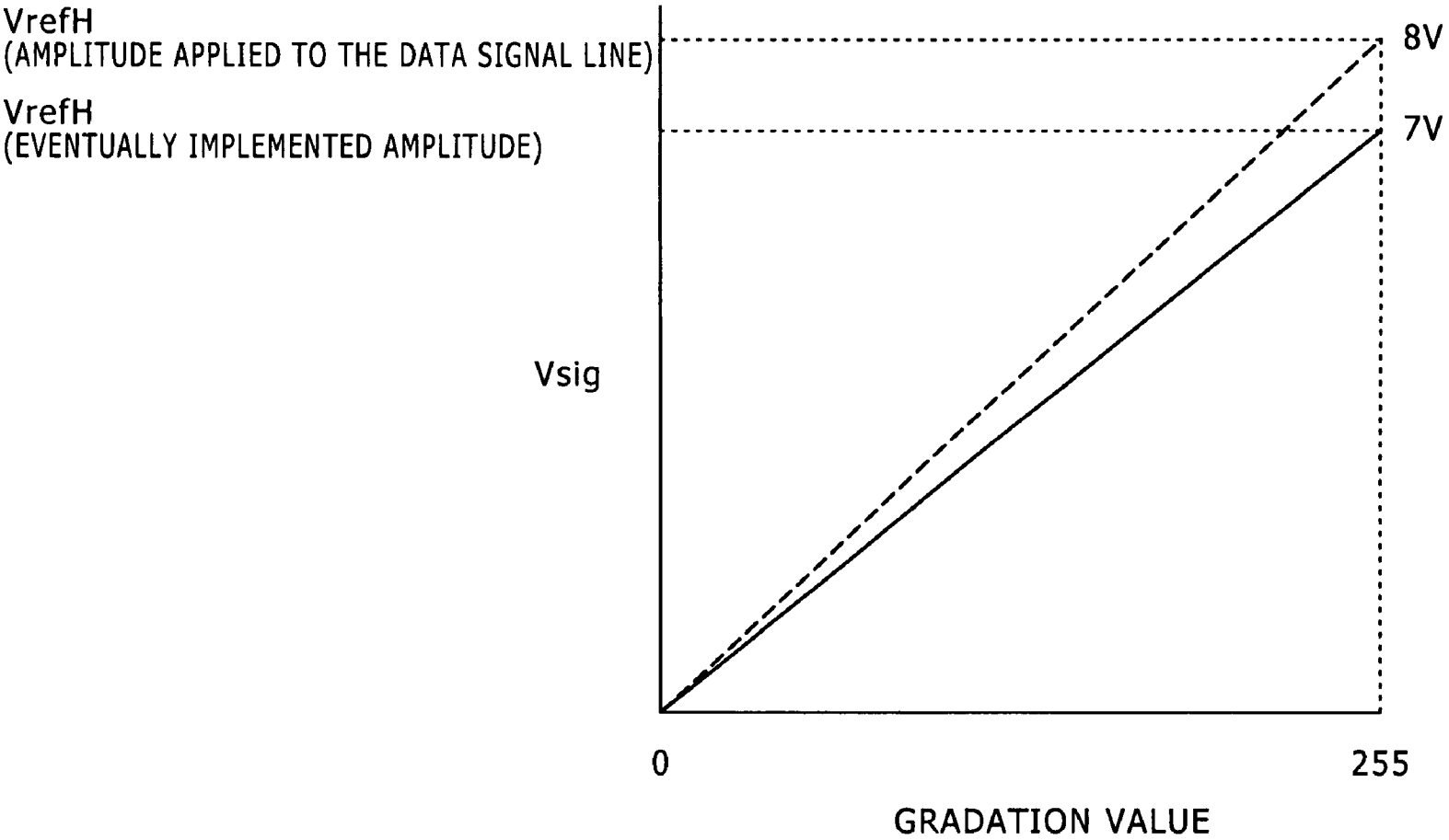
FIG. 11 is an explanatory diagram showing a relation between a dashed line representing a input/output characteristic for a video signal applied to a data signal line and a solid line representing an input/output characteristic eventually implemented through a coupling operation.

FIG. 11 is an explanatory diagram showing a relation between a dashed line representing a input/output characteristic for a video signal applied to the data signal line DTL and a solid line representing an input/output characteristic eventually implemented through a coupling operation in this embodiment. In the case of this embodiment, the digital-to-analog conversion circuit 45 sets the H-level reference electric potential VrefH at 8 V so as eventually obtain the same signal amplitude as a case in which a signal amplitude of 7 V is applied.

In this way, the amplitude of the signal electric potential Vsig asserted on the data signal line DTL is greater than the eventually realized signal amplitude. Thus, the time that it takes to carry out a mobility compensation process is also shorter than the time that it takes to carry out a mobility compensation process for a case in which the coupling operation is not performed. In particular, the effect of the shortened mobility compensation period in an area of low gradations is large.

The switch 47 is a circuit for selecting the signal electric potential Vsig corresponding to the pixel gradation or the offset electric potential Vofs used for the threshold-voltage compensation process and for supplying the selected one to a data signal line DTL provided for the selected one. To put it more concretely, the switch 47 outputs the offset electric potential Vofs during a threshold-voltage compensation period or the signal electric potential Vsig during a period in which an operation to store the signal electric potential Vsig and the mobility compensation process are carried out at the same time.

(c): Configuration of the First Control-Line Driving Section

The first control-line driving section 35 is a driving circuit for driving the write control signal lines WSL in order to sequentially control operations to write the signal electric potential Vsig or the like into sub-pixels 11 on a line-after-line basis.

Figure 12:
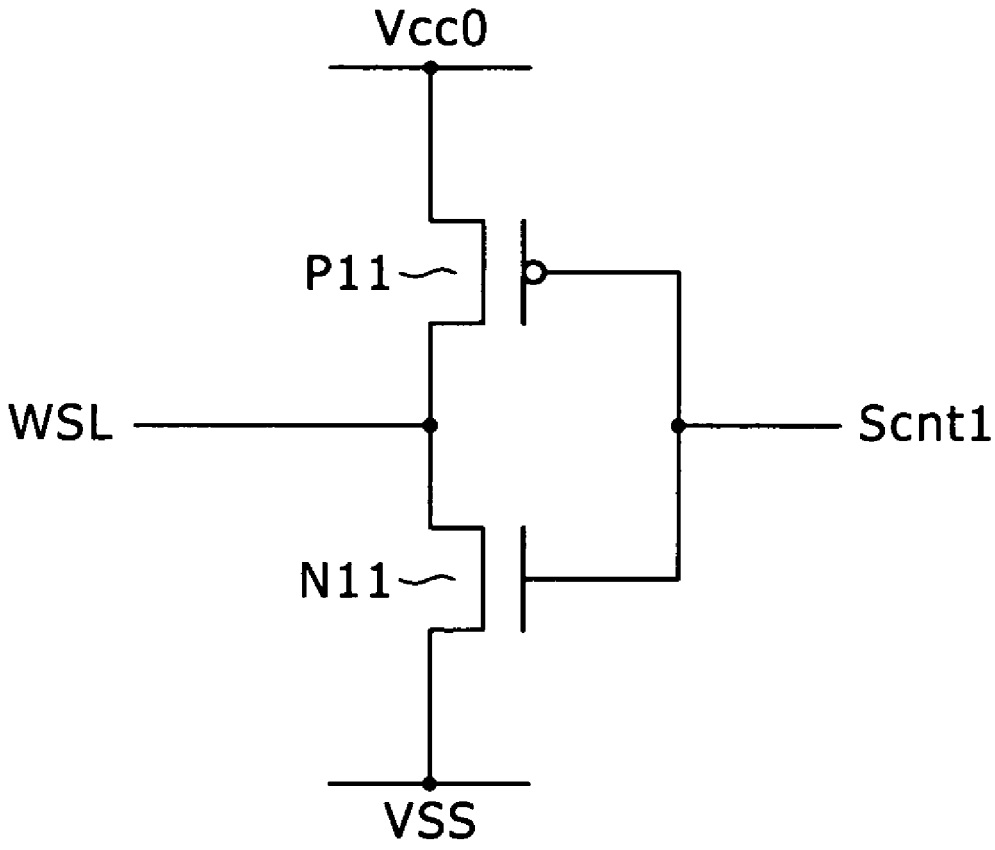
FIG. 12 is an explanatory diagram showing a typical partial configuration of a control-line driving section for driving the write control signal line.

FIG. 12 is an explanatory circuit diagram showing a typical partial configuration of the first control-line driving section 35. That is to say, the circuit diagram of FIG. 12 shows a configuration for one horizontal line. Thus, a plurality of configurations each shown in the circuit diagram of FIG. 12 are laid out in the vertical direction of the screen. The number of configurations laid out in the vertical direction represents the vertical-direction resolution of the image displayed on the screen.

In the case of the partial configuration shown in the circuit diagram of FIG. 12, the first control-line driving section 35 employs a thin-film transistor P11 of the P-channel type. A specific one of the two main electrodes employed in the thin-film transistor P11 of the P-channel type is connected to a power-supply line Vcc0 whereas the other main electrode thereof is connected to the write control signal line WSL. This write control signal line WSL is also connected to a specific one of the two main electrodes employed in a thin-film transistor N11 of the N-channel type. It is to be noted that the other main electrode of the thin-film transistor N11 of the N-channel type is connected to the ground electric potential VSS.

By the way, a common control signal line Scnt1 is connected to the gate electrode of the thin-film transistor P11 of the P-channel type and the gate electrode of the thin-film transistor N11 of the N-channel type. Since the characteristic of the thin-film transistor P11 of the P-channel type is different from the characteristic of the thin-film transistor N11 of the N-channel type, when a specific one of the two transistors is turned on, the other transistor is turned off. That is to say, the thin-film transistor P11 of the P-channel type and the thin-film transistor N11 of the N-channel type operate in a manner of being complementary to each other.

In the case of this embodiment, the electric potential appearing on the common control line Scnt1 is controlled by a pulse supplied by an output stage employed by a shift register provided at a preceding stage as an output stage As described above, the first control-line driving section 35 operates to generate two H-level periods during a horizontal scan period of the no-light emission period. The first H-level period is allocated to a threshold-voltage compensation process whereas the second H-level period is allocated to a mobility compensation process.

Thus, in the second H-level period, the time that it takes to electrically charge the signal holding capacitor Cs with a new voltage equal to half the signal electric potential Vsig asserted on the data signal line DTL during the period is time demanded for the mobility compensation process.

In the case of this embodiment, however, the signal electric potential Vsig has been set at a level a little bit higher than that demand by assuming a voltage drop due to a coupling effect. Thus, the second H-level period provided by the first control-line driving section 35 is set as time that it takes to electrically charge a voltage of (Signal electric potential Vsig—Coupling voltage)/2 to the signal holding capacitor Cs.

Figure 13:
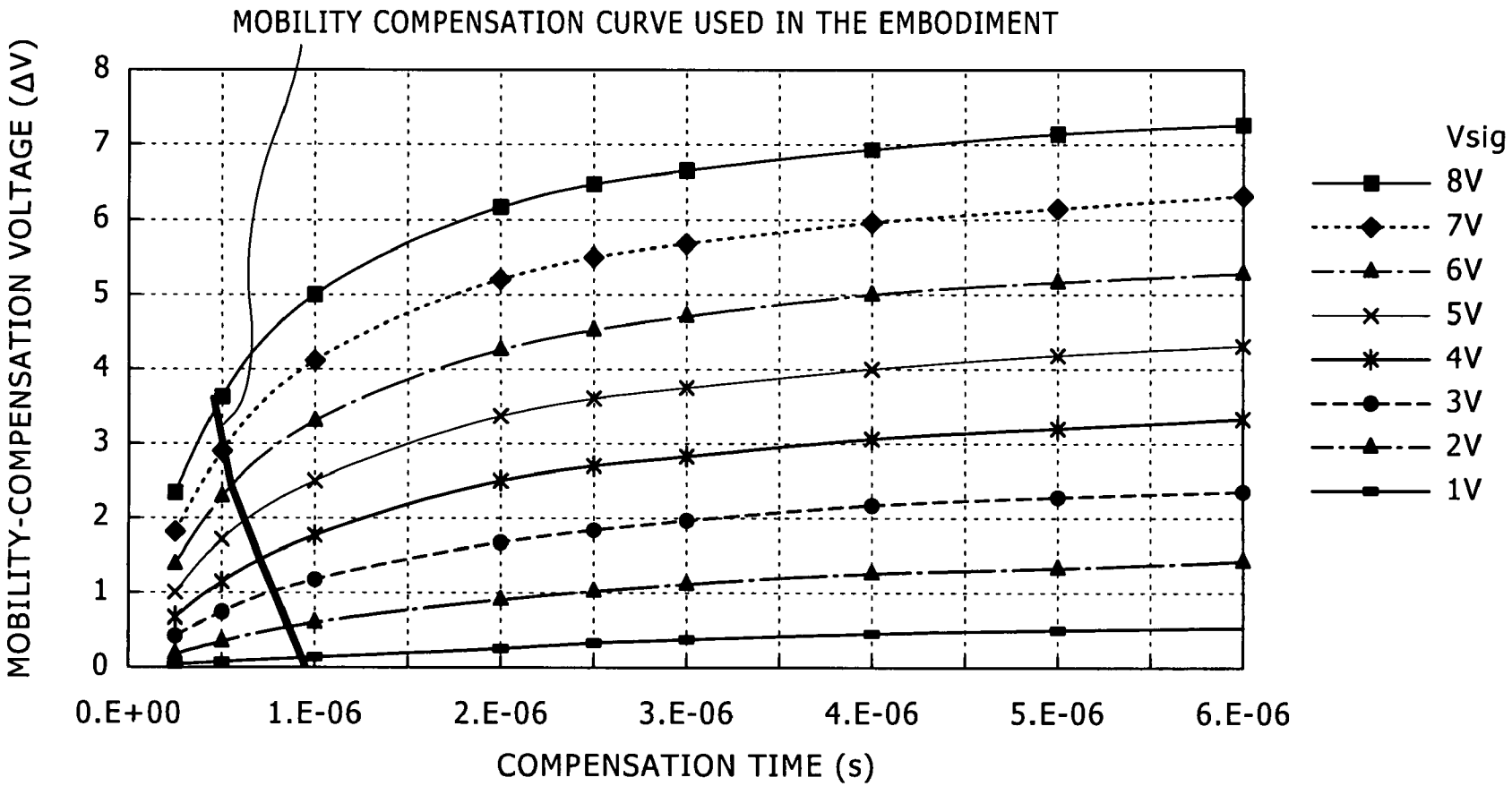
FIG. 13 is a diagram showing the shape of a mobility compensation curve which is used in the first embodiment.

FIG. 13 is a diagram showing the shape of a mobility compensation curve which is represented by a bold line as a mobility compensation curve used in this embodiment. It is to be noted that, in the case of this embodiment, it is assumed that the maximum amplitude of the signal electric potential Vsig asserted on the data signal line DTL is 8 V whereas the coupling voltage is 1 V. The coupling voltage is defined as a voltage drop due to a coupling operation.

Thus, in the case of the mobility compensation curve shown in the diagram of FIG. 13, even if the signal electric potential Vsig asserted on the data signal line DTL is 8 V, the time that it takes to make a transition of 3.5 V as a generated mobility compensation quantity is the optimum value of the mobility compensation time.

By the same token, even if the signal electric potential Vsig asserted on the data signal line DTL is 7 V, the time that it takes to make a transition of 3 V as a generated mobility compensation quantity is the optimum value of the mobility compensation time.

In the same way, even if the signal electric potential Vsig asserted on the data signal line DTL is 6 V, the time that it takes to make a transition of 2.5 V as a generated mobility compensation quantity is the optimum value of the mobility compensation time.

Similarly, even if the signal electric potential Vsig asserted on the data signal line DTL is 5 V, the time that it takes to make a transition of 2 V as a generated mobility compensation quantity is the optimum value of the mobility compensation time.

Likewise, even if the signal electric potential Vsig asserted on the data signal line DTL is 4 V, the time that it takes to make a transition of 1.5 V as a generated mobility compensation quantity is the optimum value of the mobility compensation time.

In the same way, even if the signal electric potential Vsig asserted on the data signal line DTL is 3 V, the time that it takes to make a transition of 1 V as a generated mobility compensation quantity is the optimum value of the mobility compensation time.

By the same token, even if the signal electric potential Vsig asserted on the data signal line DTL is 2 V, the time that it takes to make a transition of 0.5 V as a generated mobility compensation quantity is the optimum value of the mobility compensation time.

The mobility compensation curve shown as a bold line is the waveform of a driving signal which is to be asserted by the first control-line driving section 35 on the write control signal line WSL at the end of the mobility compensation process.

By comparing the mobility compensation curve shown in the diagram of FIG. 13 with the mobility compensation curve explained earlier by referring to the diagram of FIG. 5, it is obvious that the mobility compensation time for each signal electric potential Vsig is short in the case of the mobility compensation curve shown in the diagram of FIG. 13 in comparison with the mobility compensation curve shown in the diagram of FIG. 5.

Figure 5:
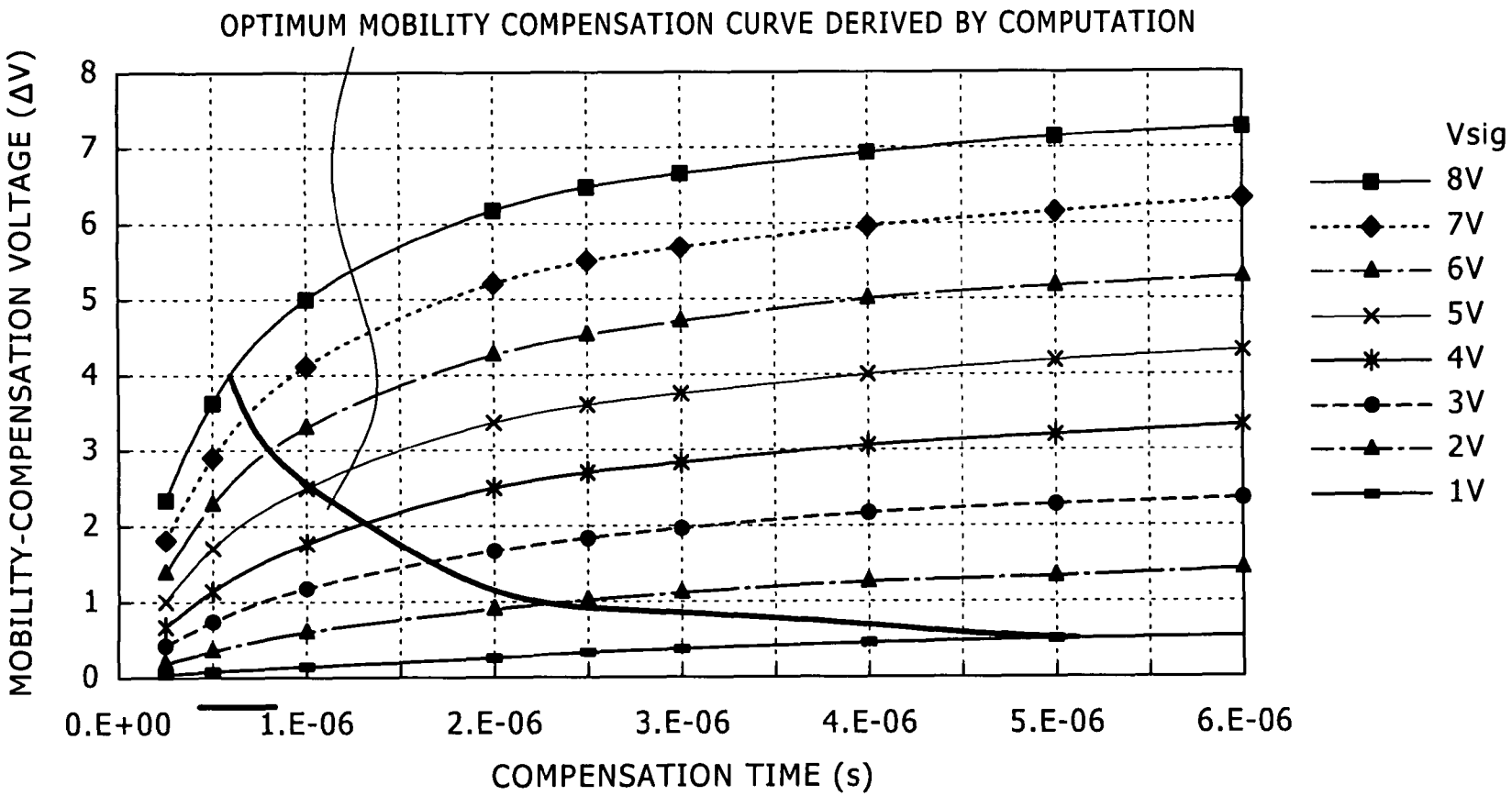
FIG. 5 is an explanatory diagram showing an optimum mobility compensation curve derived by a computation.
Figures 6A, 6B, 6C, 6D:
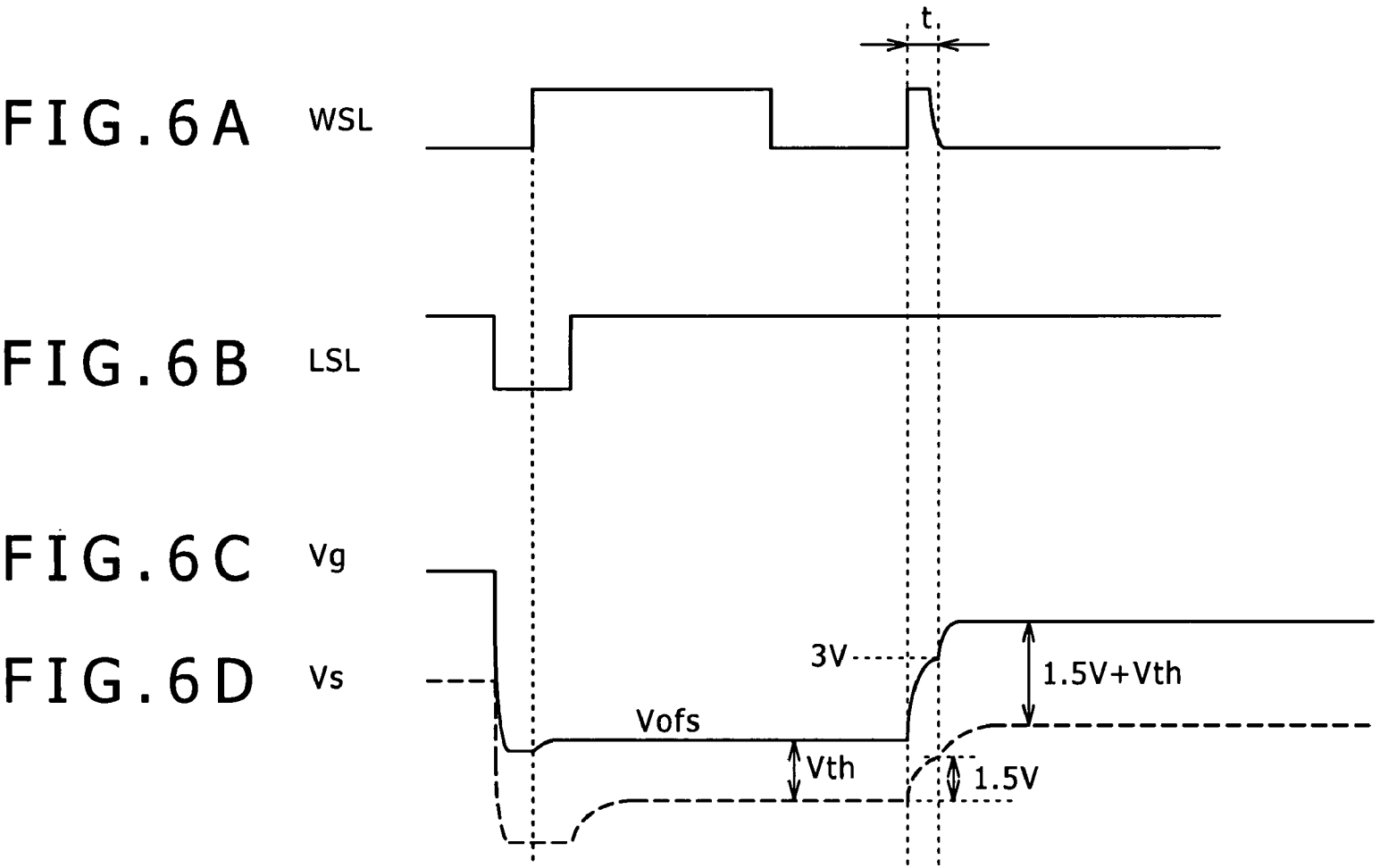
FIGS. 6A to 6D are timing charts showing changes of the gate-to-source electric potential of the device driving transistor N2.

In the case of a signal electric potential Vsig of 2 V representing the luminance of emitted light for example, the mobility compensation time is about 3.00 microseconds in the case of the mobility compensation curve shown in the diagram of FIG. 5, but the mobility compensation time is about 0.9 microseconds in the case of the mobility compensation curve shown in the diagram of FIG. 13.

In the case of the mobility compensation curve shown in the diagram of FIG. 5, for a given signal electric potential Vsig of 2 V, the time demanded by the mobility compensation voltage to attain 1 V is taken as the optimum mobility compensation time. In the case of the mobility compensation curve shown in the diagram of FIG. 13, on the other hand, for a given signal electric potential Vsig of 3 V, the time demanded by the mobility compensation voltage to attain 1 V is taken as the optimum mobility compensation time provided that the coupling driving operation is taken into consideration.

As described above, there is an effective function to shorten the mobility compensation time by about two microseconds. In other words, in the case of a 100-percent display, a shortening effect of 70% can really be recognized.

In addition, in the case of this embodiment, mobility compensation time variations caused by variations of the signal electric potential Vsig are very small. As a matter of fact, the mobility compensation time can be regarded to be all but independent of the variations of the signal electric potential Vsig. In actuality, the maximum variation of the mobility compensation time is about 300 ns. If the maximum mobility compensation time variation has such a small magnitude, a similar mobility compensation curve can be realized as a transient waveform of a driving pulse. For this reason, in the case of this embodiment, the falling waveform of the second driving pulse is also designed as a rectangular wave.

(d): Configuration of the Second Control-Line Driving Section

The second control-line driving section 37 is a driving circuit for controlling the switching from an operation to supply a driving power to sub-pixels 11 through lighting control signal lines LSL to an operation to supply no driving power to sub-pixels 11 and vice versa.

Figure 14:
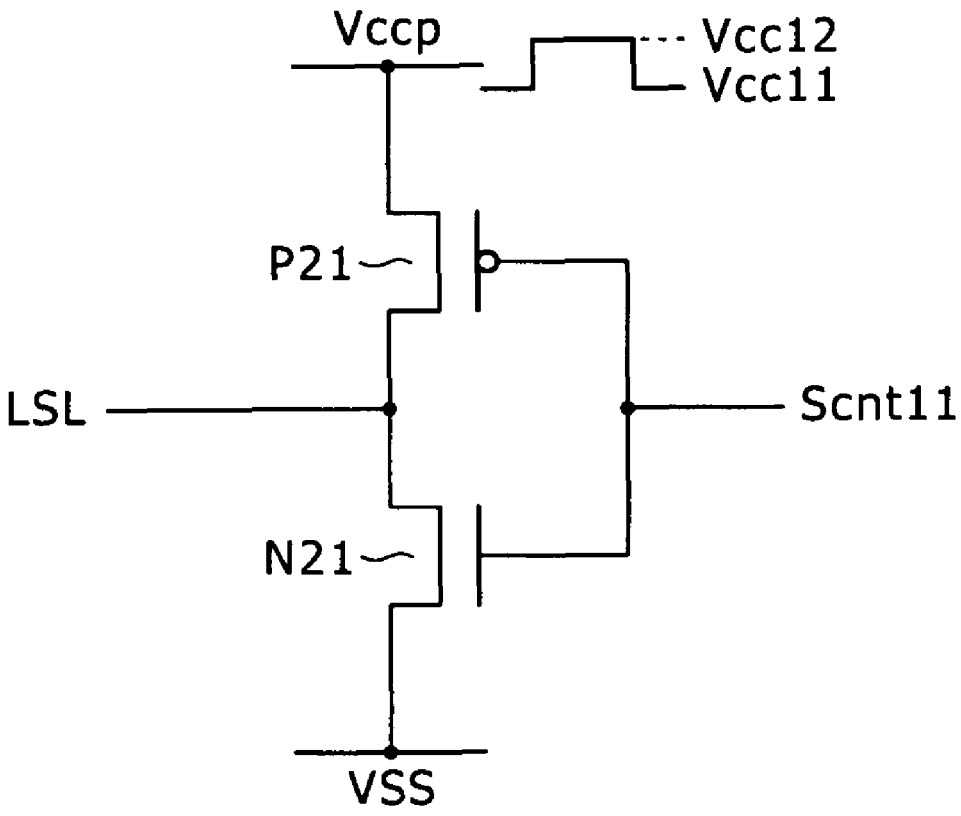
FIG. 14 is an explanatory diagram showing a typical partial configuration of a control-line driving section for driving the lighting control signal line.

FIG. 14 is an explanatory diagram showing a typical partial configuration of the second control-line driving section 37. That is to say, the diagram of FIG. 14 shows the configuration for one horizontal line or one lighting control signal line LSL. Thus, a plurality of configurations each shown in the diagram of FIG. 14 are laid out in the vertical direction of the screen. The number of configurations laid out in the vertical direction represents the vertical-direction resolution of the image displayed on the screen.

In the case of the configuration shown in the diagram of FIG. 14 as the configuration of the control-line driving section 37, a specific one of the two main electrodes of a P-channel thin-film transistor P21 designed as a transistor of the P-channel type is connected to a scan power-supply line Vccp whereas the other main electrode of the P-channel thin-film transistor P11 is connected to the lighting control signal line LSL. The lighting control signal line LSL is also connected to a specific one of the two main electrodes of a N-channel thin-film transistor N21 designed as a transistor of the N-channel type. It is to be noted that the other main electrode of the N-channel thin-film transistor N21 of the N-channel type is connected to a ground line conveying the ground electric potential VSS.

By the way, the gate electrode of the thin-film transistor P21 designed as a transistor of the P-channel type and the gate electrode of the thin-film transistor N21 designed as a transistor of the N-channel type are connected to a common control signal line Scnt11. Since the characteristic of the thin-film transistor P11 of the P-channel type is different from the characteristic of the thin-film transistor N11 of the N-channel type, when a specific one of them is put in a turned-off state, the other one of them is put in a turned-on state. That is to say, the thin-film transistor P11 of the P-channel type and the thin-film transistor N11 of the N-channel type operate complementarily to each other.

In the case of the first embodiment, the electric potential appearing on the control signal line Scnt11 is controlled by an output pulse generated by a corresponding output stage of a shift register, which is provided at the preceding stage, as a pulse having two binary values.

Figures 15A, 15B, 15C:
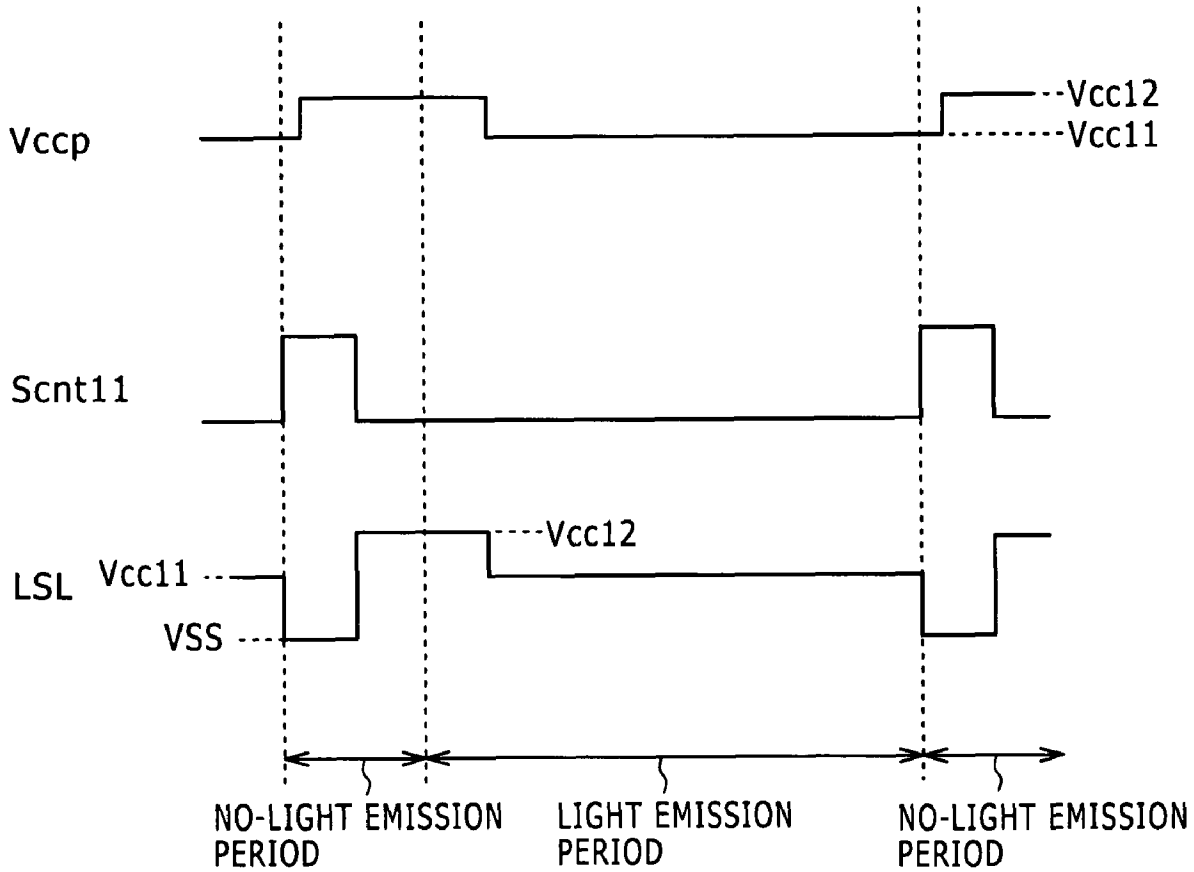
FIGS. 15A to 15C are timing charts showing waveforms representing changes of driving signals in the control-line driving section shown in the circuit diagram of FIG. 14.

FIGS. 15A to 15C are timing diagrams showing relations between the waveforms of signals of the second control-line driving section 37 and operation periods of the pixel circuit. To be more specific, FIG. 15A is a timing chart showing a waveform representing changes of a driving signal which is appearing on the pulse power-supply line Vccp whereas FIG. 15B is a timing chart showing a waveform representing changes of a driving signal which is appearing on the control signal line Scnt11. FIG. 15C is a timing chart showing a waveform representing changes of an electric potential which is appearing on the lighting control signal line LSL.

As shown in the timing diagrams of FIGS. 15A to 15C, in the initialization period, the driving signal appearing on the control signal line Scnt11 is sustained at the H level. In this initialization period, the thin-film transistor N21 of the N-channel type is driven to enter a turned-on state, controlling the electric potential appearing on the lighting control signal line LSL to the L level. In the range of claims appended to this specification, the L level is referred to as a first driving voltage.

In addition, the common control signal line Scnt11 is changed to an L level in order to end the initialization period. The period of the L level continues to the start of the initialization period of the next frame. During the period of the L level, the thin-film transistor P21 of the P-channel type is operating in a turned-on state, asserting the electric potential of the pulse power-supply line Vccp on the lighting control signal line LSL.

It is to be noted that, as shown in the timing chart of FIG. 15A, first of all, the electric potential appearing on the pulse power-supply line Vccp is controlled to a high-level ON electric potential Vcc12 which is referred to as a second driving voltage in the range of claims appended to this specification. Then, with an early timing lagging behind the start of the light emission period, the electric potential appearing on the pulse power-supply line Vccp is changed from the high-level ON electric potential Vcc12 to a low-level ON electric potential Vcc11 which is referred to as a third driving voltage in the range of claims appended to this specification.

Thus, the changes of the electric potential appearing on the pulse power-supply line Vccp are passed on to the electric potential appearing on the lighting control signal line LSL as they are. By the way, both the high-level ON electric potential Vcc12 and the low-level ON electric potential Vcc11 are set at predetermined levels which are each capable of putting the device driving transistor N2 in a turned-on state.

In addition, in the case of this embodiment, the difference between the high-level ON electric potential Vcc12 and the low-level ON electric potential Vcc11 is set at 1 V.

(B-2): Driving Operations

The following description explains typical driving operations carried out by the organic EL panel module 31 according to the first embodiment.

FIGS. 16A to 16E are explanatory timing charts showing changes of electric potentials inside a sub-pixel 11. To be more specific, FIG. 16A is a timing chart showing a waveform representing changes of a driving signal appearing on the write control signal line WSL whereas FIG. 16B is a timing chart showing a waveform representing changes of a driving signal appearing on the data signal line DTL. FIG. 16C is a timing chart showing a waveform representing changes of a driving signal appearing on the lighting control signal line LSL whereas FIG. 16D is a timing chart showing a waveform representing changes of a gate electric potential Vg appearing at the gate electrode of the device driving transistor N2. FIG. 16E is a timing chart showing a waveform representing changes of a source electric potential Vs appearing at the source electrode of the device driving transistor N2.

(a): Initialization Process

When the electric potential appearing on the lighting control signal line LSL is controlled to change to the L level of the ground electric potential Vss, a light emission period is ended and a no-light emission period is started. When the no-light emission period is started, an initialization process of the sub-pixel 11 is carried out in order to make a preparation for a new process to store a signal electric potential Vsig into the signal holding capacitor Cs. Strictly speaking, the initialization process of the sub-pixel 81 is carried out in order to lower the gate electric potential Vg of the device driving transistor N2 and the source electric potential Vs of the device driving transistor N2 as shown in the timing charts of FIGS. 16D and 16E respectively.

Figure 17:
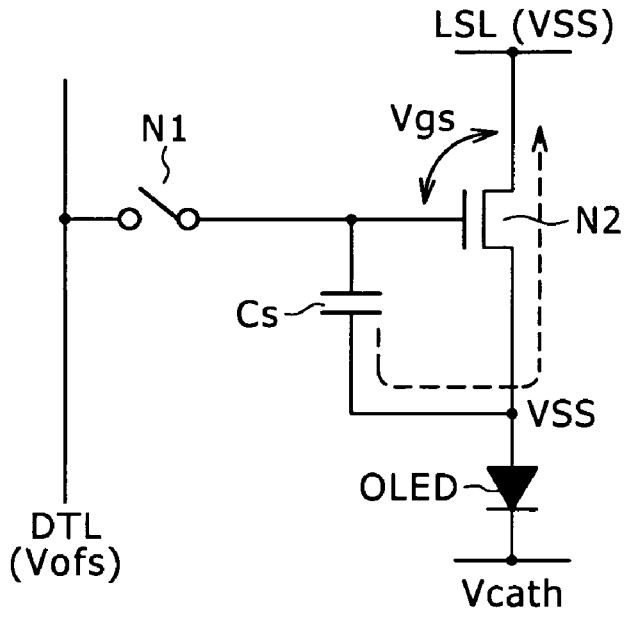
FIG. 17 is an explanatory diagram showing an equivalent circuit of the sub-pixel to serve as a circuit representing the state of the sub-pixel at the start of an initialization process.

FIG. 17 is an explanatory diagram showing an equivalent circuit of the sub-pixel 11 to serve as a circuit representing the state of the sub-pixel 11 at the start of the no-light emission period or the start of the initialization process. As shown in the circuit diagram of FIG. 17, the signal sampling transistor N1 has been put in a turned-off state.

When the driving signal appearing on the lighting control signal line LSL is set at the L level of the ground electric potential Vss as described above, a voltage Vgs appearing between the gate electrode of the device driving transistor N2 and the lighting control signal line LSL as shown in the circuit diagram of FIG. 17 becomes greater than the threshold voltage Vth of the device driving transistor N2. Thus, the device driving transistor N2 is put in a turned-on state, drawing electric charge accumulated in the signal holding capacitor Cs as shown by a dashed-line arrow shown in the circuit diagram of FIG. 17. The electric charge accumulated in the signal holding capacitor Cs is drawn, causing the source electric potential Vs of the device driving transistor N2 to decrease to a level equal to the ground electric potential VSS. In addition, the gate electric potential Vg of the device driving transistor N2 is also lowered because of a coupling effect due to the decrease of the source electric potential Vs.

(b): Threshold-Voltage Compensation Preparation Process and Threshold-Voltage Compensation Process When the initialization process described above is ended, the signal sampling transistor N1 is put in a turned-on state by raising the driving signal appearing on the write control signal line WSL to the H level in order to apply the offset electric potential Vofs used as a reference electric potential to the gate electrode of the device driving transistor N2.

Figure 18:
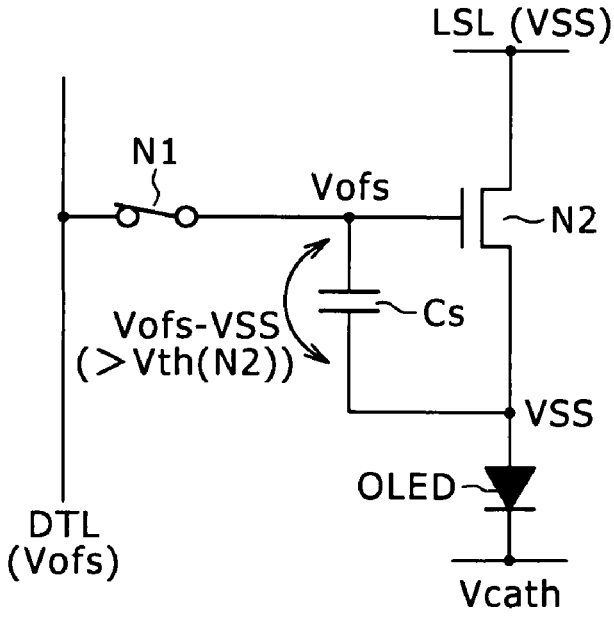
FIG. 18 is an explanatory diagram showing an equivalent circuit of the sub-pixel during a threshold-voltage compensation preparation process.

FIG. 18 is an explanatory diagram showing an equivalent circuit of the sub-pixel 11 to serve as a circuit representing this state. During the threshold-voltage compensation preparation process, the signal holding capacitor Cs is controlled to enter a state in which a voltage having a magnitude of (Vofs−VSS). The ground electric potential Vss and the offset electric potential Vofs are set at such values that the voltage having a magnitude of (Vofs−VSS) is greater than the threshold voltage Vth of the device driving transistor N2. As the voltage appearing between the electrodes of the signal holding capacitor Cs exceeds the threshold voltage Vth of the device driving transistor N2, the threshold-voltage compensation preparation process can be said to have been ended.

In this state of electric potentials, the electric potential appearing on the lighting control signal line LSL is changed to the high-level ON electric potential Vcc12 which is the highest electric potential among the three electric potentials applicable to the lighting control signal line LSL. As described above, the high-level ON electric potential Vcc12 is referred to as a second driving voltage in the range of claims appended to this specification.

Figure 19:
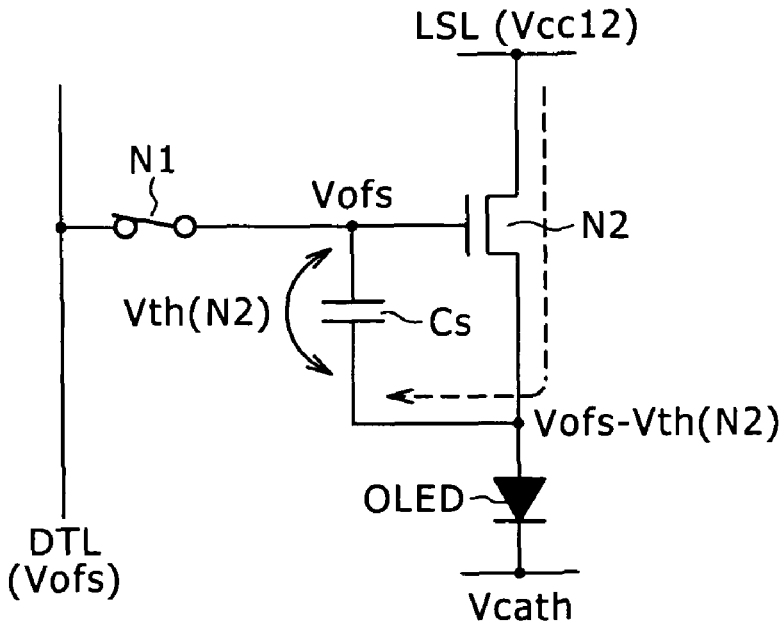
FIG. 19 is an explanatory diagram showing an equivalent circuit of the sub-pixel to serve as a circuit representing the state of the sub-pixel during a threshold-voltage preparation process.

FIG. 19 is an explanatory diagram showing an equivalent circuit of the sub-pixel 11. At the start of the threshold-voltage preparation process, the voltage appearing between the electrodes of the signal holding capacitor Cs exceeds the threshold voltage Vth of the device driving transistor N2, that is, the gate-source voltage Vgs of the device driving transistor N2 is greater than the threshold voltage Vth of the device driving transistor N2. Thus, the device driving transistor N2 is put in a turned-on state, causing a driving current Ids to flow in a direction from the lighting control signal line LSL to the signal holding capacitor Cs. The driving current Ids flowing in a direction from the lighting control signal line LSL to the signal holding capacitor Cs neutralizes electric charge accumulated in the signal holding capacitor Cs, causing the source electric potential Vs of the device driving transistor N2 to start rising.

As the electric charge accumulated in the signal holding capacitor Cs is neutralized, the voltage appearing between the electrodes of the signal holding capacitor Cs becomes equal to the threshold voltage Vth (N2) of the device driving transistor N2. At the point of time the voltage appearing between the electrodes of the signal holding capacitor Cs becomes equal to the threshold voltage Vth of the device driving transistor N2 (N2), the driving current Ids stops to flow. This is because the device driving transistor N2 automatically enters a cut-off state. The process to set the gate-source voltage Vgs of the device driving transistor N2 at the threshold voltage Vth of the device driving transistor N2 is referred to as the threshold-voltage compensation process.

Figure 20:
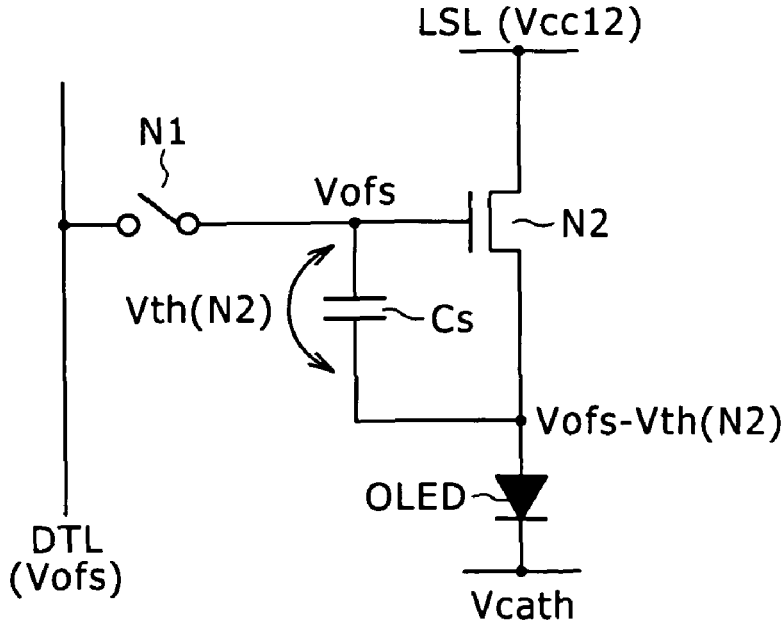
FIG. 20 is an explanatory diagram showing an equivalent circuit of the sub-pixel to serve as a circuit representing the state of the sub-pixel at the end of the threshold-voltage compensation process.

When the threshold-voltage compensation process is assumed to have ended, the signal sampling transistor N1 is controlled to enter a turned-off state as shown in FIG. 20. Thus, the gate electrode of the device driving transistor N2 is put in a floating state.

(c): Signal Electric-Potential Write Process and Mobility Compensation Process

At a point of time after the threshold-voltage compensation process has been ended, the electric potential appearing on the data signal line DTL is changed from the offset electric potential Vofs to the signal electric potential Vsig. Then, the write control signal line WSL is controlled to rise from the L level to the H level in order to put the signal sampling transistor N1 in a turned-on state.

Figure 21:
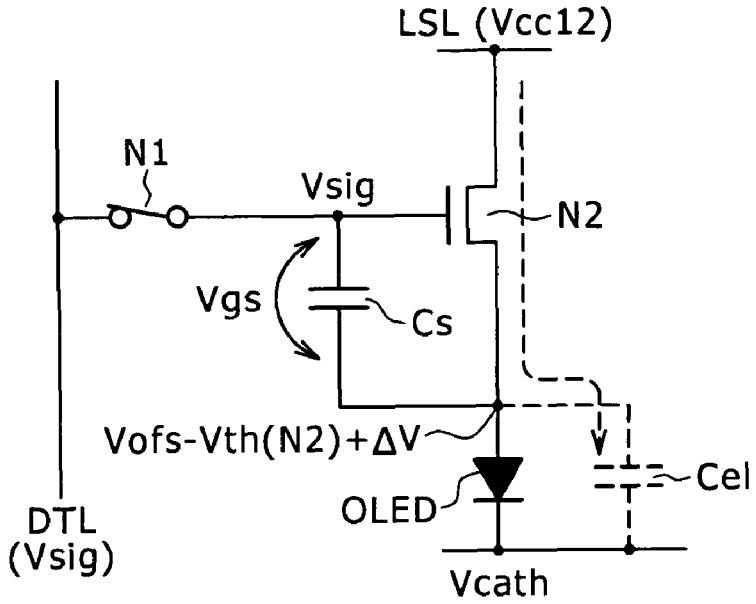
FIG. 21 is an explanatory diagram showing an equivalent circuit of the sub-pixel to serve as a circuit representing the state of the sub-pixel at the start of a signal electric-potential write process and a mobility compensation process.

FIG. 21 is an explanatory diagram showing an equivalent circuit of the sub-pixel 11 to serve as a circuit representing the state of the sub-pixel 11 at the start of the signal electric-potential write process and the mobility compensation process. Since the signal sampling transistor N1 is in a turned-on state, the signal electric potential Vsig appearing on the data signal line DTL is stored in the signal holding capacitor Cs so that the voltage of the signal holding capacitor Cs again exceeds the threshold voltage Vth (N2). As a result, the device driving transistor N2 is controlled to enter a turned-on state. The process to store the signal electric potential Vsig appearing on the data signal line DTL in the signal holding capacitor Cs is referred to as the signal electric-potential write process.

Thus, an operation to supply a driving current Ids to the organic EL device OLED is started. It is to be noted, however, that the driving current Ids electrically charges the parasitic capacitor Ce1 of the organic EL device OLED and other capacitors instead of flowing through the organic EL device OLED. Thus, the electric potential appearing on the anode electrode of the organic EL device OLED rises by a mobility compensation voltage ΔV. The electric potential appearing on the anode electrode of the organic EL device OLED is no other than the source electric potential Vs appearing at the source electrode S of the device driving transistor N2. It is to be noted that the mobility compensation time T during which a driving pulse is generated is common to all levels of the signal electric potential Vsig. In addition, the waveform of the actual driving pulse shows a transient portion like one shown in the diagram of FIG. 13 due effects of a wire capacitor and other capacitors.

For this reason, the mobility compensation time of a low luminance gradation is longer than the mobility compensation time of a high luminance gradation. In either case, the mobility compensation time T to be used is set at a value shorter than the mobility compensation time t found by computation according to Eq. (2) for a signal electric potential Vsig actually stored in the signal holding capacitor Cs.

In addition, the mobility compensation voltage ΔV has a value smaller than half the signal electric potential Vsig actually asserted on the data signal line DTL.

Needless to say, the potential to which the mobility compensation voltage ΔnV is added (Vofs−Vth (N2)+ΔV) is deliberately set at such a value that the electric potential does not exceed the threshold voltage Vth(oeld) of the organic EL device OLED.

Thus, the organic EL device OLED is not operating during the mobility compensation process. That is to say, the organic EL device OLED stays in a no-light emission state during the mobility compensation process.

(d): Light Emission Process (Including a Coupling Operation)

Figure 22:
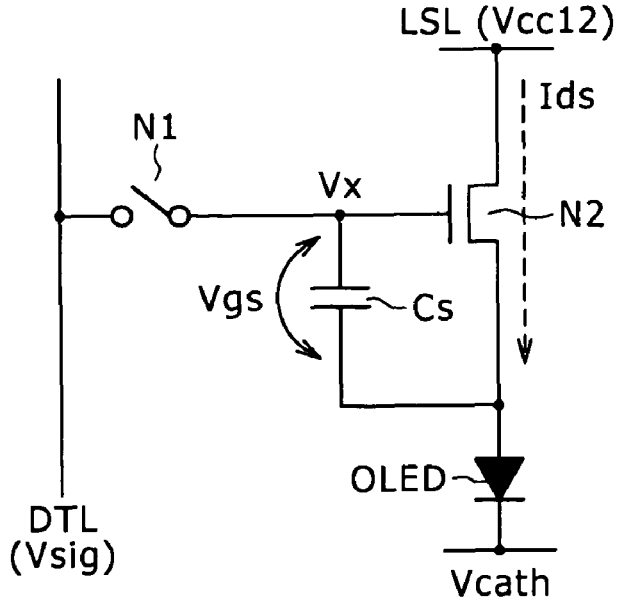
FIG. 22 is a circuit diagram showing an equivalent circuit of the sub-pixel that prevails during an initial portion of a light emission period.

The mobility compensation process is ended when the signal sampling transistor N1 is controlled to enter a turned-off state. FIG. 22 is a circuit diagram showing an equivalent circuit of the sub-pixel 11 as an equivalent circuit that prevails at a point of time after the signal sampling transistor N1 has been put in a turned-off state.

The signal sampling transistor N1 is put in a turned-off state by changing a driving pulse asserted on the write control signal line WSL connected to the signal sampling transistor N1 from the H-level electric potential appearing on the power-supply line Vcc0 to the ground electric potential VSS of the L level.

The change of the driving pulse asserted on the write control signal line WSL connected to the signal sampling transistor N1 from the H-level electric potential appearing on the power-supply line Vcc) to the ground electric potential VSS of the L level controls the signal sampling transistor N1 to enter a turned-off state. The signal sampling transistor N1 enters a turned-off state, electrically disconnecting the gate electrode of the device driving transistor N2 from the data signal line DTL. That is to say, the gate electrode of the device driving transistor N2 is put in a floating state.

In the mean time, the device driving transistor N2 keeps supplying the driving current Ids to the organic EL device OLED. Thus, the driving current Ids keeps electrically charging the parasitic capacitor Ce1 of the organic EL device OLED. As a result, the electric potential appearing on the anode electrode of the organic EL device OLED rises.

When the electric potential appearing on the anode electrode of the organic EL device OLED rises, the source electric potential Vs appearing at the source electrode S of the device driving transistor N2 also increases as well. In addition, when the source electric potential Vs appearing at the source electrode S of the device driving transistor N2 increases, the gate electric potential Vg appearing at the gate electrode G of the device driving transistor N2 also rises as well due to a bootstrap operation.

Then, the source electric potential Vs appearing at the source electrode S of the device driving transistor N2 attains the threshold voltage Vth(oled) of the organic EL device OLED. At the point of time the source electric potential Vs appearing at the source electrode S of the device driving transistor N2 attains the threshold voltage Vth(oled) of the organic EL device OLED, the organic EL device OLED is put in a turned-on state. With the organic EL device OLED put in a turned-on state, the driving current Ids generated by the device driving transistor N2 flows through the organic EL device OLED, causing the organic EL device OLED to emit light with a luminance level determined by the magnitude of the driving current Ids.

It is to be noted that the luminance level of light emitted by the organic EL device OLED during this light emission period is a luminance level determined by the magnitude of the signal electric potential Vsig actually asserted on the data signal line DTL. That is to say, the luminance level of light emitted by the organic EL device OLED during this light emission period is different from the supposed luminance level. Thus, the shorter the light emission process carried out in the initial period, the better the result. Then, the electric potential appearing on the lighting control signal line LSL is changed to the low-level ON electric potential Vcc11 which is referred to as a third driving voltage in the range of claims appended to this specification in order to end the initial portion of the light emission period.

Figure 23:
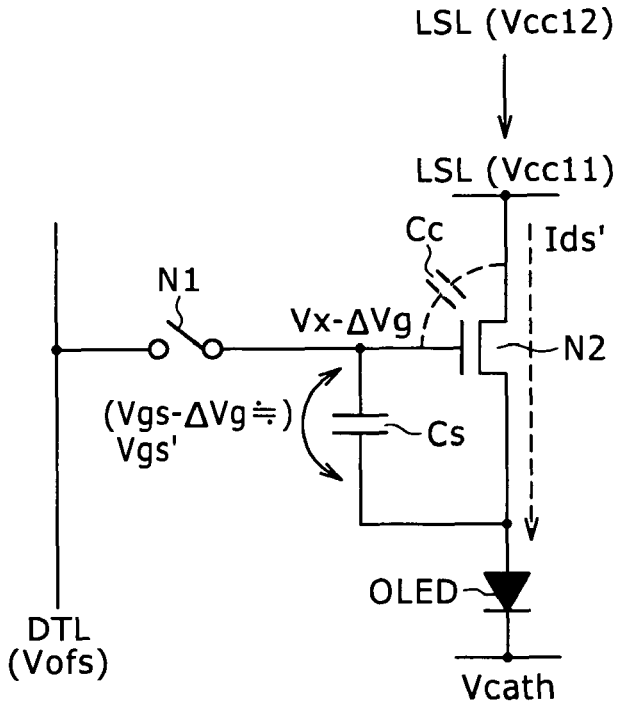
FIG. 23 is a circuit diagram showing an equivalent circuit of the sub-pixel for a case in which a minus-direction coupling operation is carried out.

FIG. 23 is a circuit diagram showing an equivalent circuit of the sub-pixel 11 as an equivalent circuit that prevails at the end of the initial portion of the light emission period.

At this point of time, the electric potential appearing on the lighting control signal line LSL is changed from the high-level ON electric potential Vcc12 to the low-level ON electric potential Vcc11. This change of the electric potential appearing at the drain electrode of the device driving transistor N2 is passed on to the gate electrode G of the device driving transistor N2 through a parasitic capacitor Cc existing between the gate and drain electrodes of the device driving transistor N2 because the gate electrode G of the device driving transistor N2 has been put in a floating state.

That is to say, the gate electric potential Vg appearing at the gate electrode G of the device driving transistor N2 drops from the signal electric potential Vx to an electric potential of (Vx−ΔVg). On the other hand, the source electric potential Vs appearing at the source electrode S of the device driving transistor N2 is fixed at an electric potential to which the driving current Ids generated by the device driving transistor N2 has electrically charged the parasitic capacitor of the organic EL device OLED and the like.

Thus, as a result of the coupling operation, the gate-source voltage Vgs' appearing between the gate (G) and source (S) electrodes of the device driving transistor N2 changes from Vgs to (Vgs−ΔVg).

Figure 24:
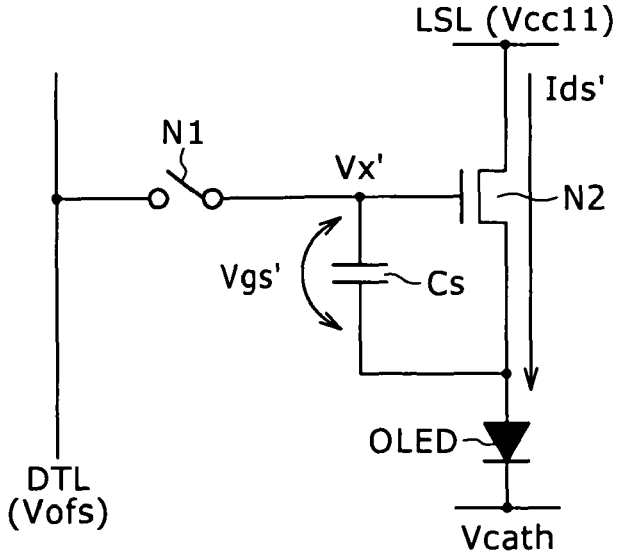
FIG. 24 is a circuit diagram showing an equivalent circuit of the sub-pixel that prevails after the initial portion of the light emission period.

FIG. 24 is a circuit diagram showing an equivalent circuit of the sub-pixel 11 as an equivalent circuit that prevails after the gate-source voltage Vgs' appearing between the gate (G) and source (S) electrodes of the device driving transistor N2 changes from Vgs to (Vgs−ΔVg) due to the coupling operation.

As shown in the circuit diagram of FIG. 24, in the light emission period, after the gate-source voltage Vgs' appearing between the gate (G) and source (S) electrodes of the device driving transistor N2 has changed from Vgs to (Vgs−ΔVg) due to the coupling operation, a driving current Ids' is flowing to the organic EL device OLED so that the light transmission state of emitting light with a luminance level obtained after the mobility compensation process is continued. The driving current Ids' flowing to the organic EL device OLED has a magnitude determined by the gate-source voltage Vgs' which appears between the gate (G) and source (S) electrodes of the device driving transistor N2 after the coupling operation Finally, by referring to a timing diagrams of FIGS. 25A to 25D, the following description explains the fact that an electric-potential relation obtained after the execution of the mobility compensation process based on the coupling operation is the same as an electric-potential relation which prevails after a proper mobility compensation process has been carried out.

Figures 25A, 25B, 25C, 25D:
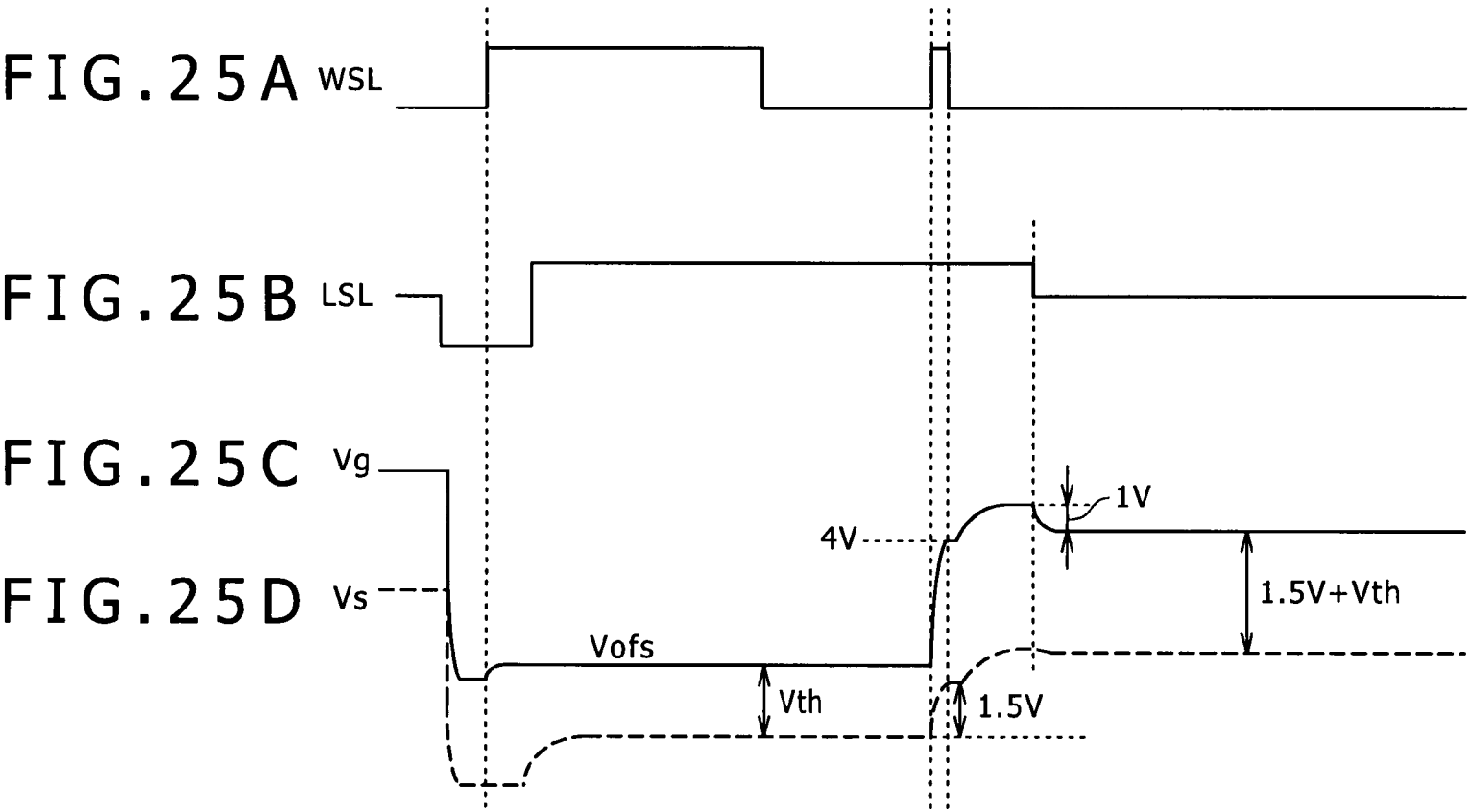
FIGS. 25A to 25D are timing charts showing changes of the gate-to-source electric potential of the device driving transistor during the driving operation of the embodiment.

FIG. 25A is a timing chart showing a waveform representing changes of the driving signal appearing on the write control signal line WSL whereas FIG. 25B is a timing chart showing a waveform representing changes of the driving signal appearing on the lighting control signal line LSL. FIG. 25C is a timing chart showing a waveform representing changes of the gate electric potential Vg appearing at the gate electrode G of the device driving transistor N2 whereas FIG.

25D is a timing chart showing a waveform representing changes of the source electric potential Vs appearing at the source electrode S of the device driving transistor N2.

It is to be noted that, in the timing diagram of FIGS. 25A to 25D, the signal electric potential Vsig actually asserted on the data signal line DTL is assumed to be 4 V or a signal electric potential Vsig to be essentially implemented is assumed to be 3 V.

The mobility compensation time T shown in the timing chart of FIG. 25A as the width of the later pulse is controlled, being set at a value shorter than the mobility compensation time t found by calculation based on Eq. (2) from the signal electric potential Vsig. For a signal electric potential Vsig of 4 V, the mobility compensation voltage found by calculation based on Eq. (2) is 2 V. In this case, however, the mobility compensation period is ended at a point of time the mobility compensation voltage attains 1.5 V. At this point of time, the gate-source voltage Vgs appearing between the gate (G) and source (S) electrodes of the device driving transistor N2 is (2.5 V+Vth).

In this state, the change of the electric potential appearing on the lighting control signal line LSL is passed on to the gate electrode G of the device driving transistor N2 by way of a parasitic capacitor of the device driving transistor N2. In the case of this embodiment, the change of the electric potential appearing on the lighting control signal line LSL is 1 V without regard to the magnitude of the signal electric potential Vsig.

That is to say, due to the effect of the coupling driving operation, the gate electric potential Vg appearing at the gate electrode G of the device driving transistor N2 drops by 1 V. On the other hand, the source electric potential Vs appearing at the source electrode S of the device driving transistor N2 almost does not drop.

As a result, the gate-source voltage Vgs appearing between the gate (G) and source (S) electrodes of the device driving transistor N2 is reduced from (2.5 V+Vth) to (1.5 V+Vth).

This state of electric potentials is completely identical with the electric-potential state shown in the timing diagrams of FIGS. 6A to 6D for a case in which a mobility compensation process is carried out with a 3 V signal electric potential Vsig asserted on the data signal line DTL from the beginning.

(B-3): Effects of the Embodiment

This embodiment adopts a driving method for reducing the gate-source voltage Vgs, which has been stored in the signal holding capacitor Cs at the end of the initial portion of the light emission period, to a level lower than the level obtained at a mobility compensation time by making use of a parasitic capacitive component existing between the device driving transistor N2 and the lighting control signal line LSL.

By adoption of this driving method, the amplitude of the signal electric potential Vsig asserted on the data signal line DTL can be made greater than the amplitude of the signal electric potential Vsig for a case in which the coupling operation is not taken into consideration. As a result, the mobility compensation time can be made shorter than the mobility compensation time for a case in which the coupling operation is not taken into consideration.

In addition, the mobility compensation voltage is by all means generated during the mobility compensation period by assuming an electric-potential relation to be implemented after the execution of the coupling operation. Thus, the time that it takes to obtain the necessary mobility compensation voltage becomes considerably shorter than the time that it takes to obtain the mobility compensation voltage found by calculation based on Eq. (2) for all levels of the signal electric potential Vsig. As a result, the mobility compensation time can be made shorter than the mobility compensation time for a case in which the coupling operation is not taken into consideration.

As another result, an organic EL panel can be implemented to serve as an organic EL panel that makes it easy to realize a high definition/resolution of the panel and use of a higher driving frequency in the panel.

On top of that, since the mobility compensation time can be made shorter, a driving pulse for providing a mobility compensation time can be reproduced as a transient portion of a rectangular pulse.

Thus, the circuit configuration of the first control-line driving section 35 for driving the write control signal line WSL can be made simple. In addition, the first control-line driving section 35 can be created by making use of the same process on the same panel as the sub-pixels in the pixel array section 3.

It is therefore possible to further reduce the cost of the organic EL panel and lower the power consumption of the organic EL panel.

In addition, since the falling transient portion of the driving pulse appearing on the write control signal line WSL has a steep shape, it is possible to reduce image-quality deteriorations caused by mobility compensation variations and caused by time-lapse shifts of the mobility compensation process. Also from this point of view, it is possible to implement a display panel that is capable of stabilizing the quality of the displayed image and the luminance level.

(C): Second Embodiment (C-1): System Configuration

Figure 26:
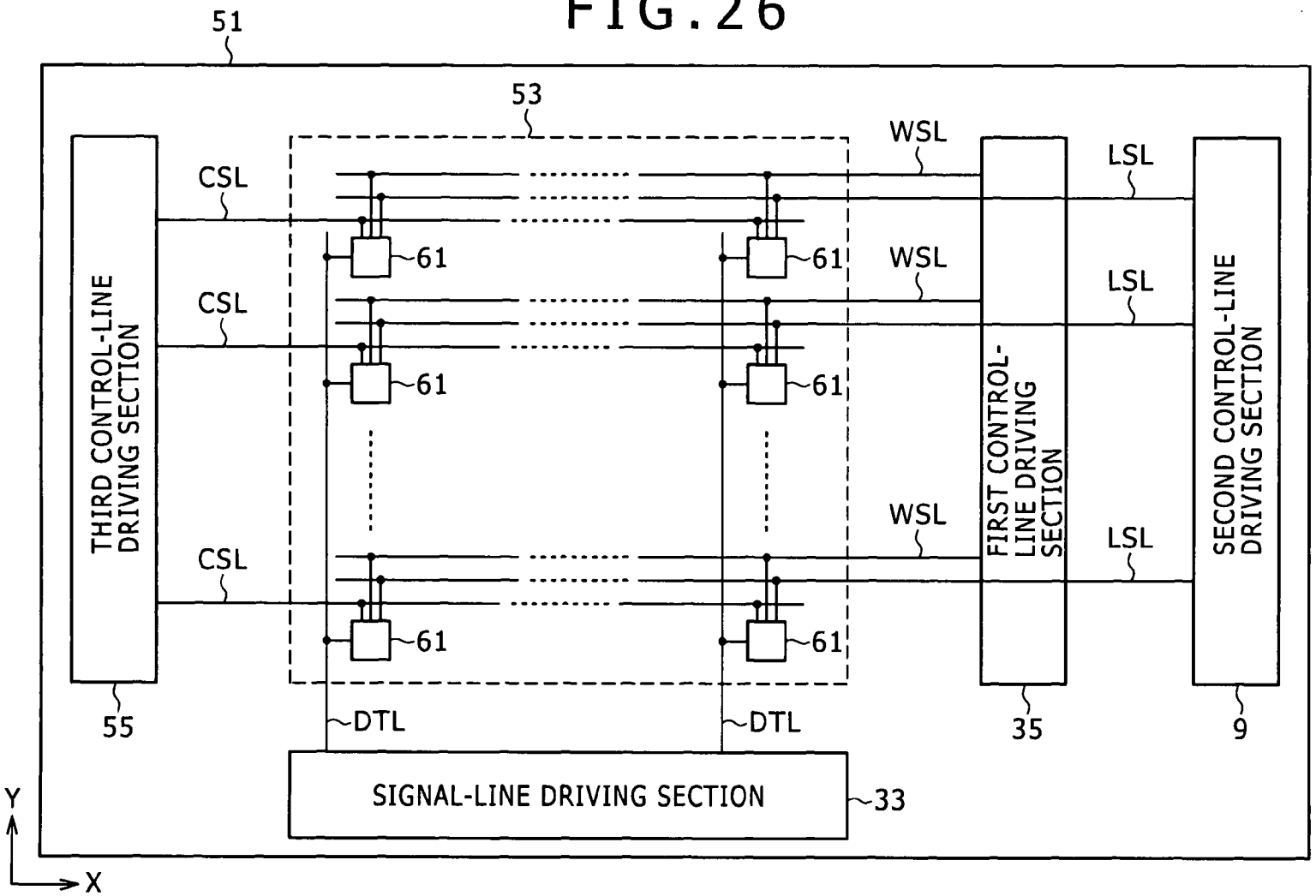
FIG. 26 is a block diagram showing a typical system configuration of an organic EL panel module according to a second embodiment.

FIG. 26 is a block diagram showing a typical system configuration of an organic EL panel module 51 according to a second embodiment. In the block diagram of FIG. 26, components identical with their respective counterparts shown in the block diagrams of FIGS. 1 and 8 are denoted by the same reference numerals or the same reference notations as the counterparts.

The organic EL panel module 51 shown in the block diagram of FIG. 26 employs a pixel array section 53, a signal-line driving section 33, a first control-line driving section 35, a second control-line driving section 9 and a third control-line driving section 55. Each of the signal-line driving section 33, the first control-line driving section 35, the second control-line driving section 9 and the third control-line driving section 55 is a circuit for driving the pixel array section 53.

A typical configuration of the second embodiment is described below.

(a): Pixel Array Section

In the case of the second embodiment, the pixel array section 53 has sub-pixels 61 which each serves as a white unit laid out to form a two dimensional matrix.

Figure 3:
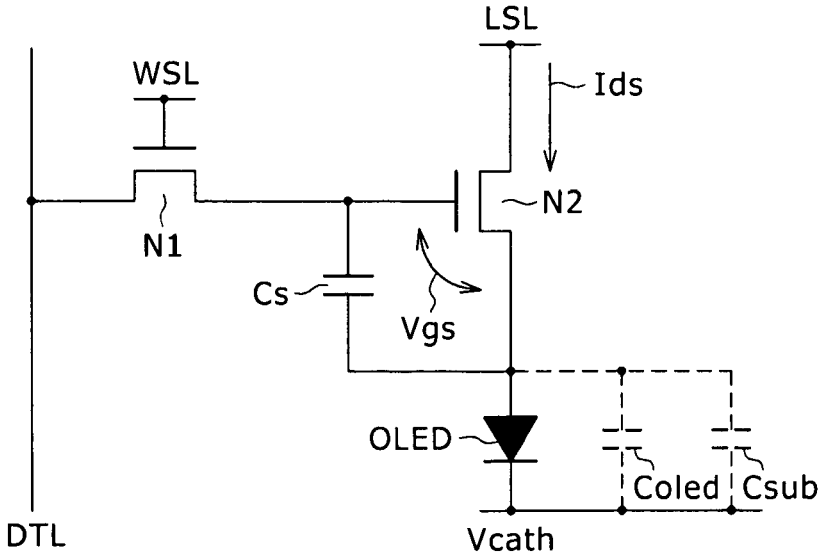
FIG. 3 RELATED ART
FIG. 3 is an explanatory circuit diagram showing the structure of a sub-pixel.
Figures 4A, 4B, 4C, 4D, 4E:
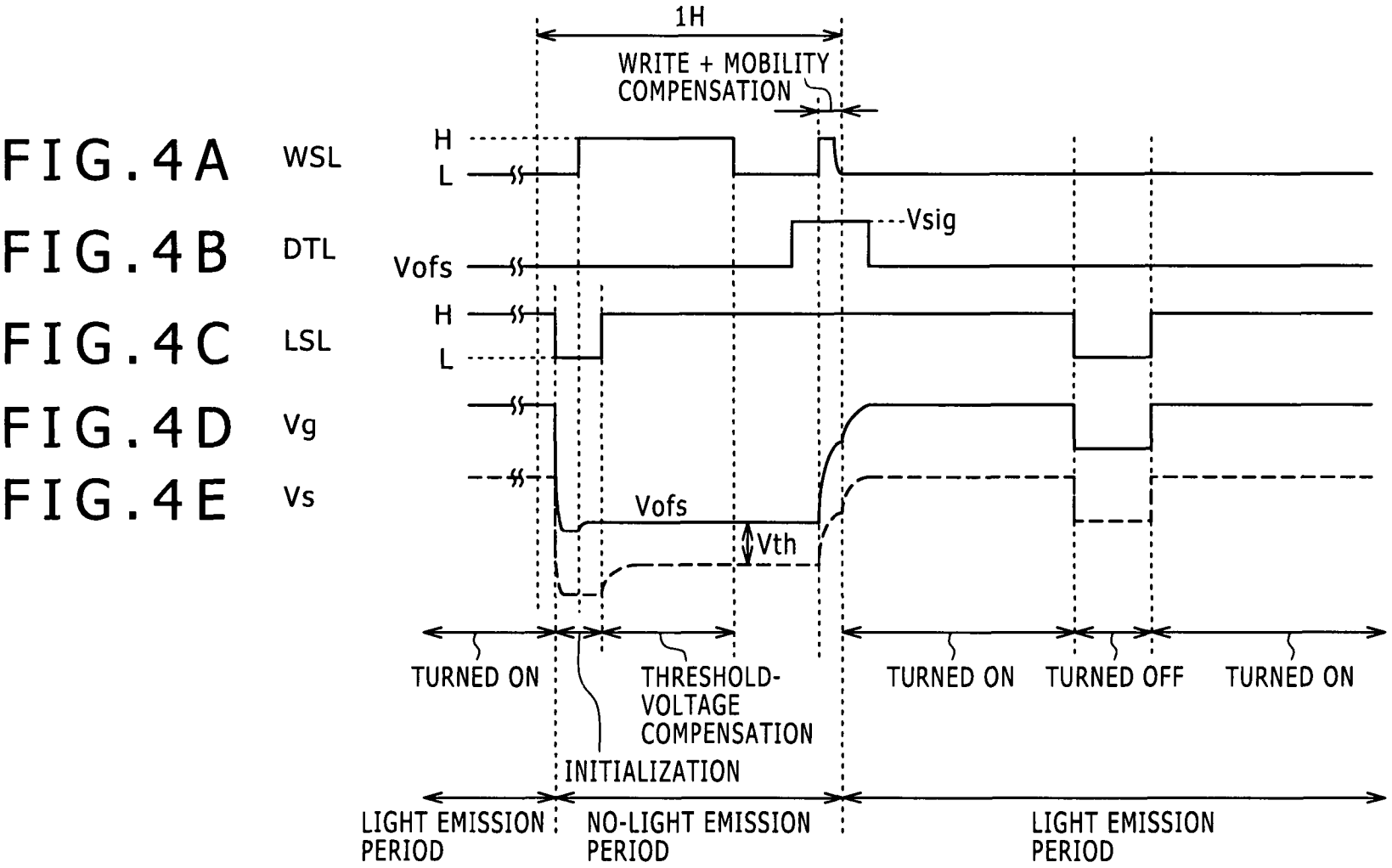
FIGS. 4A to 4E are explanatory timing diagrams showing timing charts of operations to drive the sub-pixel.
Figure 27:
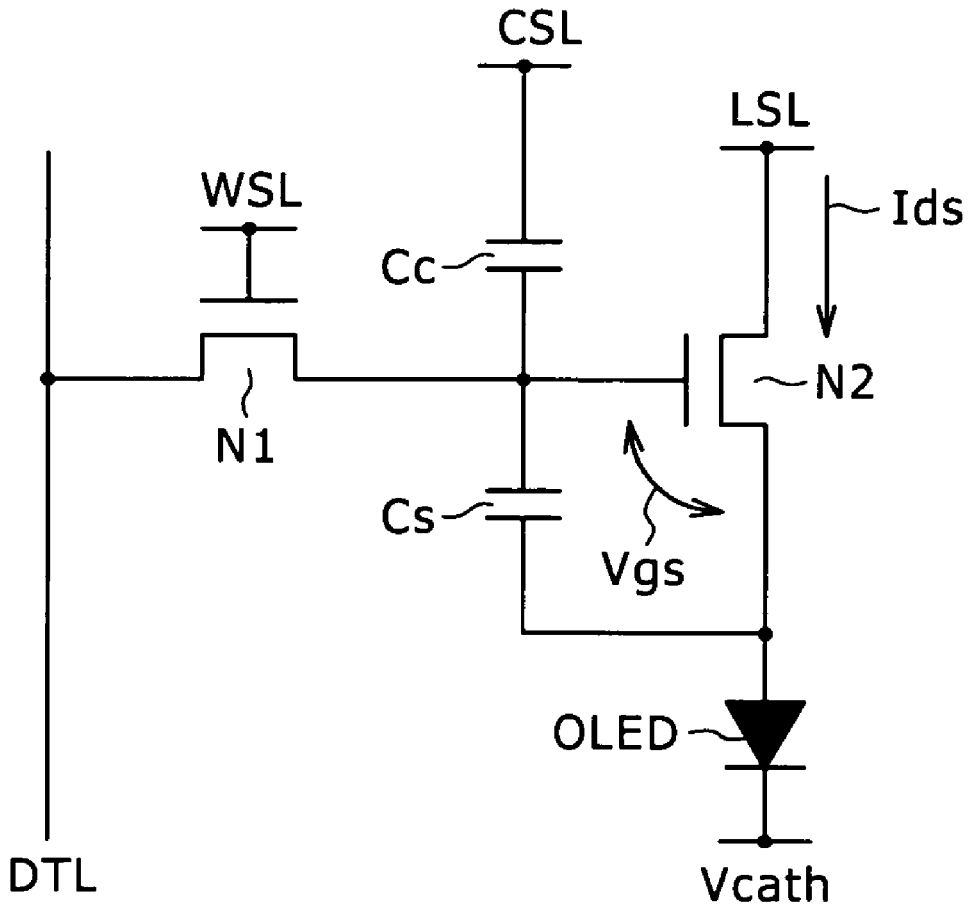
FIG. 27 is an explanation circuit diagram showing the configuration of a sub-pixel employed in the second embodiment.

FIG. 27 is an explanatory circuit diagram showing the configuration of the sub-pixel 61. It is to be noted that, in the circuit diagram of FIG. 27, components identical with their respective counterparts employed in the configuration shown in the circuit diagram of FIG. 3 are denoted by the same reference numerals or the same reference notations as the counterparts.

As shown in the circuit diagram of FIG. 27, the sub-pixel 61 employs a signal sampling transistor N1, a device driving transistor N2, a signal holding capacitor Cs to hold a signal potential Vsig, a dedicated coupling capacitor Cc and an organic EL device OLED.

The sub-pixel 61 employed in the second embodiment is different from the sub-pixel 11 employed in the first embodiment in that the sub-pixel 61 has the dedicated coupling capacitor Cc.

The coupling capacitor Cc is a capacitor for superposing a coupling voltage on the gate electrode G of the device driving transistor N2 during a light emission operation. For this reason, a specific one of the two electrodes of the coupling capacitor Cc is connected to the gate electrode G of the device driving transistor N2 whereas the other electrode is connected to the coupling control line CSL. It is needless to say that one coupling control line CSL is added to each horizontal line which serves as a row of the two dimensional matrix.

It is to be noted that the capacitance of the coupling capacitor Cc can be increased to a value which is greater than that for a case in which a parasitic capacitor of the device driving transistor N2 is used as a coupling capacitor. Thus, the change of an electric potential appearing on the coupling control signal line CSL can be made smaller than the change of an electric potential appearing on the lighting control signal line LSL employed in the first embodiment.

(b): Configuration of the Signal-Line Driving Section

The signal-line driving section 33 employed in this embodiment is the same as the signal-line driving section 33 employed in the first embodiment. This is because this embodiment also adopts a driving method for carrying out a coupling operation of the minus direction after the end of the initial portion of the light emission period. For this reason, this embodiment also increases the amplitude of the signal electric potential Vsig asserted on the data signal line DTL to a value greater than the essential driving voltage by a coupling voltage which is determined in advance.

(c): Configuration of the First Control-Signal Driving Section

By the same token, the first control-line driving section 35 employed in this embodiment carries out the same operation as the first control-line driving section 35 employed in the first embodiment. That is to say, the first control-line driving section 35 employed in this embodiment also carries out an operation to control the threshold-voltage compensation process and the mobility compensation process which are performed by the sub-pixel 61. Also in the case of this embodiment, the first control-line driving section 35 asserts a driving signal, which can have either one of two values determined in advance, on the data signal line DTL. To put it in detail, the first control-line driving section 35 sets the electric potential appearing on the write control signal line WSL at the H-level electric potential appearing on the power-supply line Vcc) in order to put the signal sampling transistor N1 in a turned-on state. On the other hand, the first control-line driving section 35 sets the electric potential appearing on the write control signal line WSL at the ground electric potential VSS of the L level in order to put the signal sampling transistor N1 in a turned-off state.

It is needless to say that the mobility compensation period in this embodiment is also set at a value shorter than the mobility compensation period found by calculation based on Eq. (2) as is the case with the first embodiment. In addition, the waveform of the driving pulse providing a timing to end the mobility compensation period is controlled to exhibit a steep falling portion.

(d): Configuration of the Second Control-Signal Driving Section

With the lighting control signal line LSL set at a specific one of two voltages determined in advance, a driving power is being supplied to the sub-pixel 11 by way of the lighting control signal line LSL. With the lighting control signal line LSL set at the other one of the two voltages determined in advance, on the other hand, no driving power is being supplied to the sub-pixel 11 by way of the lighting control signal line LSL.

Figure 28:
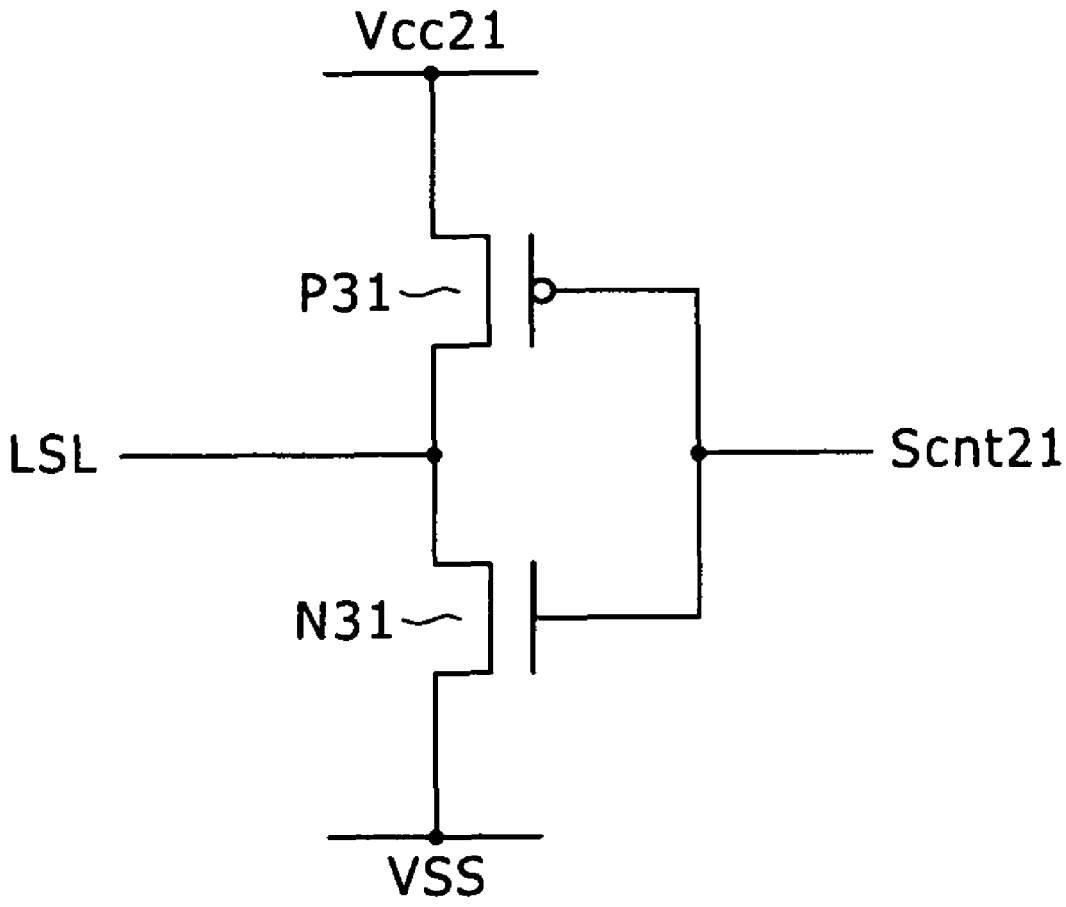
FIG. 28 is an explanatory diagram showing a partial configuration of a control-line driving section for driving a lighting control signal line.

FIG. 28 is a circuit diagram showing a typical partial configuration of the second control-signal driving section 9. That is to say, the circuit diagram of FIG. 28 shows only a configuration for one horizontal line which serves as a row of the two dimensional matrix. Thus, a plurality of configurations each shown in the diagram of FIG. 28 are laid out in the vertical direction of the screen. The number of configurations laid out in the vertical direction represents the vertical-direction resolution of the image displayed on the screen.

In the case of the partial configuration shown in the circuit diagram of FIG. 28, the second control-signal driving section 9 employs a thin-film transistor P31 of the P-channel type. A specific one of the two main electrodes of the thin-film transistor P31 of the P-channel type is connected to a power-supply line Vcc21 whereas the other main electrode thereof is connected to the lighting control signal line LSL. This lighting control signal line LSL is also connected to a specific one of the two main electrodes of a thin-film transistor N31 of the N-channel type. It is to be noted that the other main electrode of the thin-film transistor N31 of the N-channel type is connected to the ground electric potential Vss.

By the way, the gate electrode of the thin-film transistor P31 of the P-channel type and the gate electrode of the N-channel thin-film transistor N31 are connected to a common control line Scnt21. Since the characteristic of the thin-film transistor P31 of the P-channel type is different from the characteristic of the thin-film transistor N31 of the N-channel type, when a specific one of them is put in a turned-off state, the other one of them is put in a turned-on state. That is to say, the thin-film transistor P31 of the P-channel type and the thin-film transistor N31 of the N-channel type operate complementarily to each other.

In the case of the second embodiment, the electric potential appearing on the common control line Scnt21 is controlled by an output pulse generated by a corresponding output stage of a shift register, which is provided at the preceding stage, as a pulse having two binary values.

For example, in a time span between the initial portion of the no-light emission period and a turned-off portion of the light emission period, the second control-signal driving section 9 drives the lighting control signal line LSL to the ground electric potential VSS of the L level. In other time spans, on the other hand, the second control-signal driving section 9 drives the lighting control signal line LSL to an H-level electric potential which is appearing on the power-supply line Vcc21.

(e): Configuration of the Third Control-Signal Driving Section

The third control-signal driving section 55 is a driving device for controlling a coupling signal CSL by asserting a signal which may have either one of two values determined in advance on the coupling control line CSL. The coupling control line CSL is a control line which is peculiar to this embodiment. In the range of claims appended to this specification, the coupling control line CSL is referred to as a third control line. As described previously, the coupling control line CSL is a control line which is used for lowering the gate electric potential Vg appearing at the gate electrode G of the device driving transistor N2 after the start of the light emission period.

Figure 29:
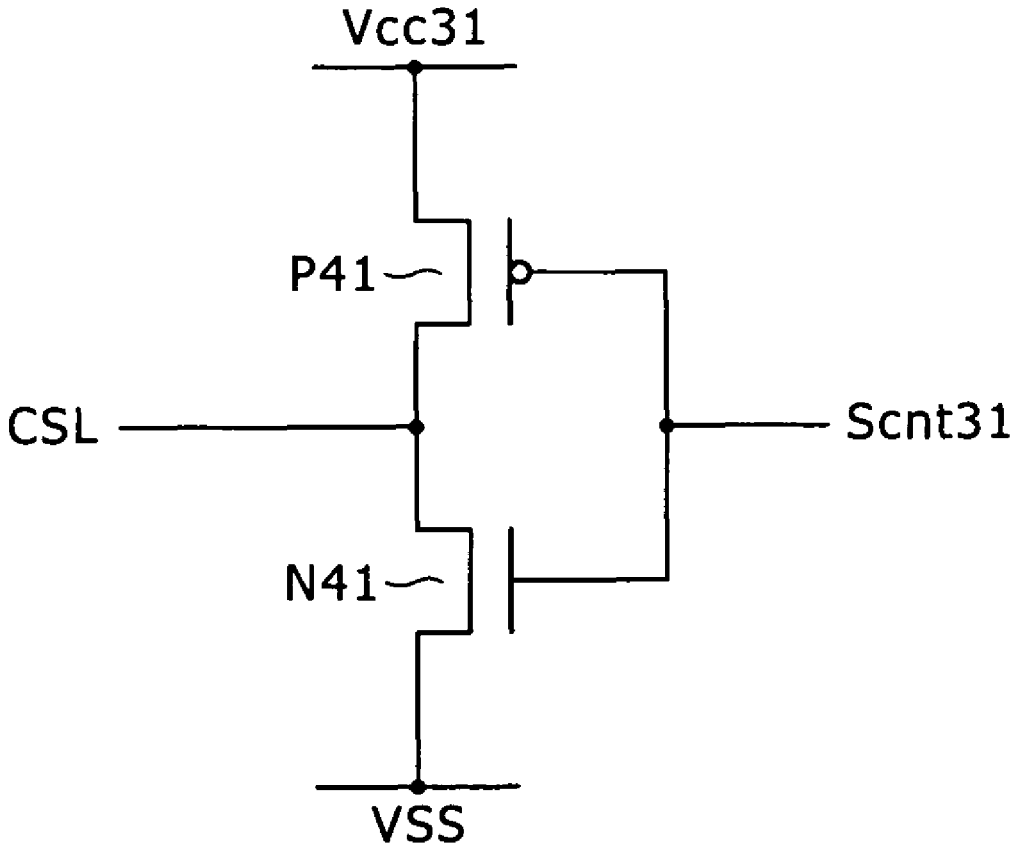
FIG. 29 is a circuit diagram showing a typical partial configuration of a control-line driving section for driving a coupling control line.

FIG. 29 is a circuit diagram showing a typical partial configuration of the third control-signal driving section 55. That is to say, the circuit diagram of FIG. 29 shows only a configuration for one horizontal line which serves as a row of the two dimensional matrix. Thus, a plurality of configurations each shown in the diagram of FIG. 29 are laid out in the vertical direction of the screen. The number of configurations laid out in the vertical direction represents the vertical-direction resolution of the image displayed on the screen.

In the case of the partial configuration shown in the circuit diagram of FIG. 29, the third control-signal driving section 55 employs a thin-film transistor P41 of the P-channel type. A specific one of the two main electrodes of the thin-film transistor P41 of the P-channel type is connected to a power-supply line Vcc31 whereas the other main electrode thereof is connected to the coupling control line CSL.

This coupling control line CSL is also connected to a specific one of the two main electrodes of a thin-film transistor N41 of the N-channel type. It is to be noted that the other main electrode of the thin-film transistor N41 of the N-channel type is connected to the ground electric potential Vss.

By the way, the gate electrode of the thin-film transistor P41 of the P-channel type and the gate electrode of the thin-film transistor N41 of the N-channel type are connected to a common control line Scnt31.

Since the characteristic of the thin-film transistor P41 of the P-channel type is different from the characteristic of the thin-film transistor N41 of the N-channel type, when a specific one of the two transistors is turned on, the other transistor is turned off and, when the specific transistor is turned off, the other transistor is turned on. That is to say, the thin-film transistor P41 of the P-channel type and the thin-film transistor N41 of the N-channel type operate in a manner of being complementary to each other.

In the case of this embodiment, the electric potential appearing on the common control line Scnt31 is controlled by a pulse supplied by an output stage employed by a shift register provided at a preceding stage as an output stage corresponding to the third control-signal driving section 55.

During a time span between the initial portion of the no-light emission period and the completion point of the initial portion of the light emission period for example, the third control-signal driving section 55 sets the coupling control line CSL at an H-level electric potential appearing on the power-supply line Vcc31. In other time spans, on the other hand, the third control-signal driving section 55 drives the coupling control line CSL to the ground electric potential VSS of the L level.

(C-2): Driving Operations

The following description explains typical driving operations carried out by the organic EL panel module 71 according to the second embodiment.

Figures 30A, 30B, 30C, 30D, 30E, 30F:
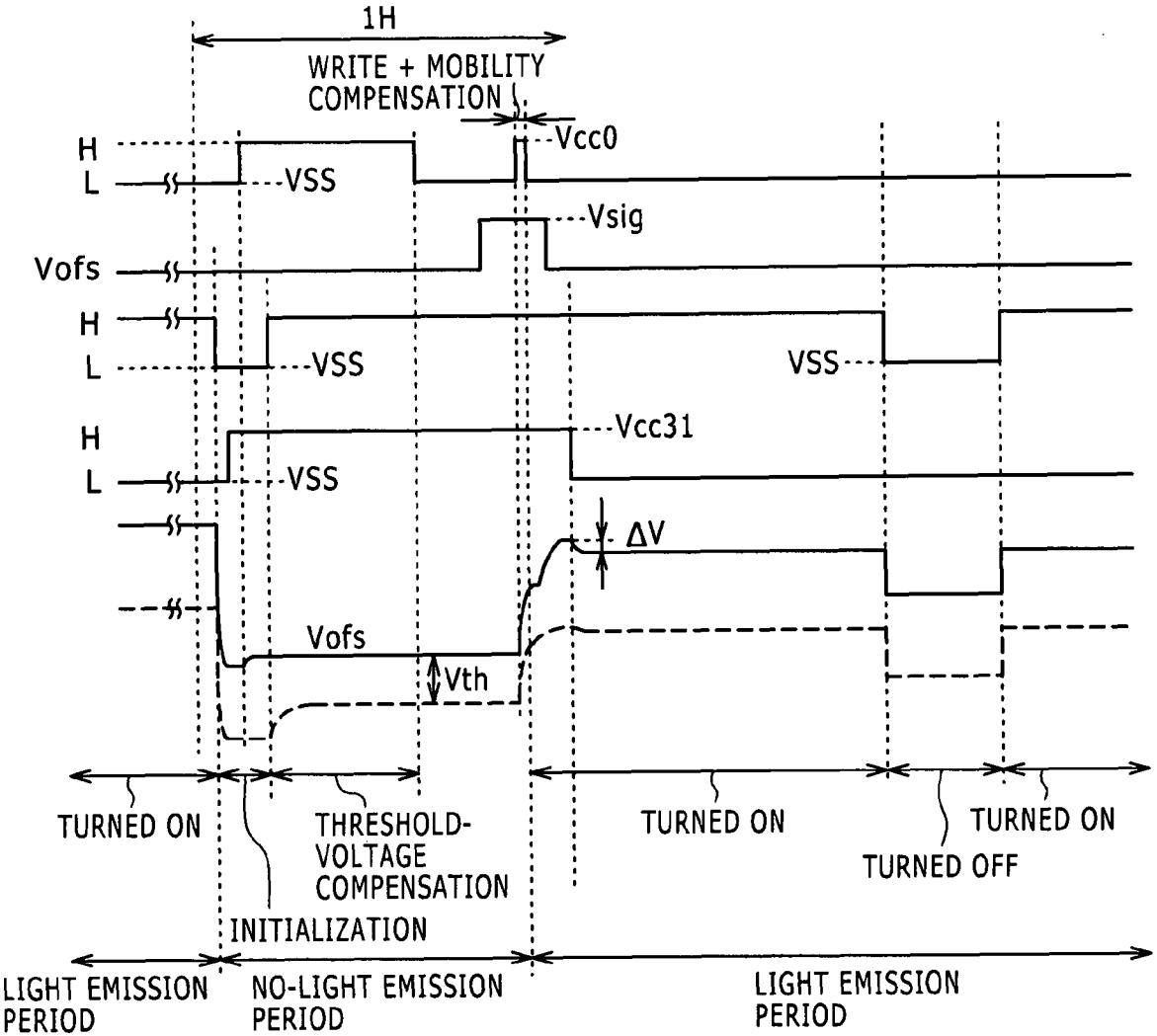
FIGS. 30A to 30F are timing charts showing waveforms representing changes of driving signals according to the second embodiment.

FIGS. 30A to 30F are explanatory timing charts showing changes of electric potentials inside a sub-pixel 81. To be more specific, FIG. 30A is a timing chart showing a waveform representing changes of a driving signal appearing on the write control signal line WSL whereas FIG. 30B is a timing chart showing a waveform representing changes of a driving signal appearing on the data signal line DTL. FIG. 30C is a timing chart showing a waveform representing changes of a driving signal appearing on the lighting control signal line LSL whereas FIG. 30D is a timing chart showing a waveform representing changes of a driving signal appearing on the coupling control signal line CSL. FIG. 30E is a timing chart showing a waveform representing changes of a gate electric potential Vg of the device driving transistor N2 whereas FIG. 30F is a timing chart showing a waveform representing changes of a source electric potential Vs of the device driving transistor N2. It is to be noted that, also in the case of this embodiment, the basic operations including the coupling operation carried out after the start of the light emission period are the same as those of the first embodiment.

(a): Initialization Process

When a light emission period is ended, a no-light emission period is started. When the no-light emission period is started, the initialization process of the sub-pixel 61 is carried out in order to make a preparation for a new process to store a signal electric potential Vsig. In addition, the electric potential appearing on the lighting control signal line LSL is set at the ground electric potential VSS.

Figure 31:
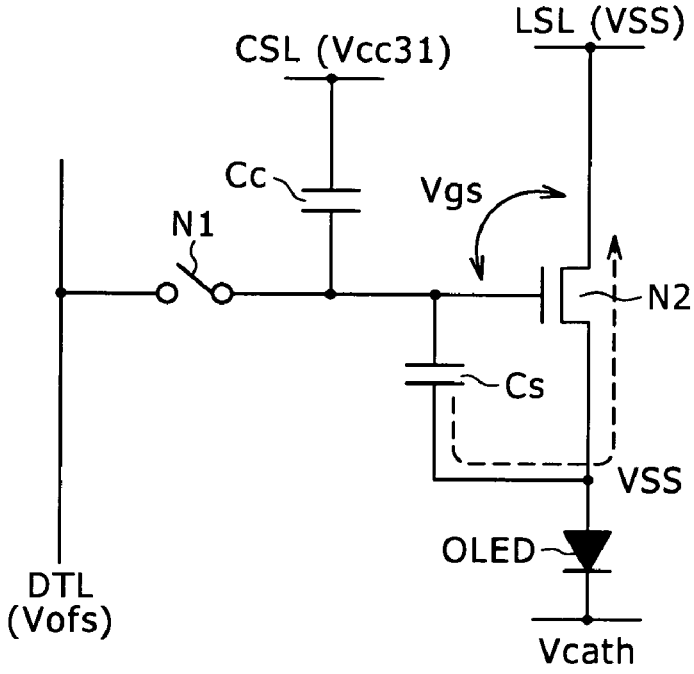
FIG. 31 is an explanatory diagram showing an equivalent circuit of the sub-pixel to serve as a circuit representing the state of the sub-pixel at the start of an initialization process.

FIG. 31 is a circuit diagram showing an equivalent circuit of the sub-pixel 61 which is operating at this initialization time. As shown in the circuit diagram of FIG. 31, the signal sampling transistor N1 has been controlled to enter a turned-off state.

At this time, a voltage appearing between the gate electrode G of the device driving transistor N2 and the lighting control signal line LSL is greater than the threshold voltage Vth of the device driving transistor N2. Thus, the device driving transistor N2 is put in a turned-on state, drawing electric charge which has been accumulated in the signal holding capacitor Cs. As the electric charge accumulated in the signal holding capacitor Cs is drawn from the signal holding capacitor Cs, the source electric potential Vs appearing at the source electrode S of the device driving transistor N2 drops, becoming equal to the ground electric potential VSS. In addition, the gate electric potential Vg appearing at the gate electrode G of the device driving transistor N2 also drops due to the fall of the source electric potential Vs. As described earlier, the source electric potential Vs appearing at the source electrode S of the device driving transistor N2 is no other than the electric potential appearing at the anode electrode of the organic EL device OLED because the source electrode S is connected to the anode electrode.

It is to be noted that, in the case of this embodiment, during the period of the initialization process, the coupling control line CSL is controlled to change from the ground electric potential VSS of the L level to the H-level electric potential appearing on the power-supply line Vcc31. Thus, since the gate electrode G of the device driving transistor N2 has been put in a floating state, the gate electric potential Vg appearing at the gate electrode G also rises due to a coupling-operation effect exercised on the gate electrode G through the coupling capacitor Cc. Since the increase of the gate electric potential Vg appearing at the gate electrode G of the device driving transistor N2 is reset to the offset electric potential Vofs in a threshold-voltage compensation process, however, the increase of the gate electric potential Vg does not have an effect on the threshold-voltage compensation process.

Figure 32:
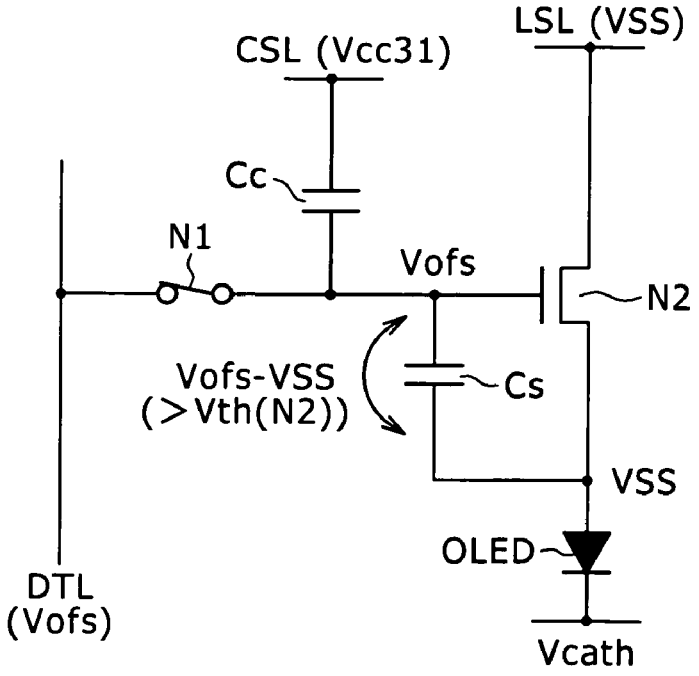
FIG. 32 is an explanatory diagram showing an equivalent circuit of the sub-pixel during a threshold-voltage compensation preparation process.

(b): Threshold-Voltage Compensation Preparation Process and Threshold-Voltage Compensation Process The initialization process described above is ended and the signal sampling transistor N1 is put in a turned-on state in order to apply the offset electric potential Vofs used as a reference electric potential to the gate electrode of the device driving transistor N2. FIG. 32 shows the equivalent circuit diagram showing an equivalent circuit of the sub-pixel 61. At the end of the threshold-voltage compensation preparation process, the signal holding capacitor Cs of the device driving transistor N2 is equal to a difference of (Vofs−VSS) which is greater than the threshold voltage Vth of the device driving transistor N2. The process is referred to as a threshold-voltage compensation preparation process.

Figure 33:
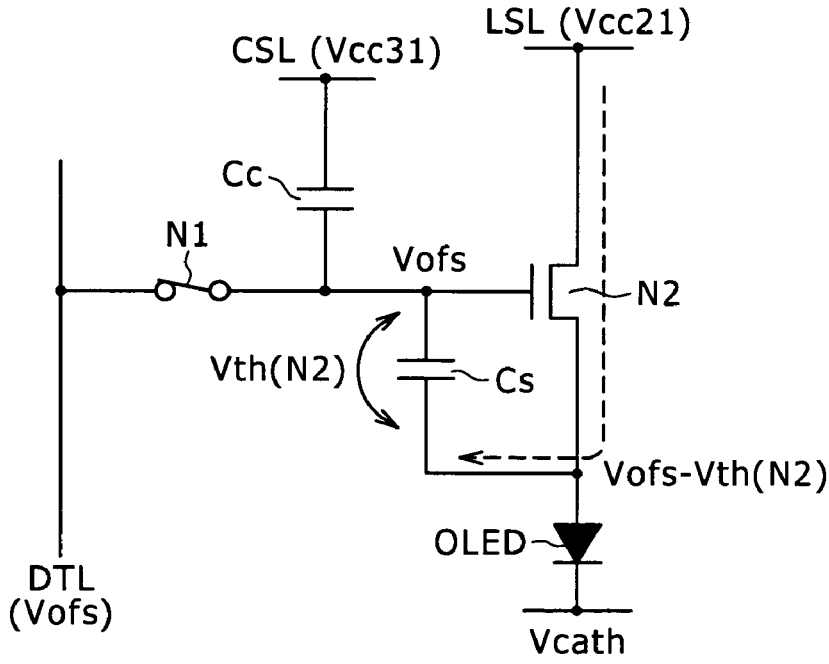
FIG. 33 is an explanatory diagram showing an equivalent circuit of the sub-pixel to serve as a circuit representing the state of the sub-pixel during a threshold-voltage preparation process.

In actuality, when the voltage appearing between the electrodes of the signal holding capacitor Cs is assumed to have exceeded the threshold voltage Vth of the device driving transistor N2, the lighting control signal line LSL is changed to the on electric potential Vcc21. FIG. 33 shows the equivalent circuit diagram showing an equivalent circuit of the sub-pixel 61. At this time, the drain-source voltage Vds appearing between the drain and source electrodes of the device driving transistor N2 is increased. Thus, the device driving transistor N2 is put in a turned-on state, causing a driving current Ids to flow in a direction from the lighting control signal line LSL to the signal holding capacitor Cs. As a result, electric charge accumulated in the signal holding capacitor Cs is neutralized. While the driving current Ids is flowing in a direction from the lighting control signal line LSL to the signal holding capacitor Cs, the source electric potential Vs of the device driving transistor N2 starts to rise.

It is to be noted that the source electric potential Vs rises so that the voltage appearing between the electrodes of the signal holding capacitor Cs becomes equal to the threshold voltage Vth (N2) of the device driving transistor N2. At the point of time, the driving current Ids stops to flow. This because the device driving transistor N2 automatically enters a cut-off state.

Figure 34:
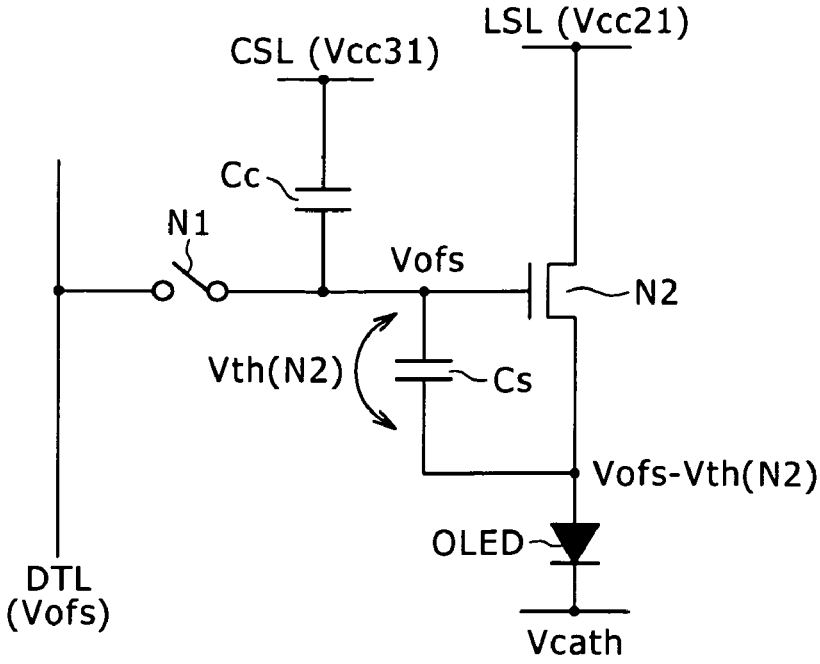
FIG. 34 is an explanatory diagram showing an equivalent circuit of the sub-pixel to serve as a circuit representing the state of the sub-pixel at the end of the threshold-voltage compensation process.

When the threshold-voltage compensation process is assumed to have ended as shown in FIG. 34, the signal sampling transistor N1 is controlled to enter a turned-off state. That is to say, the ground electric potential VSS which is an off electric potential is applied to the write control signal line WSL.

(c): Signal Electric-Potential Write Process and Mobility Compensation Process

Figure 35:
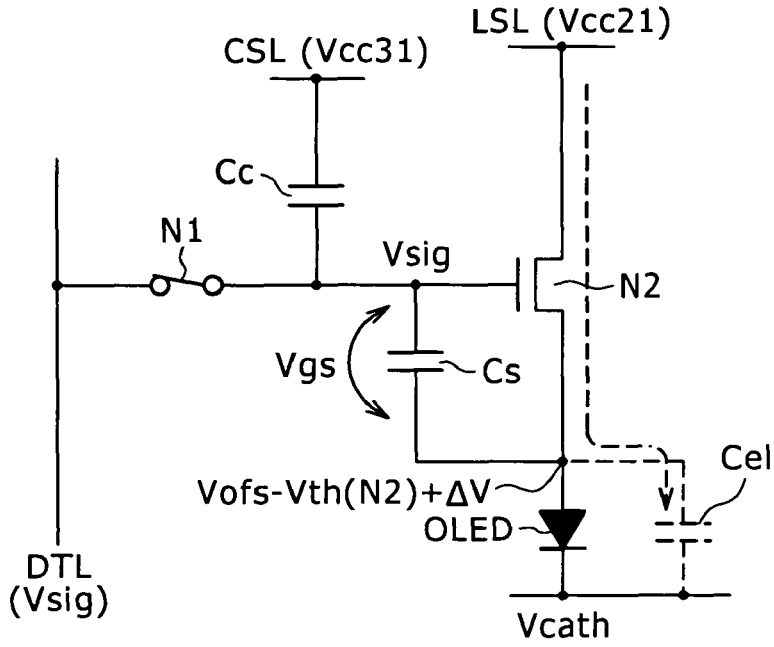
FIG. 35 is an explanatory diagram showing an equivalent circuit of the sub-pixel to serve as a circuit representing the state of the sub-pixel at the start of a signal electric-potential write process and a mobility compensation process.

At a time after the threshold-voltage compensation process has been ended, the electric potential appearing on the data signal line DTL is changed from the offset electric potential Vofs to the signal electric potential Vsig. Then, the write control signal line WSL is controlled to enter a turned-on state in order to put the signal sampling transistor N1 in a turned-on state. FIG. 35 shows the equivalent circuit of the sub-pixel 61.

The signal electric potential Vsig is stored in the signal holding capacitor Cs so that the gate-source voltage Vgs of the device driving transistor N2 again exceeds the threshold voltage Vth (N2). As a result, the device driving transistor N2 is controlled to enter a turned-on state.

Thus, an operation to supply a driving current Ids to the organic EL device OLED is started. It is to be noted, however, that the driving current Ids electrically charges the parasitic capacitor Ce1 of the organic EL device OLED and other capacitors instead of flowing through the organic EL device OLED. As a result, the electric potential appearing at the anode electrode of the organic EL device OLED rises by the mobility compensation voltage ΔV. As described earlier, the electric potential appearing at the anode electrode of the organic EL device OLED is no other than the source electric potential Vs appearing at the source electrode S of the device driving transistor N2 because the anode electrode of the organic EL device OLED is connected to the source electrode S of the device driving transistor N2. It is to be noted that the mobility compensation time T during which a driving pulse is generated is common to all levels of the signal electric potential Vsig. In addition, the waveform of the actual driving pulse shows a transient portion like one shown in the diagram of FIG. 13 due to effects of a wire capacitor and other capacitors.

For this reason, the mobility compensation time of a low luminance gradation is longer than the mobility compensation time of a high luminance gradation. It is needless to say that the mobility compensation time is set at a value which is optimized for the signal electric potential Vsig applied to the data signal line DTL after the minus-direction coupling driving operation.

Thus, in this case, the mobility compensation time T can be made shorter than the mobility compensation time t found by calculation based on Eq. (2) for the signal electric potential Vsig actually applied to the data signal line DTL.

In addition, by taking the coupling operation carried out thereafter into consideration, the mobility compensation voltage ΔV can have a magnitude smaller than half the signal electric potential Vsig actually applied to the data signal line DTL.

It is needless to say that the mobility compensation voltage ΔV is determined so that the value of the expression (Vofs−Vth (N2)+8V) does not exceed the threshold voltage Vth (oled) of the organic EL device OLED.

Thus, the organic EL device OLED is by no means put in a turned-on state in the course of the mobility compensation process. That is to say, also during the mobility compensation process, the organic EL device OLED remains in a turned-off state as it is.

(d): Light Emission Operation (Including a Coupling Operation)

Figure 36:
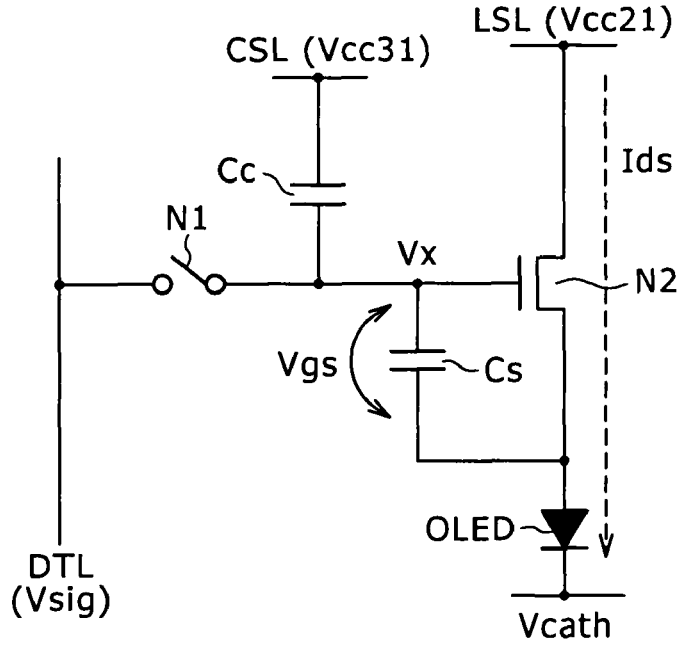
FIG. 36 is a circuit diagram showing an equivalent circuit of the sub-pixel that prevails during an initial portion of a light emission period.

The signal sampling transistor N1 is controlled to enter a turned-off state in order to end the mobility compensation process. FIG. 36 is a circuit diagram showing an equivalent circuit of the sub-pixel 61 at a point of time the signal sampling transistor N1 is put in a turned-off state. The signal sampling transistor N1 is put in a turned-off state by changing the driving pulse asserted on the write control signal line WSL from an H-level electric potential appearing on the power-supply line Vcc0 to the ground electric potential VSS of the L level.

That is to say, when the driving pulse asserted on the write control signal line WSL is changed from an H-level electric potential appearing on the power-supply line Vcc0 to the ground electric potential VSS of the L-level, the signal sampling transistor N1 is controlled to enter a turned-off state, electrically disconnecting the gate electrode G of the device driving transistor N2. In other words, the signal sampling transistor N1 is controlled to enter a turned-off state in order to put the gate electrode G of the device driving transistor N2 in a floating state.

In the mean time, the device driving transistor N2 continues the operation to supply the driving current Ids to the organic EL device OLED. For this reason, the operation to electrically charge the parasitic capacitor of the organic EL device OLED also continues as well. As a result, the electric potential appearing at the anode electrode of the organic EL device OLED rises.

Since the anode electrode of the organic EL device OLED is connected to the source electrode S of the device driving transistor N2, the source electric potential Vs appearing at the source electrode S also increases when the electric potential appearing at the anode electrode of the organic EL device OLED rises. In addition, when the source electric potential Vs appearing at the source electrode S of the device driving transistor N2 increases, the gate electric potential Vg appearing at the gate electrode G of the device driving transistor N2 also rises as well due to a bootstrap operation.

Then, the source electric potential Vs appearing at the source electrode S of the device driving transistor N2 attains the threshold voltage Vth(oled) of the organic EL device OLED. At the point of the time, the organic EL device OLED is put in a turned-on state. With the organic EL device OLED put in a turned-on state, the driving current Ids generated by the device driving transistor N2 flows through the organic EL device OLED, causing the organic EL device OLED to emit light with a luminance level determined by the magnitude of the driving current Ids.

It is to be noted that the luminance level of light emitted by the organic EL device OLED during this light emission period is a luminance level determined by the magnitude of the signal electric potential Vsig actually asserted on the data signal line DTL. That is to say, the luminance level of light emitted by the organic EL device OLED during this light emission period is different from the supposed luminance level. Thus, the shorter the light emission process carried out in the initial period, the better the result. Then, the electric potential appearing on the coupling control line CSL is changed to the ground electric potential VSS, which is a turned-off electric potential.

Figure 37:
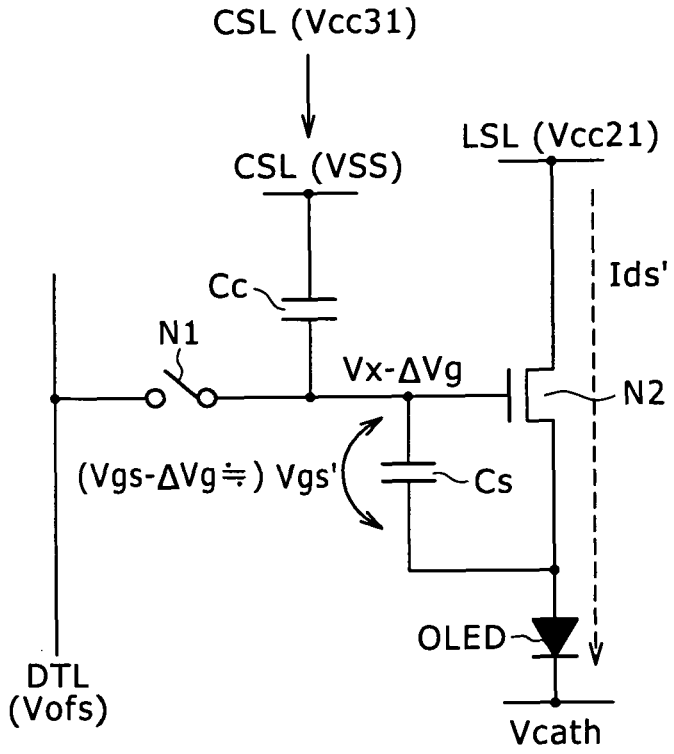
FIG. 37 is a circuit diagram showing an equivalent circuit of the sub-pixel for a case in which a minus-direction coupling operation is carried out.

FIG. 37 is a circuit diagram showing an equivalent circuit of the sub-pixel 61 as an equivalent circuit that prevails at a point of time the electric potential appearing on the coupling control line CSL is changed from an H-level electric potential to the ground electric potential VSS. To put it in detail, at this point of time, the electric potential appearing on the coupling control line CSL is changed from an H-level electric potential appearing on the power-supply line Vcc31 to the ground electric potential VSS of the L level. The change of the electric potential appearing on the coupling control line CSL is passed on to the gate electrode G of the device driving transistor N2 by way of the coupling capacitor Cc because the gate electrode G of the device driving transistor N2 has been put in a floating state as described above.

That is to say, the gate electric potential Vg appearing at the gate electrode G of the device driving transistor N2 drops from the signal electric potential Vx to an electric potential of (Vx−ΔVg). On the other hand, the source electric potential Vs appearing at the source electrode S of the device driving transistor N2 is fixed at an electric potential to which the driving current Ids generated by the device driving transistor N2 has electrically charged the parasitic capacitor of the organic EL device OLED and the like.

Thus, as a result of the coupling operation, the gate-source voltage Vgs' appearing between the gate (G) and source (S) electrodes of the device driving transistor N2 changes from Vgs to (Vgs−ΔVg).

Figure 38:
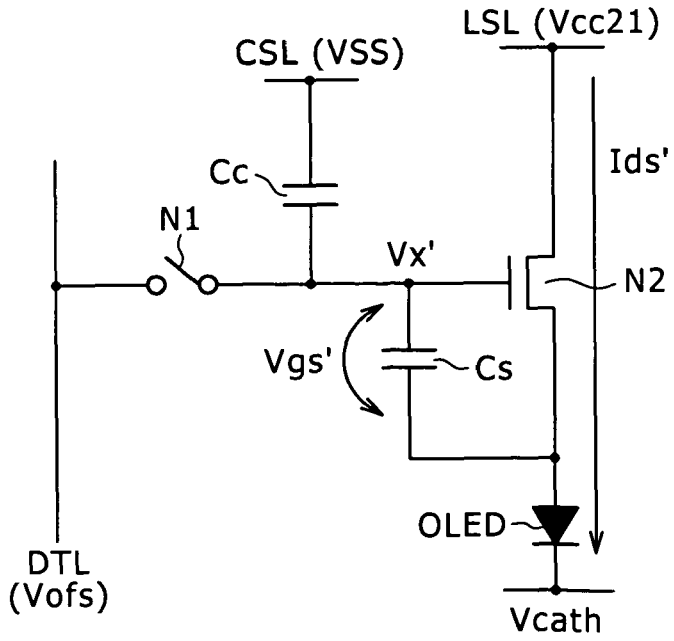
FIG. 38 is a circuit diagram showing an equivalent circuit of the sub-pixel that prevails after the initial portion of the light emission period.

FIG. 38 is a circuit diagram showing an equivalent circuit of the sub-pixel 61 as an equivalent circuit that prevails after the completion of a process of reducing the gate-source voltage Vgs appearing between the gate (G) and source (S) electrodes of the device driving transistor N2 by carrying out the coupling operation.

As shown in the circuit diagram of FIG. 38, in the light emission period, after the gate-source voltage Vgs' appearing between the gate (G) and source (S) electrodes of the device driving transistor N2 changes from Vgs to (Vgs−ΔVg) due to the coupling operation, a driving current Ids' is flowing to the organic EL device OLED so that the light transmission state of emitting light with a luminance level obtained after the mobility compensation process is continued. The driving current Ids' flowing to the organic EL device OLED has a magnitude determined by the gate-source voltage Vgs' which appears between the gate (G) and source (S) electrodes of the device driving transistor N2 after the coupling operation.

It is needless to say that an electric-potential relation obtained after the execution of mobility compensation process based on the coupling operation is the same as an electric-potential relation which prevails after a proper mobility compensation process has been carried out as is the case with the first embodiment.

(C-3): Effects of the Embodiment

In the case of this embodiment, the coupling capacitor Cc and the coupling control line CSL serving as a line for driving the coupling capacitor Cc are added as new components. Thus, it is possible to simplify the configuration of the driving circuit for driving the lighting control signal line LSL which functions as the power supply line.

In addition, by employing the coupling capacitor Cc as a new component, it is possible easily carry out an operation to set the mobility compensation voltage ΔV in comparison with the configuration in which the coupling operation is carried out on the basis of a parasitic capacitor.

(D): Other Embodiments (D-1): First Other Typical Configuration of the Second Control-Line Driving Section In the case of the first embodiment described above, the second control-line driving section 37 having a configuration shown in the circuit diagram of FIG. 14 functions as a section for driving the lighting control signal line LSL.

Figure 39:
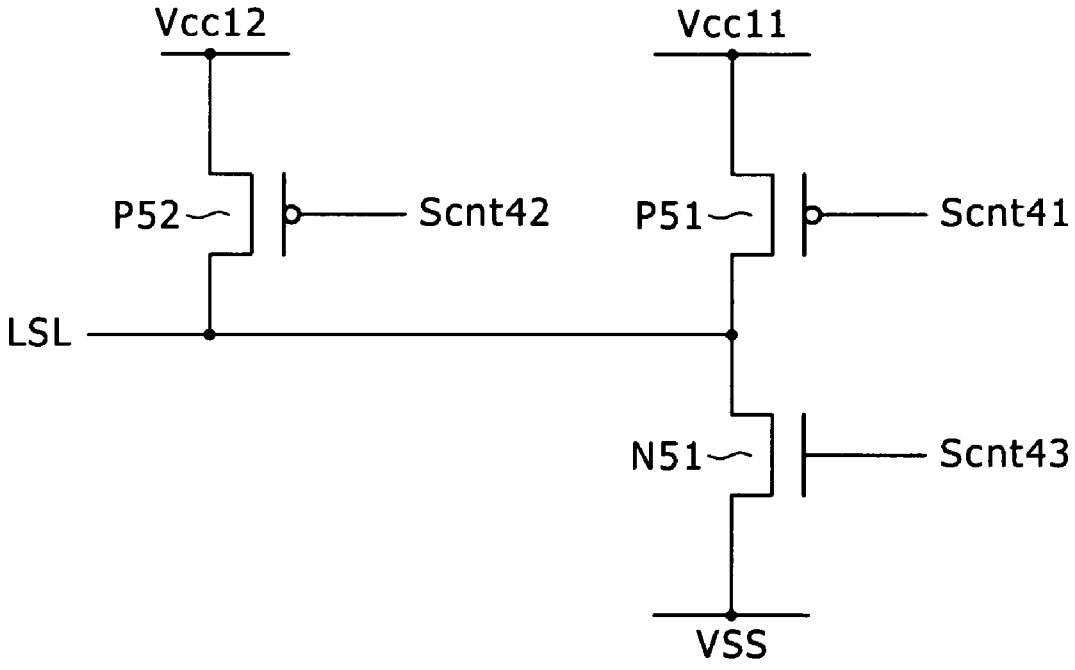
FIG. 39 is an explanatory circuit diagram showing another configuration of the control-line driving section which is also proper for driving the lighting control signal line.

However, the second control-line driving section can have another circuit configuration. FIG. 39 is an explanatory circuit diagram showing another configuration of the second control-line driving section 37 which is also proper for driving the lighting control signal line LSL.

In the case of the second control-line driving section 37 shown in the circuit diagram of FIG. 39, a switch is provided for each of the three electric potentials Vss, Vcc11 and Vcc12 to be applied to the lighting control signal line LSL. Each of the switches is typically a thin-film transistor.

In the case of the second control-line driving section 37 shown in the circuit diagram of FIG. 39, thin-film transistors P51 and P52 of the P-channel type are connected in parallel to the lighting control signal line LSL.

A specific one of the two main electrodes of the first P-channel thin-film transistor P51 is connected to a power supply line on which the low-level ON electric potential Vcc11 is asserted and the other main electrode of the first P-channel thin-film transistor P51 is connected to the lighting control signal line LSL. On the other hand, a specific one of the two main electrodes of the second P-channel thin-film transistor P52 is connected to a power supply line on which the high level ON electric potential Vcc12 is asserted and the other main electrode of the second P-channel thin-film transistor P52 is connected to the lighting control signal line LSL.

A specific one of the two main electrodes of a thin-film transistor N51 designed as a transistor of the N-channel type is connected in series to the two thin-film transistors P51 and P52 whereas the other main electrode of the N-channel thin-film transistor N51 is connected to the ground electric potential VSS.

In the case of the second control-line driving section 37 shown in the circuit diagram of FIG. 39, the gate electrodes of the first P-channel thin-film transistor P51, the second P-channel thin-film transistor P52 and the N-channel thin-film transistor N51 are connected to dedicated control signal lines Scnt41, Scnt42 and Scnt43 respectively.

To be more specific, the gate electrode of the first P-channel thin-film transistor P51 is connected to the dedicated control signal line Scnt41, the gate electrode of the second P-channel thin-film transistor P52 is connected to the dedicated control signal line Scnt42 and the gate electrode of the N-channel thin-film transistor N51 is connected to the dedicated control signal line Scnt43.

The electric potential appearing on each of the dedicated control signal line Scnt41, the dedicated control line Scnt42 and the dedicated control signal line Scnt43 is controlled by an output pulse generated by a corresponding output stage of a shift register, which is provided at the preceding stage, as a pulse having two binary values.

Figures 40A, 40B, 40C, 40D:
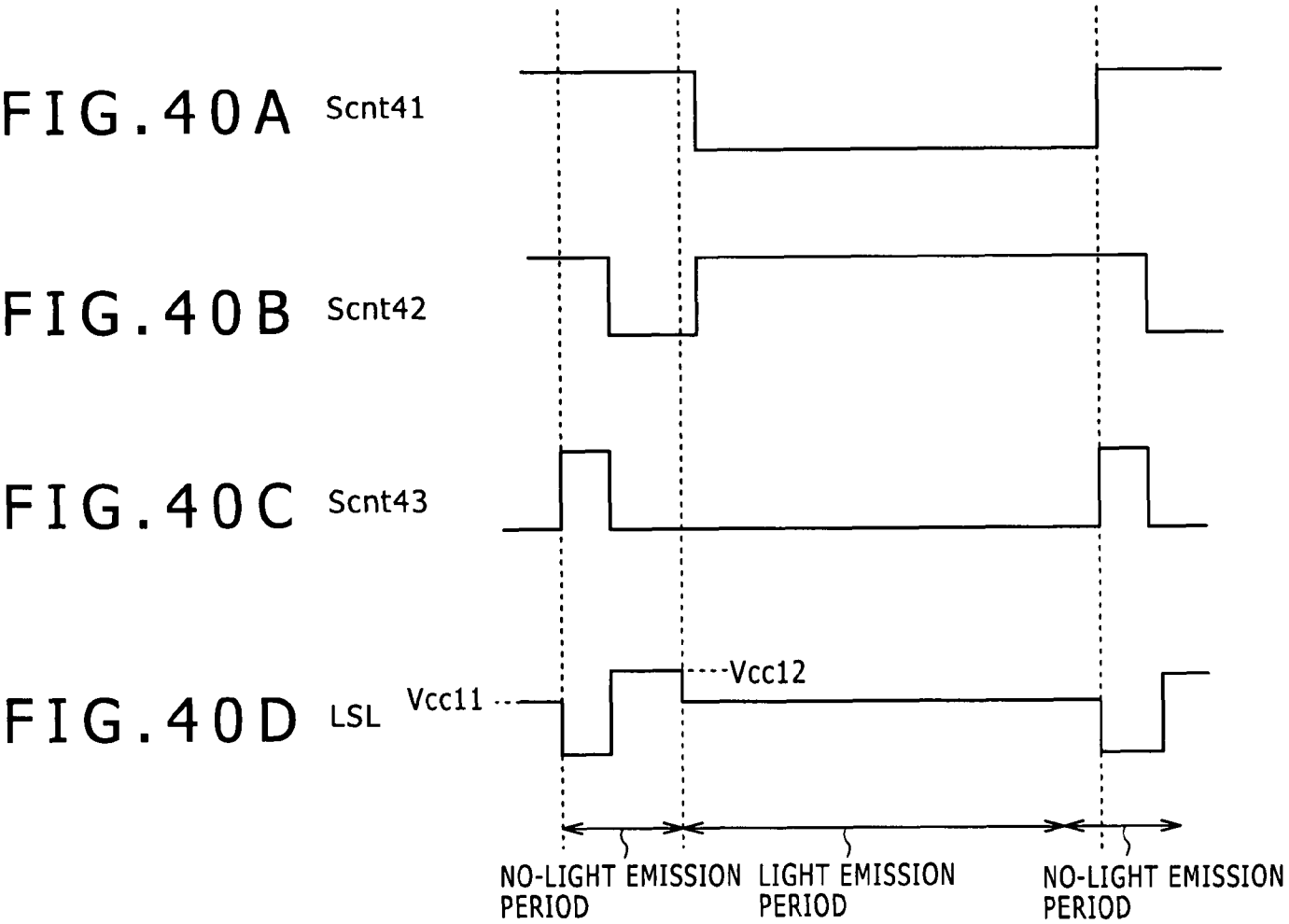
FIGS. 40A to 40D are timing charts of driving signals in the control-line driving section shown in the circuit diagram of FIG. 39.

FIGS. 40A to 40D are explanatory timing charts showing relations between the waveforms of driving signals in the second control-line driving section shown in FIG. 39 and operation periods of the pixel circuit. To be more specific, FIG. 40A is a timing chart showing the waveform of a driving signal asserted on the dedicated control signal line Scnt41 whereas FIG. 40B is a timing chart showing the waveform of a driving signal asserted on the dedicated control signal line Scnt42. FIG. 40C is a timing chart showing the waveform of a driving signal asserted on the dedicated control signal line Scnt43 whereas to FIG. 40D is a timing chart showing the waveform of an electric potential appearing on the lighting control signal line LSL.

In the case of the circuit configuration, first of all, when the electric potential of the dedicated control signal line Scnt43 is set at the H level, the thin-film transistor N51 of the N-channel type is put in a turned-on state, controlling the electric potential appearing on the lighting control signal line LSL to the L level (VSS).

Then, the electric potential of the dedicated control signal line Scnt43 is changed from the H level back to the L level. Interlocked with the operation to change the electric potential of the dedicated control signal line Scnt43, the electric potential of the dedicated control signal line Scnt42 is also changed from the H level to the L level in order to put the first thin-film transistor P52 of the P-channel type in a turned-on state outputting the high-level ON electric potential Vcc12 to the lighting control signal line LSL.

Then, the electric potential appearing on the dedicated control signal line Scnt42 is changed from the L level back to the H level. Interlocked with the operation, the electric potential appearing on the dedicated control signal line Scnt41 is changed from the H level to the L level in order to put the first thin-film transistor P51 of the P-channel type in a turned-on state outputting the low level ON electric potential Vcc11 of a low level to the lighting control signal line LSL. By carrying out this operation, it is possible to implement electric-potential changes entirely identical with those of the circuit configuration shown in the diagram of FIG. 14.

(D-2) Second Other Typical Configuration of the Control-Line Driving Section

In the case of the embodiment described above, the falling waveform of a control pulse requesting the execution of the mobility compensation process is designed as a rectangular wave.

If it is desired to raise the degree of precision of the mobility compensation process, however, the falling waveform of the control pulse can also be controlled in order to obtain the mobility compensation curve which is shown in the diagram of FIG. 13. The following description explains a typical configuration of the first control-line driving section 35 which is capable of generating a driving pulse for obtaining a mobility compensation curve of this type.

Figure 41:
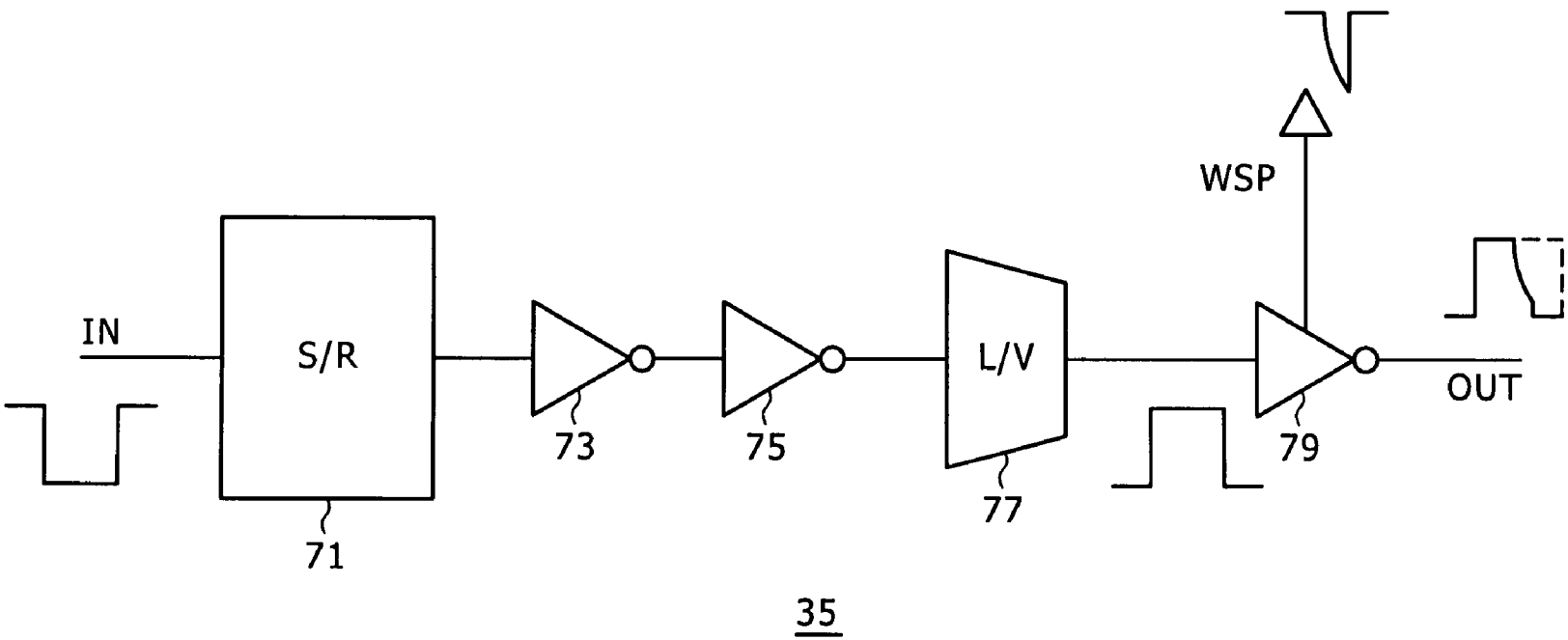
FIG. 41 is a block diagram showing another typical circuit configuration of the control-line driving section for driving the write control signal line.

FIG. 41 is an explanatory diagram showing a typical partial configuration of the control-line driving section 35. That is to say, the diagram of FIG. 41 shows the configuration for one horizontal line or one control signal line WSL. Thus, a plurality of configurations each shown in the diagram of FIG. 41 are laid out in the vertical direction of the screen. The number of configurations laid out in the vertical direction represents the vertical-direction resolution of the image displayed on the screen.

In the following description, the partial circuit, the configuration of which is shown in the diagram of FIG. 41, is also referred to as the control-line driving section 35 in order to make the explanation simpler. As shown in the figure, the control-line driving section 35 employs a shift register 71, an inverter circuit 73 provided at a preceding stage, an inverter circuit 75 provided at a succeeding stage, a level shifter 77 and a single-stage inverter circuit 79. The preceding-stage inverter circuit 73 and the succeeding-stage inverter circuit 75 serve as a buffer circuit.

A mobility-compensation curve is generated by the single-stage inverter circuit 79 in accordance with the level of the waveform of a power-supply voltage pulse WSP supplied to the single-stage inverter circuit 79.

Figure 42:
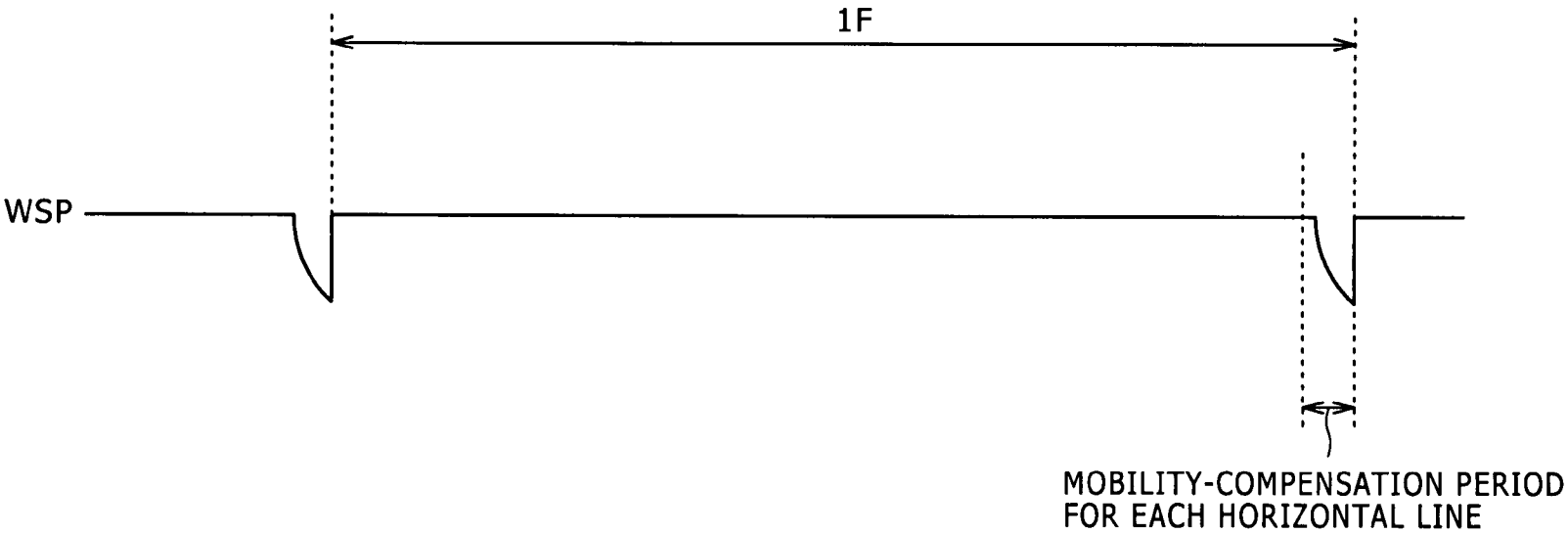
FIG. 42 is an explanatory diagram showing a typical waveform representing changes of a power-supply voltage pulse.

FIG. 42 is an explanatory diagram showing a waveform representing changes of the power-supply voltage pulse WSP.

As shown in the diagram of FIG. 42, the mobility-compensation curve portion for a horizontal line is set at a timing phase-synchronized to the mobility-compensation period for the horizontal line.

In the case of the embodiment, the mobility-compensation curve is set to have such a shape that a mobility-compensation process excessive for an applied signal electric potential Vsig is carried out. That is to say, the mobility-compensation curve shown in FIG. 13 is set to have such a shape that a mobility-compensation process excessive is carried out for every applied signal electric potential Vsig during a mobility-compensation period shorter than the mobility-compensation time computed in accordance with Eq. (2).

Figure 43:
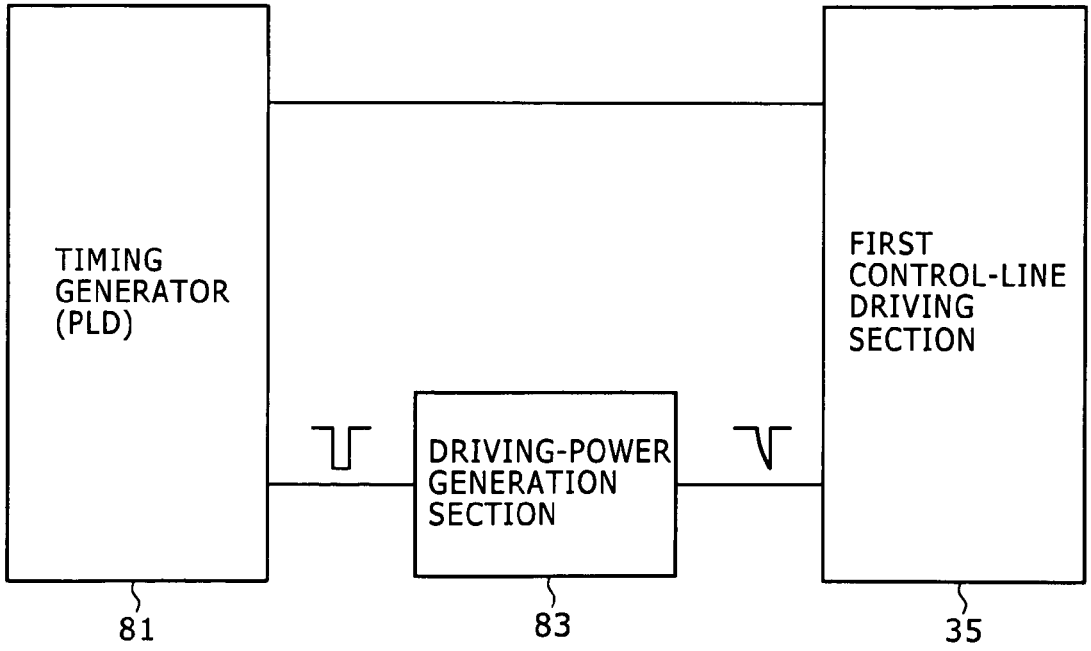
FIG. 43 is a block diagram showing the configuration of a circuit for generating the power-supply voltage pulse.

FIG. 43 is a block diagram showing the configuration of a circuit for generating the power-supply voltage pulse WSP mentioned before and supplying the power-supply voltage pulse WSP to the control-line driving section 35.

As shown in the block diagram of FIG. 14, the power-supply voltage pulse WSP is generated by a timing generator 81 and a driving power-supply generator 83. The timing generator 81 is a circuit for generating driving pulses each having a rectangular waveform supplied to not only the first control-line driving section 35, but also to the other control-line driving section and the driving power-supply generator 83. It is to be noted that the timing of the falling edge of the driving pulse lags behind the timing of the start timing of the mobility compensation period by a delay time determined in advance.

The driving power-supply generator 83 is a circuit for generating the power-supply voltage pulse WSP on the basis of the driving pulse received from the timing generator 81 as a driving pulse having a rectangular waveform. The power-supply voltage pulse WSP has a waveform with a falling portion folded and bent at two stages.

Figure 44:
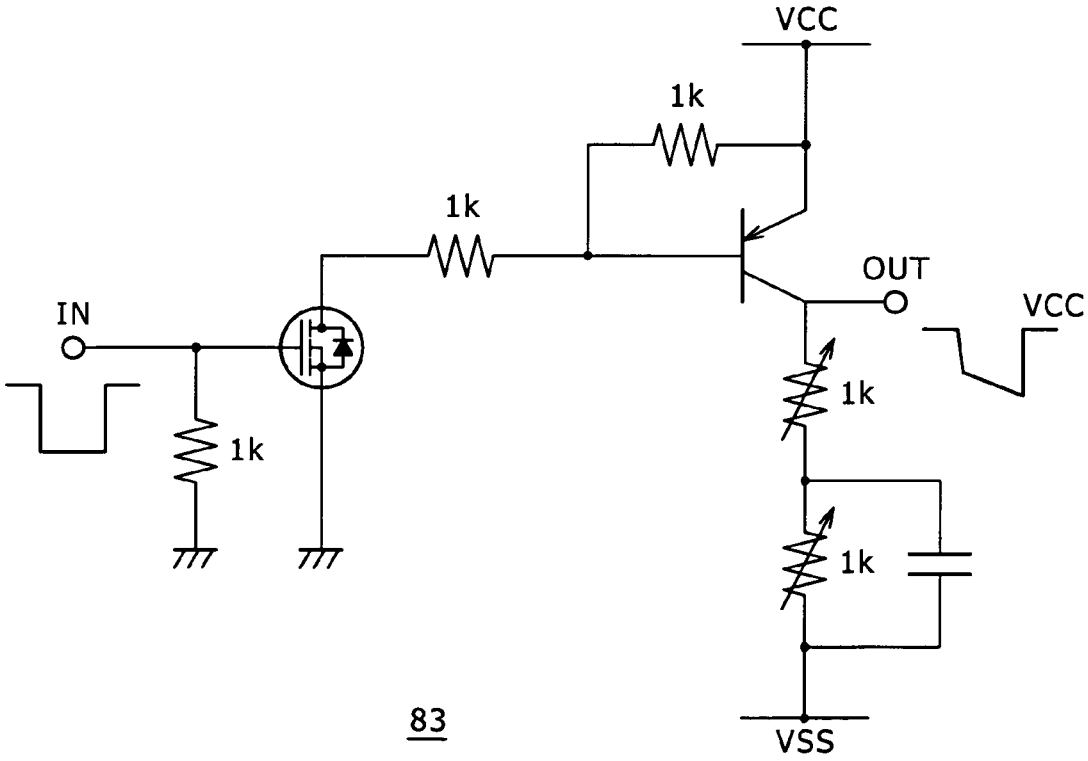
FIG. 44 is a diagram showing a typical circuit of a driving power-supply generator.

FIG. 44 is a diagram showing a typical circuit of the driving power-supply generator 83. The driving power-supply generator 83 shown in the circuit diagram of FIG. 44 is a typical pulse generator with a configuration for generating a pseudo power-supply voltage pulse WSP approximating the mobility compensation curve. As shown in the diagram of FIG. 44, the driving power-supply generator 83 employs two transistors, one capacitor, three resistors each having a fixed resistance and two resistors each having a variable resistance.

The driving power-supply generator 83 carries out an analog process on the input driving pulse in order to generate a power-supply voltage pulse WSP having a waveform with a falling portion folded and bent at two stages. The waveform falling portion folded and bent at the first stage has a large gradient whereas the waveform falling portion folded and bent at second first stage has a small gradient. Of course, by folding and bending the falling portion of the waveform of the power-supply voltage pulse WSP at several stages, it is possible to generate a power-supply voltage pulse WSP close to the ideal mobility compensation curve. The larger the number of stages, the closer the power-supply voltage pulse WSP to the ideal mobility compensation curve.

(D-3): Other Typical Configuration of the Line-Signal Driving Section

In the previous explanation of the embodiment, assuming a minus-direction coupling voltage change, the amplitude of a signal generated by the digital/analog conversion circuit 45 employed in the signal-line driving section 33 is made greater than the amplitude of a signal which is desired eventually. However, the configuration of the generally used contemporary signal-line driving section 5 can be used as the configuration of the signal-line driving section 33 as it is.

(D-4): First Other Structure of the Sub-Pixel

In the case of the first embodiment described previously, the parasitic capacitor existing between the gate and main electrodes of the device driving transistor N2 is used for passing on a change of an ON electric potential appearing on the lighting control signal line LSL to the gate electrode G of the device driving transistor N2.

It is to be noted that, the larger the capacitance of the parasitic capacitor existing between the gate and main electrodes of the device driving transistor N2, the more effective the transfer of a change of an ON electric potential appearing on the lighting control signal line LSL to the gate electrode G of the device driving transistor N2.

Figure 45B:
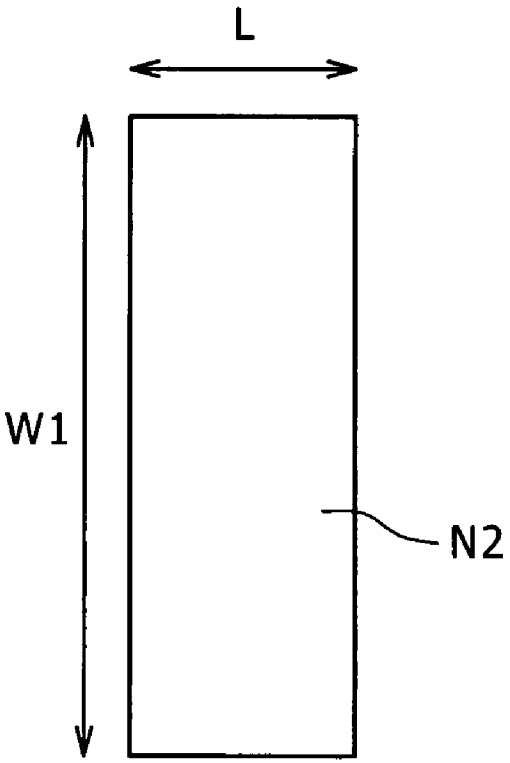
FIGS. 45A and 45B are explanatory diagrams showing typical dimensions of the signal sampling transistors.
Figure 45A:
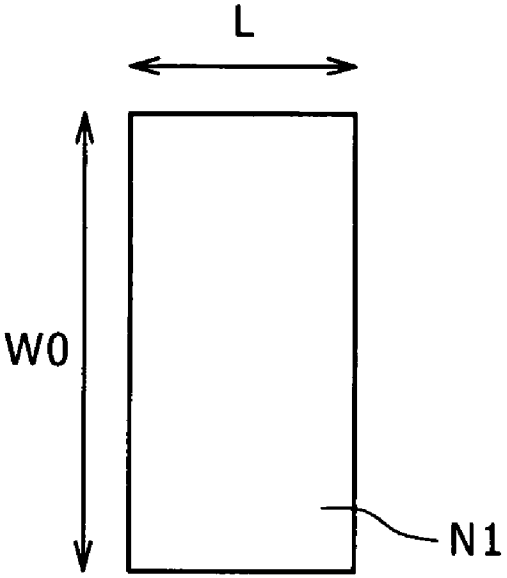

In general, by increasing a ratio W/L, the capacitance of the parasitic capacitor existing between the gate and main electrodes of the device driving transistor N2 can be raised. The ratio W/L is a ratio of the length L of the channel of a thin-film transistor to the width W of the channel of the thin-film transistor. Thus, by increasing the ratio W/L of the device driving transistor N2, at least, an effective coupling operation can be carried out. FIGS. 45A and 45B are a plurality of explanatory diagrams which each show a typical configuration of a thin-film transistor employed in the sub-pixel.

To be more specific, FIG. 45A is an explanatory diagram showing typical dimensions of the signal sampling transistor N1 whereas FIG. 45B is an explanatory diagram which shows typical dimensions of the device driving transistor N2. FIGS. 45A and 45B show typical examples in which the size of the device driving transistor N2 is greater than the size of the signal sampling transistor N1.

(D-5): Second Other Structure of the Sub-Pixel

In the case of the first embodiment described previously, the parasitic capacitor existing between the gate and main electrodes of the device driving transistor N2 is used for passing on a change of an ON electric potential appearing on the lighting control signal line LSL to the gate electrode G of the device driving transistor N2.

It is to be noted that, the larger the capacitance of the parasitic capacitor existing between the gate and main electrodes of the device driving transistor N2, the more effective the transfer of a change of an ON electric potential appearing on the lighting control signal line LSL to the gate electrode G of the device driving transistor N2.

Figure 46:
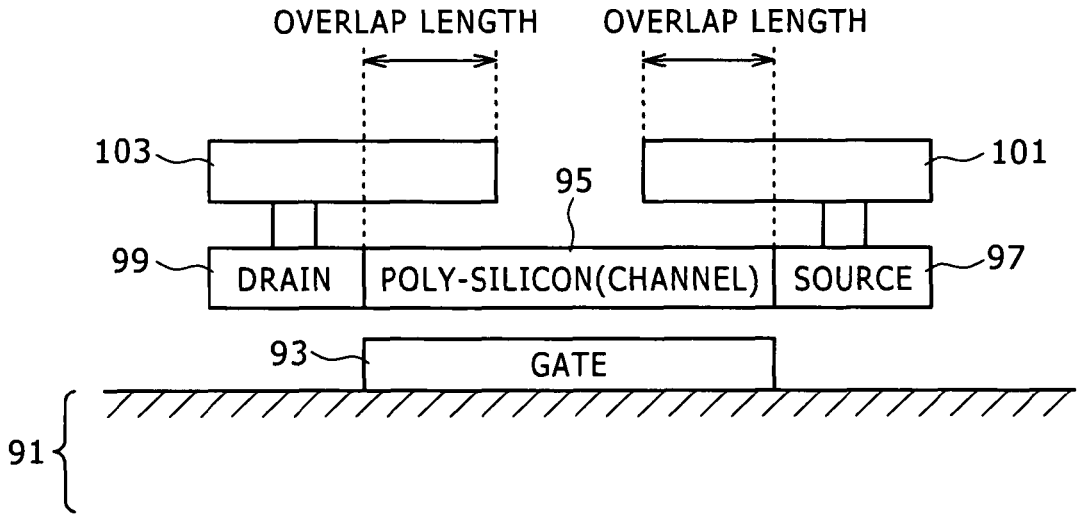
FIG. 46 is an explanatory diagram to be referred to in description of an overlap quantity.

For example, by increasing the length of an overlap between the gate electrode and the drain/source electrodes in the device driving transistor N2, the capacitance of the parasitic capacitor existing between the gate and main electrodes of the device driving transistor N2 can also be increased. The overlap length is described below. FIG. 46 is a diagram showing a typical structure of a cross section of the device driving transistor N2 which is a thin-film transistor of a bottom-gate type.

The device driving transistor N2 has a structure in which the surface of a gate electrode 93 formed on the surface of an insulation substrate 91 which is for example a glass panel is covered by an interlayer insulation film, and a channel area 95, a source area 97 as well as a drain area 99 are created on the interlayer insulation film. The source area 97 is connected to a metallic wire 101 whereas the drain area 99 is connected to a metallic wire 103 so that the metallic wires 101 and 103 overlap the channel area 95 in two regions. The size of an overlap in each of the regions is referred to as an overlap length. It is needless to say that it is also possible to provide a configuration of the device driving transistor N2 in which an overlap is created only between the gate electrode and a main electrode which is connected to the lighting control signal line LSL.

(D-6): Third Other Structure of the Sub-Pixel

In the case of the first embodiment described previously, the parasitic capacitor existing between the gate and main electrodes of the device driving transistor N2 is used for passing on a change of an ON electric potential appearing on the lighting control signal line LSL to the gate electrode G of the device driving transistor N2.

Figure 47:
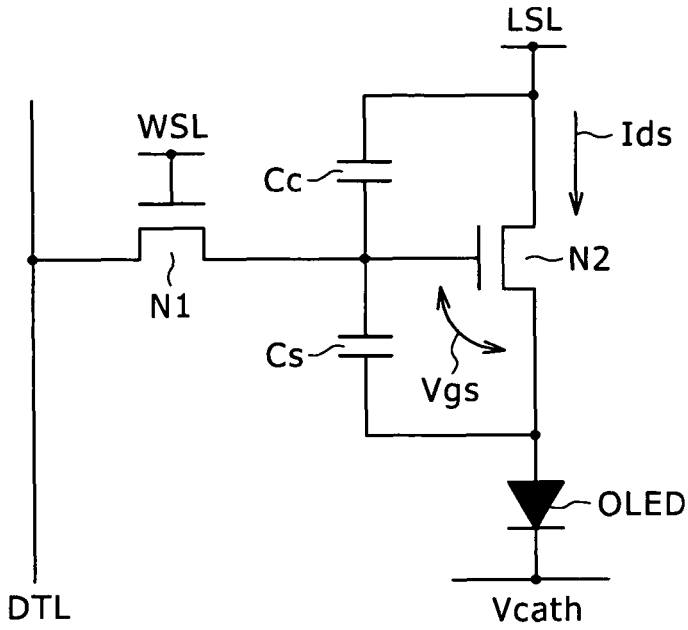
FIG. 47 is a circuit diagram showing another typical configuration of the sub-pixel.

However, a coupling capacitor Cc for supplementing the parasitic capacitor can be connected between the gate electrode G of the device driving transistor N2 and the main electrode included in the device driving transistor N2 to serve as an electrode connected to the lighting control signal line LSL as shown in a circuit diagram of FIG. 47.

(D-7): Fourth Other Structure of the Sub-Pixel

In the case of the second embodiment described previously, the number of thin-film transistors composing the sub-pixel circuit is two. However, the configuration of the sub-pixel is by no means limited to the second embodiment. For example, the number of thin-film transistors composing the sub-pixel can also be three or an integer greater than three.

Figure 48:
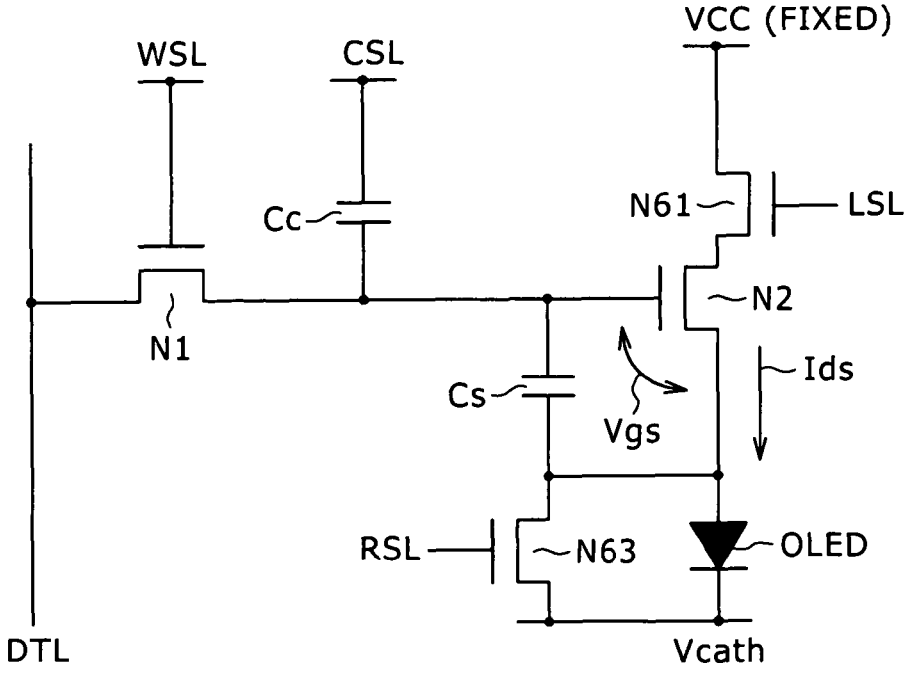
FIG. 48 is a circuit diagram showing a further typical configuration of the sub-pixel.

FIG. 48 is a circuit diagram showing a typical configuration of the sub-pixel which employs four thin-film transistors. It is to be noted that, in the typical configuration shown in the circuit diagram of FIG. 48, components identical with their counterparts employed in the configuration shown in the circuit diagram of FIG. 27 are denoted by the same reference notations as the counterparts. The typical configuration shown in the circuit diagram of FIG. 48 includes three new configuration features.

The first configuration feature is the fact that the driving power is supplied to the device driving transistor N2 through a fixed-power-supply line VCC. The second configuration feature is the fact that a lighting control transistor N61 is connected between the fixed-power-supply line VCC and the device driving transistor N2, forming a series circuit in conjunction with the device driving transistor N2.

In the case of the typical configuration shown in the circuit diagram of FIG. 48, the lighting control transistor N61 is created to function as a thin-film transistor of the N-channel type. The lighting control transistor N61 is controlled to enter a turned-on or turned-off state by the lighting control signal line LSL. When the lighting control transistor N61 is put in a turned-on state, a driving power is supplied to the device driving transistor N2 from the fixed-power-supply line VCC by way of the lighting control transistor N61. When the lighting control transistor N61 is put in a turned-off state, on the other hand, the operation to supply a driving power to the device driving transistor N2 from the fixed-power-supply line VCC by way of the lighting control transistor N61 is halted. The control to put the lighting control transistor N61 in a turned-off state is executed selectively in the no-light emission period and the turned-off portion of the light emission period.

The third configuration feature is the fact that a reset transistor N63 is connected in parallel to the organic EL device OLED. The reset transistor N63 is also created to function as a thin-film transistor of the N-channel type. The reset transistor N63 is controlled to enter a turned-on or turned-off state by a reset control line RSL. The reset transistor N63 is controlled to enter a turned-on state at an initialization time. In other periods, on the other hand, the reset transistor N63 is controlled to enter a turned-off state.

Figure 49:
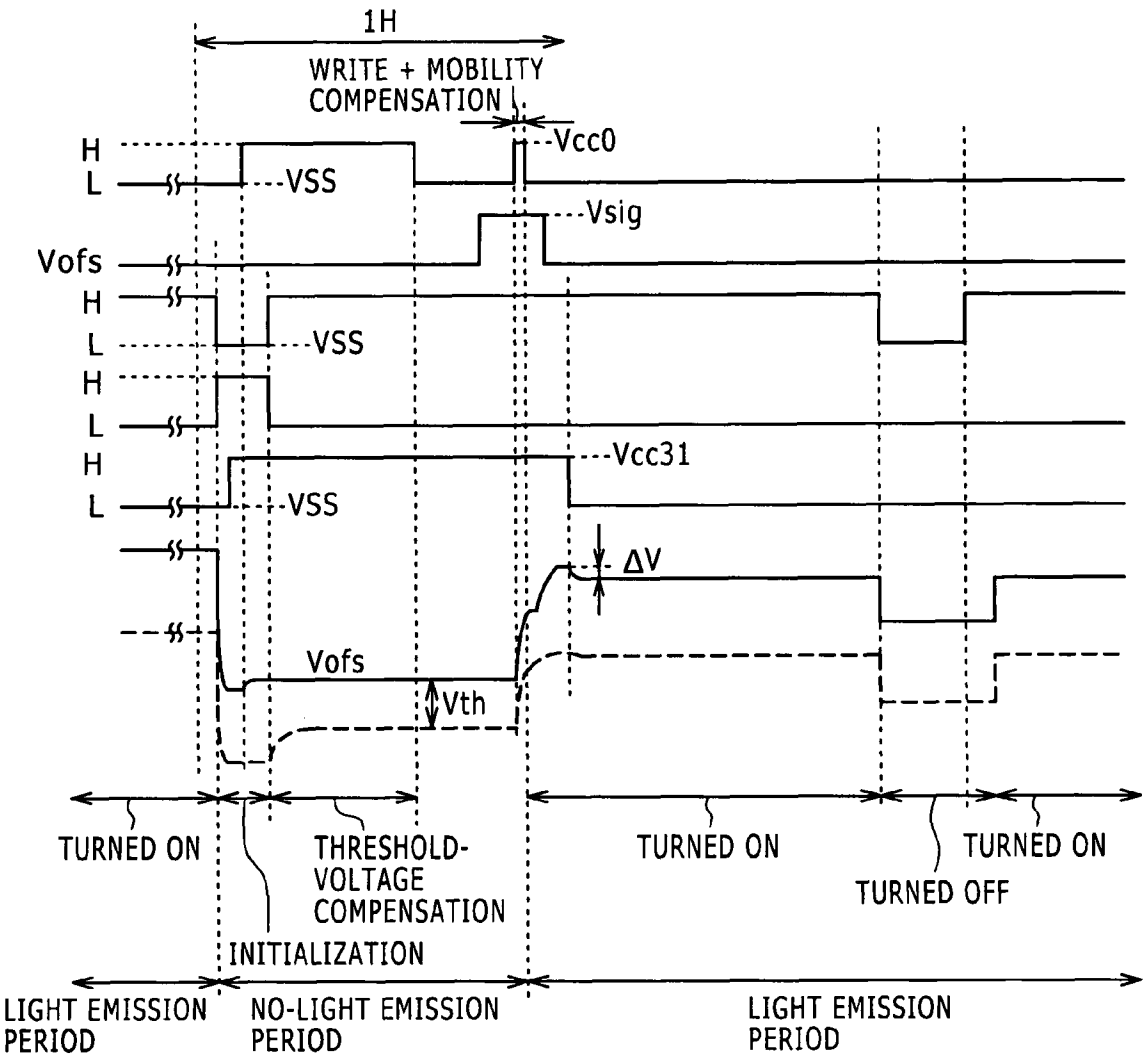
FIGS. 49A to 49G are timing charts showing waveforms representing changes of driving signals inside the sub-pixel shown in the circuit diagram of FIG. 48.

FIGS. 49A to 49G are timing diagrams showing changes of electric potentials which are generated inside the structure of the sub-pixel shown in the circuit diagram of FIG. 48. To be more specific, FIG. 49A is a timing chart showing a waveform representing changes of a driving signal which is appearing on the write control signal line WSL whereas FIG. 49B is a timing chart showing a waveform representing changes of a driving signal which is appearing on the data signal line DTL. FIG. 49C is a timing chart showing a waveform representing changes of a driving signal which is appearing on the lighting control signal line LSL whereas FIG. 49D is a timing chart showing a waveform representing changes of a driving signal which is appearing on the reset control line RSL. FIG. 49E is a timing chart showing a waveform representing changes of a driving signal which is appearing on the coupling control signal line CSL. FIG. 49F is a timing chart showing a waveform representing changes of a gate electric potential Vg which is appearing at the gate electrode G of the device driving transistor N2 whereas FIG. 49G is a timing chart showing a waveform representing changes of a source electric potential Vs which is appearing at the source electrode S of the device driving transistor N2.

Basic driving operations of the fourth other typical configuration shown in the circuit diagram of FIG. 48 are identical with the basic driving operations carried out by the second embodiment. Operations peculiar to the fourth other typical configuration shown in the circuit diagram of FIG. 48 are an operation carried out by the lighting control transistor N61 to control the operation to supply a driving power to the device driving transistor N2 and an operation carried out by the reset transistor N63 at an initialization time.

The operations carried out by the fourth other typical configuration shown in the circuit diagram of FIG. 48 are explained by focusing on only differences between the fourth other typical configuration and the second embodiment. At an initialization time for example, the lighting control transistor N61 is controlled to enter a turned-off state whereas the reset transistor N63 is controlled to enter a turned-on state. At that time, the specific electrode of the signal holding capacitor Cs is connected to the line conveying the ground electric potential VSS so that electric charge accumulated in the signal holding capacitor Cs is drawn to the line conveying the ground electric potential VSS in an electrical discharge process. In this way, an initialization process is carried out.

The lighting control transistor N61 is then controlled to enter a turned-on state in order to end the initialization process. At that time, the reset transistor N63 is controlled to enter a turned-off state. Thereafter, operations carried out by the fourth other typical configuration having an equivalent circuit shown in the circuit diagram of FIG. 48 are identical with the operations carried out by the second embodiment.

(D-8): Product Examples (a): Electronic Apparatus

The description given so far has explained organic EL panel modules. The organic EL panel modules are also made available in the market as commercial products implemented in a variety of electronic apparatus. The following description explains typical implementations of the organic EL panel modules in some of the electronic apparatus.

Figure 50:
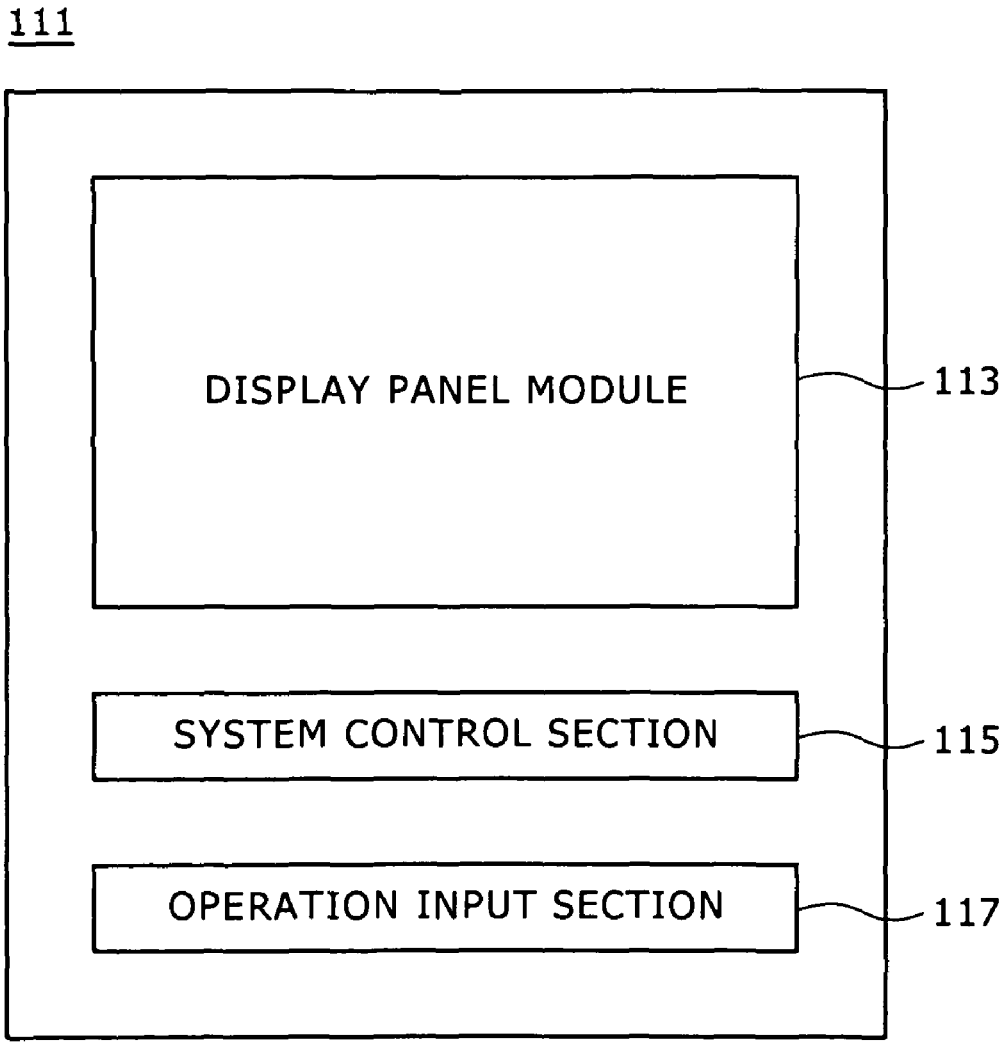
FIG. 50 is a block diagram showing a typical conceptual configuration of an electronic apparatus.

FIG. 50 is a block diagram showing a typical conceptual configuration of an electronic apparatus 111. As shown in the figure, the electronic apparatus 111 employs a display panel module 113 including the driving circuits described so far, a system control section 115 and an operation input section 117. Processing carried out by the system control section 115 depends on the function of the electronic apparatus 111. The operation input section 117 is a section for receiving operation inputs entered by the user to the system control section 115. The operation input section 117 includes a mechanical interface and/or a graphic interface. Typical examples of the mechanical interface are switches and buttons.

Figure 51:
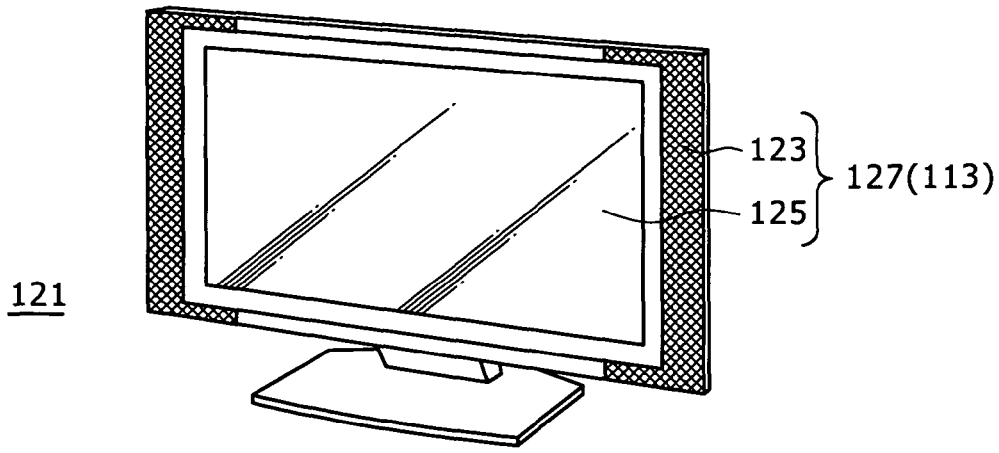
FIGS. 51 to 55 are diagrams each showing exemplary commercial products of the electronic apparatus.

FIG. 51 is a diagram showing a typical external view of an electronic apparatus 111 which functions as a TV receiver 121. The case front face of the TV receiver 121 includes a display screen 127 which has a front panel 123 and a filter glass 125. The display screen 127 corresponds to the display panel module 113 shown in the block diagram of FIG. 50.

Figure 52A:
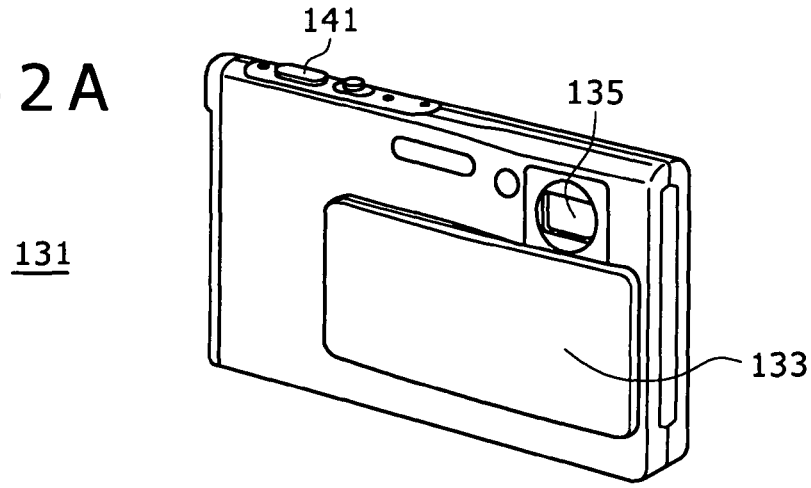
Figure 52B:
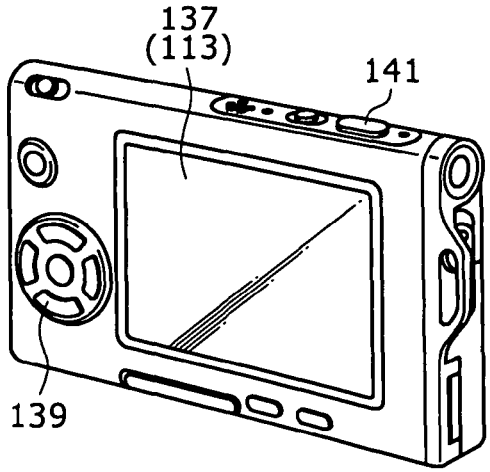

In addition, the electronic apparatus 111 may also be assumed to be a digital camera 131. FIGS. 52A and 52B are diagrams each showing a typical external view of the digital camera 131. To be more specific, FIG. 52A is a diagram showing a typical external view of the front side (or the subject side) of the digital camera 131 whereas FIG. 52B is a diagram showing a typical external view of the rear side (or the photographer side) of the digital camera 131.

As shown in the figures, the digital camera 131 employs a protection cover 133, a photographing lens 135, a display screen 137, a control switch 139 and a shutter button 141. The display screen 137 corresponds to the display panel module 113 shown in the block diagram of FIG. 50.

Figure 53:
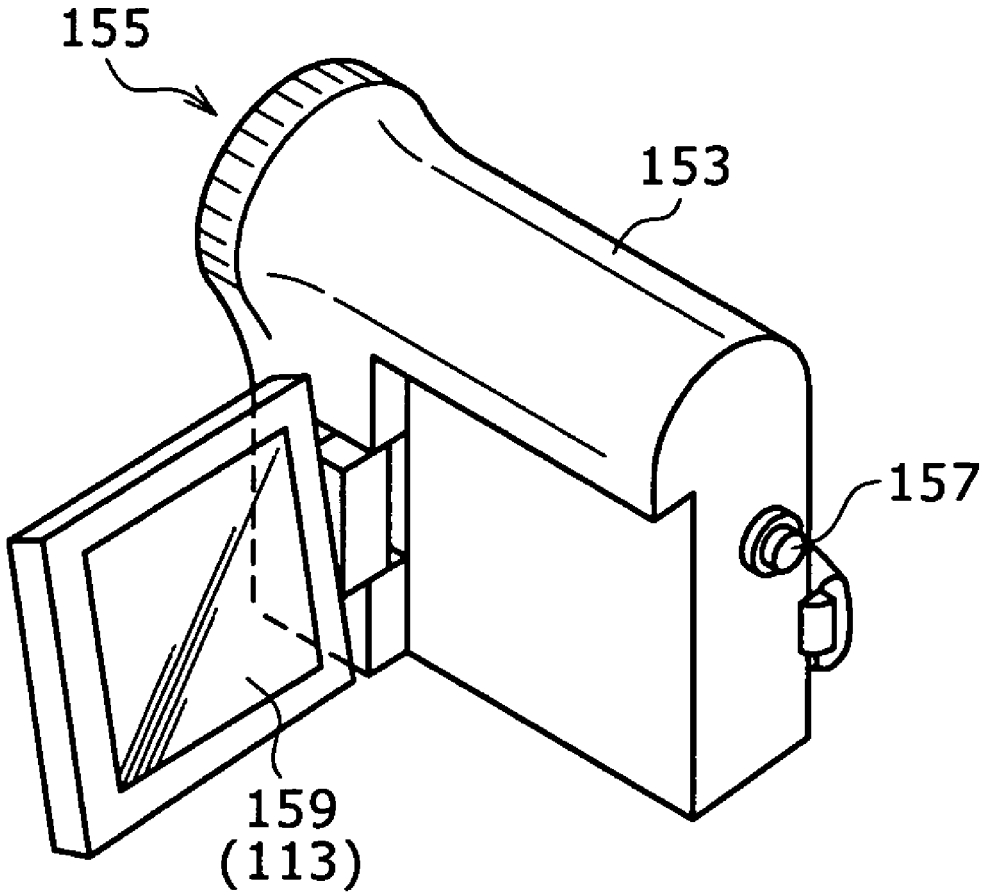

In addition, the electronic apparatus 91 may also be assumed to be a video camera 151. FIG. 53 is a diagram showing a typical external view of the video camera 151.

As shown in the figure, the video camera 151 includes a main unit 153, an image-taking lens 155, a photographing start/stop switch 157 and a display screen 139. The image-taking lens 155 is provided on the main unit 153 to serve as a lens for taking an image of a subject of video photographing. The display screen 159 corresponds to the display panel module 113 shown in the block diagram of FIG. 50.

Figure 54A:
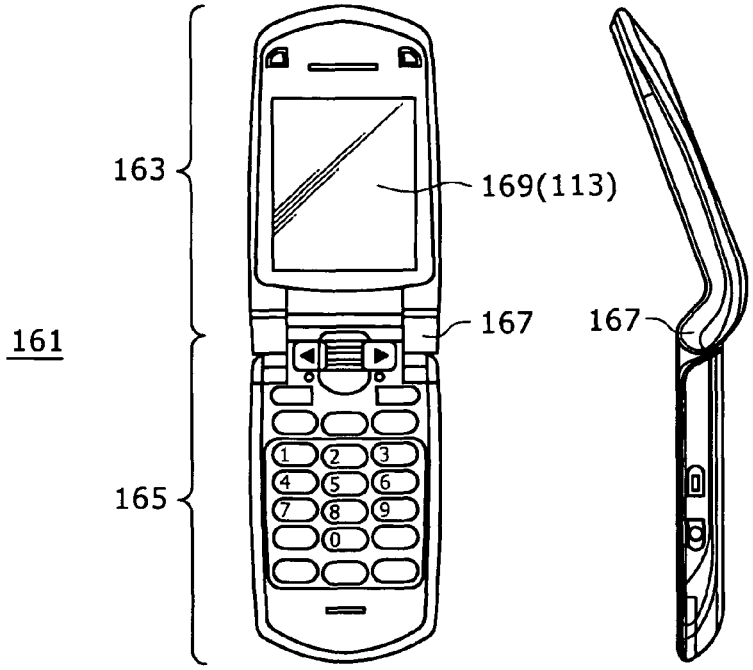
Figure 54B:
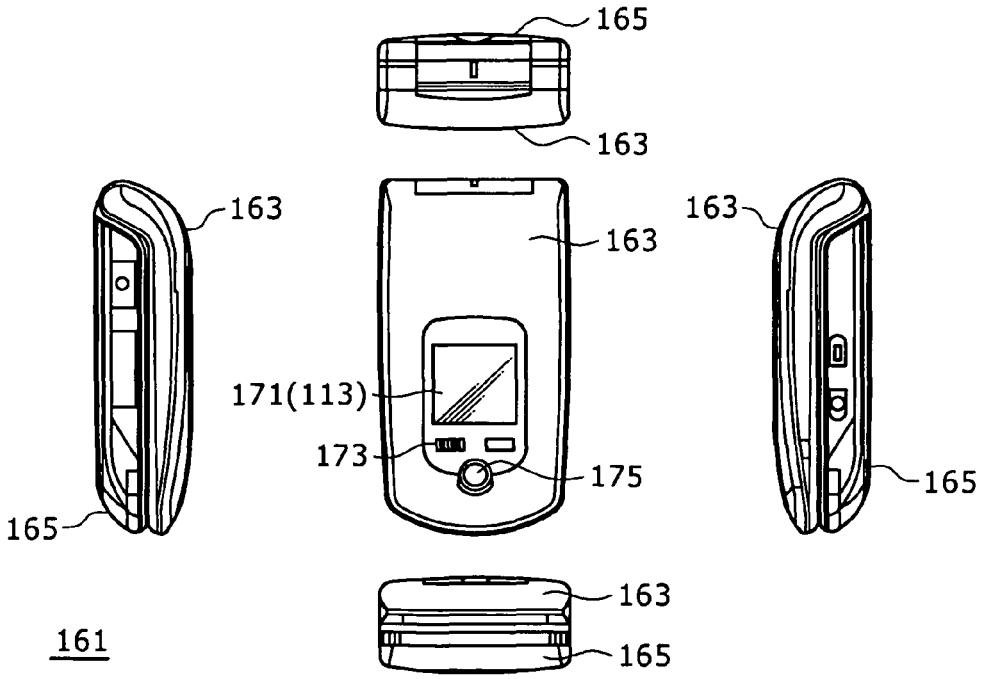

In addition, the electronic apparatus 111 may also be assumed to be a portable terminal. FIGS. 54A and 54B are diagrams each showing a typical external view of the portable terminal which serves as a cellular phone 161 of a fold-back type. To be more specific, FIG. 54A is a diagram showing a typical external view of the cellular phone 161 with a case thereof opened whereas FIG. 54B is a diagram showing a typical external view of the cellular phone 161 with the case folded back.

As shown in the figures, the cellular phone 161 employs an upper case 163, a lower case 165, a link section 167, a display screen 169, an auxiliary display screen 171, a picture light 173 and an image taking lens 175. In the case of this cellular phone 161, the link section 167 is a hinge. The display screen 169 and the auxiliary display screen 171 correspond to the display panel module 113 shown in the block diagram of FIG. 50.

Figure 55:
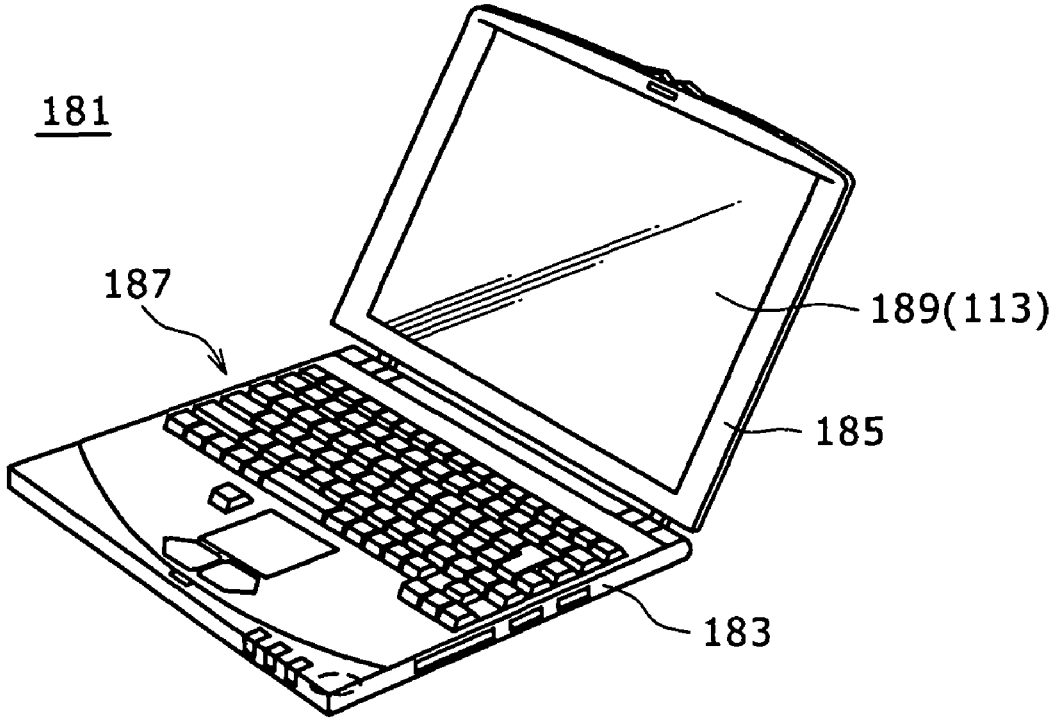

In addition, the electronic apparatus 111 may also be assumed to be a computer. FIG. 55 is a diagram showing a typical external view of the computer which is implemented as a notebook computer 181.

As shown in the figure, the notebook computer 181 employs an upper case 185, a lower case 183, a keyboard 187 and a display screen 189. The display screen 189 corresponds to the display panel module 113 shown in the block diagram of FIG. 50.

In addition, the electronic apparatus 111 may also be assumed to be an apparatus other than the electronic apparatus described above. Typical examples of the other electronic apparatus are an audio reproduction apparatus, a game machine, an electronic notebook and an electronic dictionary.

(D-9): Other Typical Display Devices

Each of the embodiments described above applies the present invention to an organic EL panel module.

However, the configuration of the signal and control line driving sections described above can be applied also to a display panel module of another light-emission type.

For example, the configuration of the signal and control line driving sections can be applied also to a display apparatus employing LEDs (Light Emitting Diode) laid out to form a two dimensional matrix. In addition, the configuration of the signal and control line driving sections can be applied also to a display panel module employing light emitting devices laid out on the display screen as devices each having a diode structure. On top of that, the configuration of the signal and control line driving sections can be applied also to an inorganic EL panel.

(D-10) Others

Each of the embodiments described above can be changed to a variety of conceivable modified versions within a range of essentials of the present invention. In addition, it is also possible to conceive a variety of changes/applications which are obtained by creations and/or combinations based on the descriptions in this specifications.

The present application contains subject matter related to that disclosed in Japanese Priority Patent Application JP 2008-251711 filed in the Japan Patent Office on Sep. 29, 2008, the entire content of which is hereby incorporated by reference.

What is claimed is:

1. A self-light-emission-type display panel module comprising:

a pixel array section including pixel areas laid out to form a two dimensional matrix in a display area to serve as pixel areas each having a signal holding capacitor, a device driving transistor provided with a control electrode connected to a first electrode of said signal holding capacitor and a first current electrode connected to a second electrode of said signal holding capacitor to serve as a transistor for providing a self-light-emitting device connected to said device driving transistor with a driving current having a magnitude according to a voltage stored in said signal holding capacitor, and a signal sampling transistor for controlling an operation to supply a signal electric potential to said control electrode of said device driving transistor;

a first driving section configured to assert said signal electric potential on a data signal line;

a second driving section configured to assert an electric-potential write timing signal on a first control line connected to a control electrode of said signal sampling transistor; and a third driving section configured to provide a second control line connected to a second current electrode of said device driving transistor sequentially with the following three different driving voltages:

a first driving voltage having a lowest electric potential during a time span between the initial time of a no-light emission period and the start of a period for compensating said device driving transistor for characteristic variations, a second driving voltage having a highest electric potential during a time span between said start of said period for compensating said device driving transistor and an initial portion of a light emission period, and a third driving voltage having an intermediate electric potential after said initial portion of said light emission period.

2. The display panel module according to claim 1 wherein a period T used to assert each signal electric potential corresponding to a pixel gradation is set at a value shorter than a mobility compensation time t calculated for said signal electric potential.

3. A self-light-emission-type display panel module comprising:

a pixel array section including pixel areas laid out to form a two dimensional matrix in a display area to serve as pixel areas each having a signal holding capacitor, a device driving transistor provided with a control electrode connected to a first electrode of said signal holding capacitor and a first current electrode connected to a second electrode of said signal holding capacitor to serve as a transistor for providing a self-light-emitting device connected to said device driving transistor with a driving current having a magnitude according to a voltage stored in said signal holding capacitor, a signal sampling transistor for controlling an operation to supply a signal electric potential to said control electrode of said device driving transistor, and a coupling capacitor having a first electrode connected to said control electrode of said device driving transistor and a second electrode connected to a third control line;

a first driving section configured to assert said signal electric potential on a data signal line;

a second driving section configured to assert an electric-potential write timing signal on a first control line connected to a control electrode of said signal sampling transistor;

a third driving section configured to control an operation to supply a driving voltage to said device driving transistor and an operation to stop said operation to supply a driving voltage to said device driving transistor; and a fourth driving section configured to provide said third control line sequentially with the following two different driving voltages:

a high-level driving voltage having a relatively high electric potential during a time span between the start of a characteristic compensation period and an initial portion of a light emission period, and a low-level driving voltage having a relatively low electric potential after said initial portion of said light emission period.

4. The display panel module according to claim 3 wherein a period T used to assert each signal electric potential corresponding to a pixel gradation is set at a value shorter than a mobility compensation time t calculated for said signal electric potential.

5. A self-light-emission-type display panel module comprising:

a pixel array section including pixel areas laid out to form a two dimensional matrix in a display area to serve as pixel areas each having at least a signal holding capacitor, a device driving transistor provided with a control electrode connected to a first electrode of said signal holding capacitor and a first current electrode connected to a second electrode of said signal holding capacitor to serve as a transistor for providing a self-light-emitting device connected to said device driving transistor with a driving current having a magnitude according to a voltage stored in said signal holding capacitor, and a signal sampling transistor for controlling an operation to supply a signal electric potential to said control electrode of said device driving transistor;

a first driving section configured to assert said signal electric potential on a data signal line;

a second driving section configured to assert an electric-potential write timing signal on a first control line connected to a control electrode of said signal sampling transistor; and a third driving section configured to decrease an electric potential appearing at said control electrode of said device driving transistor through a coupling effect exercised after an initial portion of a light emission period.

6. An electronic apparatus comprising:

a self-light-emission-type display panel module having a pixel array section including pixel areas laid out to form a two dimensional matrix in a display area to serve as pixel areas each having a signal holding capacitor, a device driving transistor provided with a control electrode connected to a first electrode of said signal holding capacitor and a first current electrode connected to a second electrode of said signal holding capacitor to serve as a transistor for providing a self-light-emitting device connected to said device driving transistor with a driving current having a magnitude according to a voltage stored in said signal holding capacitor, and a signal sampling transistor for controlling an operation to supply a signal electric potential to said control electrode of said device driving transistor, a first driving section configured to assert said signal electric potential on a data signal line, a second driving section configured to assert an electric-potential write timing signal on a first control line connected to a control electrode of said signal sampling transistor, and a third driving section configured to provide a second control line connected to a second current electrode of said device driving transistor sequentially with the following three different driving voltages:

a first driving voltage having a lowest electric potential during a time span between the initial time of a no-light emission period and the start of a period for compensating said device driving transistor for characteristic variations, a second driving voltage having a highest electric potential during a time span between said start of said period for compensating said device driving transistor and an initial portion of a light emission period, and a third driving voltage having an intermediate electric potential after said initial portion of said light emission period;

a system control section configured to control operations of an entire system of said electronic apparatus; and an operation input section configured to receive operation inputs entered to said system control section.

7. An electronic apparatus comprising:

a self-light-emission-type display panel module having a pixel array section including pixel areas laid out to form a two dimensional matrix in a display area to serve as pixel areas each having a signal holding capacitor, a device driving transistor provided with a control electrode connected to a specific one of the two electrodes of said signal holding capacitor and a specific main electrode connected to the other electrode of said signal holding capacitor to serve as a transistor for providing a self-light-emitting device connected to said device driving transistor with a driving current having a magnitude according to a voltage stored in said signal holding capacitor, a signal sampling transistor for controlling an operation to supply a signal electric potential to said control electrode of said device driving transistor, and a coupling capacitor having a first electrode connected to said control electrode of said device driving transistor and a second electrode connected to a third control line, a first driving section configured to assert said signal electric potential on a data signal line, a second driving section configured to assert an electric-potential write timing signal on a first control line connected to a control electrode of said signal sampling transistor, a third driving section configured to control an operation to supply a driving voltage to said device driving transistor and an operation to stop said operation to supply a driving voltage to said device driving transistor, and a fourth driving section configured to provide said third control line sequentially with the following two different driving voltages:

a high-level driving voltage having a relatively high electric potential during a time span between the start of a characteristic compensation period and an initial portion of a light emission period, and a low-level driving voltage having a relatively low electric potential after said initial portion of said light emission period;

a system control section configured to control operations of an entire system of said electronic apparatus; and an operation input section configured to receive operation inputs entered to said system control section.

8. An electronic apparatus comprising:

a self-light-emission-type display panel module having a pixel array section including pixel areas laid out to form a two dimensional matrix in a display area to serve as pixel areas each having at least a signal holding capacitor, a device driving transistor provided with a control electrode connected to a first electrode of said signal holding capacitor and a first current electrode connected to a second electrode of said signal holding capacitor to serve as a transistor for providing a self-light-emitting device connected to said device driving transistor with a driving current having a magnitude according to a voltage stored in said signal holding capacitor, and a signal sampling transistor for controlling an operation to supply a signal electric potential to said control electrode of said device driving transistor, a first driving section configured to assert said signal electric potential on a data signal line, a second driving section configured to assert an electric-potential write timing signal on a first control line connected to a control electrode of said signal sampling transistor, and a third driving section configured to decrease an electric potential appearing at said control electrode of said device driving transistor through a coupling effect exercised after an initial portion of a light emission period;

a system control section configured to control operations of an entire system of said electronic apparatus; and an operation input section configured to receive operation inputs entered to said system control section.

* * * * *